US008273513B2

(12) United States Patent
Tamoto et al.

(10) Patent No.: US 8,273,513 B2
(45) Date of Patent: Sep. 25, 2012

(54) IMAGE FORMING APPARATUS, PROCESS CARTRIDGE, AND IMAGE BEARING MEMBER

(75) Inventors: Nozomu Tamoto, Numazu (JP); Mitsuaki Hirose, Shizuoka-ken (JP); Akio Kosuge, Yokohama (JP); Makoto Yasuda, Hiratsuka (JP)

(73) Assignee: Ricoh Company, Limited, Tokyo (JP)

( * ) Notice: Subject to any disclaimer, the term of this patent is extended or adjusted under 35 U.S.C. 154(b) by 137 days.

(21) Appl. No.: 12/823,865

(22) Filed: Jun. 25, 2010

(65) Prior Publication Data

US 2010/0330475 A1 Dec. 30, 2010

(30) Foreign Application Priority Data

Jun. 25, 2009 (JP) ..... 2009-150530
Apr. 28, 2010 (JP) ..... 2010-103131

(51) Int. Cl.
*G03G 5/00* (2006.01)

(52) U.S. Cl. ..... 430/66; 399/159; 399/346

(58) Field of Classification Search ..... 430/66; 399/159, 346
See application file for complete search history.

(56) References Cited

U.S. PATENT DOCUMENTS

| | | | | |
|---|---|---|---|---|
| 5,302,485 | A * | 4/1994 | Swain | 430/127 |
| 6,861,188 | B2 | 3/2005 | Ikegami et al. | |
| 6,899,983 | B2 | 5/2005 | Tamoto et al. | |
| 6,936,388 | B2 | 8/2005 | Suzuki et al. | |
| 7,018,755 | B2 | 3/2006 | Ikegami et al. | |
| 7,160,658 | B2 | 1/2007 | Suzuki et al. | |
| 7,381,511 | B2 | 6/2008 | Ikegami et al. | |
| 2008/0292981 | A1 | 11/2008 | Toda et al. | |
| 2008/0318142 | A1 | 12/2008 | Kawasaki et al. | |

FOREIGN PATENT DOCUMENTS

| | | |
|---|---|---|
| JP | 53-92133 | 8/1978 |
| JP | 56-48637 | 5/1981 |
| JP | 60-9259 | 3/1985 |
| JP | 2-139566 | 5/1990 |
| JP | 2-150850 | 6/1990 |
| JP | 11-327303 | 11/1999 |
| JP | 2002-287567 | 10/2002 |
| JP | 2004-302452 | 10/2004 |
| JP | 2005-249901 | 9/2005 |
| JP | 2005-345783 | 12/2005 |

(Continued)

*Primary Examiner* — Mark A Chapman
(74) *Attorney, Agent, or Firm* — Oblon, Spivak, McClelland, Maier & Neustadt, L.L.P.

(57) ABSTRACT

An image forming apparatus including an image bearing member having an electroconductive substrate on which are provided at least a photosensitive layer and a protection layer, in that sequence, a charging device that charges the surface of the image bearing member to form a latent electrostatic image thereon, a development device that develops the latent electrostatic image with a development agent containing toner to obtain a developed toner image, a cleaning device that removes toner remaining on the surface of the image bearing member and a lubricant material applicator that applies a lubricant material to the surface of the image bearing member, the protection layer containing a cured resin and a filler and the surface form of the protection layer having an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

20 Claims, 4 Drawing Sheets

FOREIGN PATENT DOCUMENTS

| | | |
|---|---|---|
| JP | 2007-79244 | 3/2007 |
| JP | 2008-139804 | 6/2008 |
| JP | 2008-233165 | 10/2008 |
| JP | 2008-261971 | 10/2008 |
| JP | 4194973 | 10/2008 |

* cited by examiner

IMAGE FORMING APPARATUS, PROCESS CARTRIDGE, AND IMAGE BEARING MEMBER

BACKGROUND OF THE INVENTION

1. Field of the Invention

The present invention relates to an image forming apparatus, a process cartridge, and an image bearing member. The image forming apparatus, the process cartridge, and the image bearing member are applied to a photocopier, a facsimile machine, a laser printer, a direct digital platenmaker, etc.

2. Discussion of the Background

In recent years, image forming apparatuses such as laser printers, digital photocopiers, etc., that employ an electrophotographic system have been improved with regard to image quality and stability thereof and have now become widely diffused. Such image forming apparatuses use an image bearing member such as a photoreceptor or photoconductor the surface of which is charged and irradiated to form a latent electrostatic image thereon, followed by development to obtain a visible image.

Widely used photoconductors are mainly formed of organic materials because these materials are advantageous in terms of cost, productivity, variety of choices of materials used, impact on global environment, etc. Such organic photoconductors are formed of a photosensitive layer mainly containing a photosensitive material, and can be classified into two main types: A single-layer type in which a single layer assumes both a charge generation function and a charge transport function, and a laminate type having a charge generation layer assuming a charge generation function and a charge transport layer assuming a charge transport function.

The mechanism of forming latent electrostatic images on an image bearing member of a functionally separated laminate type involves irradiating a uniformly charged image bearing member with light, which then passes through the charge transport layer and is absorbed in charge generation material in the charge generation layer, resulting in generation of charge (actually a pair of charges). One in the pair is infused into the charge transport layer at the interface between the charge generation layer and the charge transport layer and moved through the charge transport layer by an electric field to the surface of the image bearing member where it then neutralizes the surface charge provided by charging, resulting in formation of a latent electrostatic image. Organic photoconductors having such a laminate structure are advantageous in terms of stability of electrostatic characteristics and durability, so that organic photoconductors are currently the main type of image bearing members in use today.

With improvements in the development material and the image forming apparatus itself in addition to the image bearing member, the quality of images produced by an image forming apparatus using an organic photoconductor has been markedly improved, which leads to expansion of application scope of the image forming apparatus. In recent years, as a result of full colorization and high-speed performance, application of such an image forming apparatus to other fields, the printing field in particular, has been strongly demanded. In the printing field, since printing is repetitively performed at a high speed for an extended period of time, the image bearing member is required to have improved abrasion resistance and durability to meet the demand for long life as well as high speed.

There are a great many technologies with regard to a protection layer that is provided to improve abrasion resistance and durability of the image bearing member.

For example, unexamined published Japanese patent application publication no. (hereinafter referred to as JP-) S56-48637-A describes a technology of using a curable resin for a charge transport layer, JP-2004-302452-A, a technology of using a cured cross-linked layer as a surface layer, and JP-2005-99688-A, a technology of using filler particulates in a cured surface layer. However, although the abrasion resistance and durability of an image bearing member has been improved, the cleaning blade tends to turn inward or outward, chip off, or be abraded soon, which inevitably causes bad cleaning performance or filming, etc. resulting in deterioration of the image quality.

In addition, toner remaining on an image bearing member resulting from poor cleaning performance easily attaches to a charging roller, thereby accelerating the image quality deterioration. Therefore, in addition to improvement of the abrasion resistance and durability, it is necessary to stabilize the cleaning ability by preventing the cleaning blade from turning inward or outward, chipping, abrading, etc.

A known technology to improve the cleaning ability is to roughen the surface of an image bearing member.

For example, JP-S60-9259-A describes a technology in which a surface roughening agent is dispersed in a photosensitive layer, JP-S53-92133-A describes a technology of controlling a drying speed of a protection layer, JP-H02-139566-A describes a technology of using a film-like polishing agent for mechanical roughening, and JP-H02-150850-A describes a technology of mechanically roughening the surface of an image bearing member by using spherical shot or abrasive particles having a spherical form and sandblasting the surface of an image bearing member. However, although successful in improving the cleaning ability by surface roughening, it tends to increase abrasion of the image bearing member and/or cause damage during repetitive use, which causes sudden, drastic deterioration in the cleaning ability.

Another technology described as the technology that improves the cleaning ability is one in which a lubricant material is applied to the surface of an image bearing member.

For example, JP-2002-287567-A describes a technology in which a lubricant is applied to an image bearing member to give it a friction index of from 0.1 to 0.4, and JP-2007-79244-A describes a technology in which a lubricant is applied to an image bearing member having a cross-Linked layer having a surface roughness Rz of from 0.4 to 1.0 (μm). These technologies contribute to keeping the friction index of the surface of an image bearing member low and thus are good to improve the cleaning ability, and stably sustain its effect. Furthermore, as described in JP-2005-249901-A, the lubricant material applied to the surface of an image bearing member also functions as a protection material for the image bearing member so that the lubricant material improves the abrasion resistance and durability of the image bearing member as well as to reduce the friction index thereof.

However, although a lubricant applied to the surface of an image bearing member contributes to stabilization of the behavior of a cleaning blade, the edge portion of the blade is constantly in contact with the image bearing member, which may accelerate abrasion of the blade edge. In addition, the amount of lubricant material that remains on the surface of an image bearing member decreases when images having a large image area are repetitively printed, which may cause bad cleaning performance and/or filming. Therefore, although these technologies improve both the abrasion resistance and durability of an image bearing member without degrading the cleaning ability, such effects are not sufficiently sustained. Depending on the field of application, for example, in particular the printing field, images having a large image area may be repetitively printed in full color over an extended period of time. To handle such a demanding operation, it is preferable that the image bearing member be free from abrasion or damage and the initial surface status thereof stably sustained. Also, the amount of lubricant material applied and the behavior of a cleaning blade need to be stabilized.

Furthermore, as another technology to provide a lubricant to the surface of an image bearing member, a lubricant is mixed or kneaded with and dispersed in or externally added to a toner. JP-H11-327303-A and JP-2008-139804-A describe a technology of providing such a toner to the image bearing member to apply the lubricant to the surface thereof.

This approach is good for cost reduction of an image forming apparatus. On the other hand, the application of the lubricant tends to be inferior, thereby causing the attachment amount of the lubricant to be insufficient or uneven.

As a result, the image stability deteriorates and the lubricant applied to the surface of an image bearing member is not sufficiently effective.

Thus, due to improvements in abrasion resistance and durability, the image bearing member now has a longer working life. However, this improvement is not good in light of the cleaning blade because the cleaning blade is turned inward or outward, chipped, or abraded quickly, which causes deterioration of cleaning performance, filming, contamination of the charging roller, etc., resulting in deterioration of the image quality. That is, if improvement of the length of the working life of an image bearing member causes bad cleaning performance, filming, etc., which results in deterioration of the image quality, such improvement does not contribute to the elongation of the working life in a true sense.

One of the reasons why deterioration of the cleaning ability or occurrence of filming is caused by improving the abrasion resistance or durability of an image bearing member is that the lubrication property of the surface thereof deteriorates because the lubricant is hardly refreshed (replenished).

When the lubricant property of the surface worsens, friction between the cleaning blade and the surface increases, thereby pulling in the blade and turning it outward. If this state continues, the blade is easily chipped or cracked, which leads to bad cleaning performance or filming. Therefore, since the way a lubricant is applied to the surface of an image bearing member determines how well the surface is lubricated, it should also be effective to improve the cleaning ability and prevent filming. However, although the cleaning ability is improved by application of a lubricant and the operation of the blade is stabilized, the edge of the cleaning blade is constantly in close contact with the surface of an image bearing member. Therefore, abrasion easily starts from the edge portion of the blade, resulting in deterioration of sustainability of improvement in the cleaning ability and prevention of filming.

SUMMARY OF THE INVENTION

For these reasons, the present inventors recognize that a need exists for an image forming apparatus including an image bearing member that stably produces quality images for a long period of time by extreme improvement and stabilization on abrasion duration, damage duration and the cleaning ability of the image bearing member to consequently prevent bad cleaning performance or filming while avoiding occurrence of contamination of the charging roller or turning inward or outward, chip off or abrasion of the cleaning blade even when printing is repeatedly performed for an extended period of time or when an image area increases.

Accordingly, an object of the present invention is to provide an image forming apparatus including an image bearing member that produces quality images stably for a long period of time by extreme improvement and stabilization on abrasion duration, damage duration and the cleaning ability of the image bearing member to consequently prevent bad cleaning performance or filming while avoiding occurrence of contamination of the charging roller or turning inward or outward, chip off or abrasion of the cleaning blade even when printing is repeatedly performed for an extended period of time or when an image area increases.

Briefly this object and other objects of the present invention as hereinafter described will become more readily apparent and can be attained, either individually or in combination thereof, by an image forming apparatus including an image bearing member having an electroconductive substrate on which are provided at least a photosensitive layer and a protection layer, in that sequence, a charging device that charges the surface of the image bearing member to form a latent electrostatic image thereon, a development device that develops the latent electrostatic image with a development agent containing toner to obtain a developed toner image, a cleaning device that removes toner remaining on the surface of the image bearing member and a lubricant material applicator that applies a lubricant material to the surface of the image bearing member, wherein the protection layer contains a cured resin and a filler and the surface form of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

It is preferable that, in the image forming apparatus mentioned above, the cured resin is a resin formed by curing a polymerizable compound having no charge transport structure and a polymerizable compound having a charge transport structure, the polymerizable compound having no charge transport structure comprises a polymerizable compound having at least three functional groups, and the number of functional groups of the polymerizable compound having a charge transport structure is one.

It is still further preferable that, in the image forming apparatus mentioned above, the functional groups of the polymerizable compound having no charge transport structure and the functional group of the polymerizable compound having a charge transport structure are either or both of an acryloyloxy group and a methacryloyloxy group.

It is still further preferable that, in the image forming apparatus mentioned above, the charge transport structure of the polymerizable compound having a charge transport structure is a triaryl amine structure.

It is still further preferable that, in the image forming apparatus mentioned above, the polymerizable compound having a charge transport structure is at least one kind of compounds represented by the chemical structure 12 and 13:

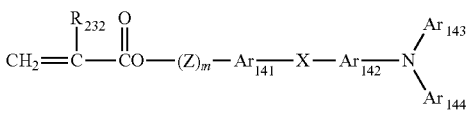

-continued (13)

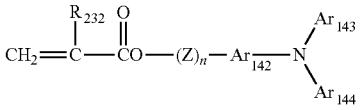

where $R_{232}$ represents hydrogen atom, a halogen atom, a substituted or non-substituted alkyl group, a substituted or non-substituted aralkyl group, a substituted or non-substituted aryl group, cyano group, nitro group, an alkoxy group, —$COOR_{241}$, wherein $R_{241}$ represents hydrogen atom, a substituted or non-substituted alkyl group, a substituted or non-substituted aralkyl group or a substituted or non-substituted aryl group, a halogenated carbonyl group or $CONR_{242}R_{243}$, wherein $R_{242}$ and $R_{243}$ independently represent hydrogen atom, a halogen atom, a substituted or non-substituted alkyl group, a substituted or non-substituted aralkyl group or a substituted or non-substituted aryl group, $Ar_{141}$ and $Ar_{142}$ independently represent a substituted or non-substituted arylene group, $Ar_{143}$ and $Ar_{144}$ independently represent a substituted or non-substituted aryl group, X represents a single bond, a substituted or non-substituted alkylene group, a substituted or non-substituted cycloalkylene group, a substituted or non-substituted alkylene ether group, oxygen atom, sulfur atom, or vinylene group, Z represents a substituted or non-substituted alkylene group, a substituted or non-substituted divalent alkylene ether group or a divalent alkyleneoxy carbonyl group, and m and n represent an integer of from 0 to 3.

It is still further preferable that, in the image forming apparatus mentioned above, the filler has an average primary particle diameter of from 0.1 to 1.0 μm.

It is still further preferable that, in the image forming apparatus mentioned above, the filler is a alumina.

It is still further preferable that, in the image forming apparatus mentioned above, the protection layer contains a polycarboxylic compound.

It is still further preferable that, in the image forming apparatus mentioned above, the charging device employs a roller system having a charging roller which is provided in the vicinity of the image bearing member.

It is still further preferable that, in the image forming apparatus mentioned above, a voltage in which an alternating current component is overlapped with a direct current component is applied to the charging roller to charge the image bearing member.

It is still further preferable that, in the image forming apparatus mentioned above, the charging device employs a scorotron system in which the charging device is not in contact with the image bearing member.

It is still further preferable that, in the image forming apparatus mentioned above, the cleaning device has a blade form and is arranged in contact with the image bearing member against a rotation direction of the image bearing member.

It is still further preferable that, in the image forming apparatus mentioned above, the lubricant material applicator is integrated into with at least one of the charging device, the development device, and the cleaning device.

It is still further preferable that, in the image forming apparatus mentioned above, the lubricant material applicator is integrated into with the development device and the lubricant material is applied to the surface of the image bearing member together with the toner when the development device develops the latent electrostatic image.

It is still further preferable that, in the image forming apparatus mentioned above, the lubricant material comprises zinc stearate.

It is still further preferable that, in the image forming apparatus mentioned above, a blade is provided between the cleaning blade and the charging device and arranged in contact with the image bearing member in a trailing direction relative to a rotation direction of the image bearing member.

It is still further preferable that, in the image forming apparatus mentioned above, multiple image formation elements are provided in a tandem arrangement, each of which includes the image bearing member and at least one of the charging device, the development device, the cleaning device, and the lubricant material applicator.

It is still further preferable that, in the image forming apparatus mentioned above, one of the image formation elements includes a combination of the development device using black toner and the charging device employing a scorotron system and the rest of the multiple image formation elements include a combination of the development device using a toner color toner other than black and the charging device employing a charging roller.

As another aspect of the present invention, a process cartridge is provided which includes an image bearing member comprising an electroconductive substrate on which are provided at least a photosensitive layer and a protection layer, in that sequence, and at least one of the devices selected from the group consisting of a charging device that charges the surface of the image bearing member to form a latent electrostatic image thereon, a development device that develops the latent electrostatic image with a development agent containing toner to obtain a developed toner image, a cleaning device that removes toner remaining on the surface of the image bearing member and a lubricant material applicator that applies a lubricant material to the surface of the image bearing member, wherein the protection layer contains a cured resin and a filler and the surface form of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm, and wherein the process cartridge is detachably attachable to the image forming apparatus mentioned above.

As another aspect of the present invention, an image bearing member is provided which includes an electroconductive substrate, and layers formed of at least a photosensitive layer and a protection layer laminated on the electroconductive substrate, in that sequence, wherein the protection layer contains a cured resin and a filler and the surface form of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

These and other objects, features and advantages of the present invention will become apparent upon consideration of the following description of the preferred embodiments of the present invention (taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

In the present invention, a curable (cured) resin is used as the binder resin for the protection layer of an image bearing member, and a filler is also contained therein, thereby forming microscopic roughness on the surface. Furthermore, macroscopic roughness is also formed by changing the prescription of the protection layer and the application conditions thereof.

To be specific, in the present invention, the surface of the protection layer has an arithmetical mean waviness Wa of from 0.05 to 0.3 μm and an average length WSm of profile elements of from 0.5 to 1.5 mm, which are obtained from a waviness profile obtained by filtering (cutting off) a coarse component with a λc profile filter of 0.25 mm and filtering (cutting off) a wavelength component longer than a waviness with a λf profile filter of 2.5 mm. This range of WSm of from 0.5 to 1.5 mm is extremely wide because WSm is typically reduced to increase the surface roughness. However, in the present invention, to sustain the improvement in the cleaning ability, increasing not only the surface roughness but also waviness is found to be suitable.

That is, the macroscopic roughness of the surface texture suitable to improve the cleaning ability and sustain the improvement is represented by the arithmetical mean waviness Wa of from 0.05 to 0.3 μm obtained from the waviness profile and the average length WSm of the profile elements of from 0.5 to 1.5 mm.

When the thus obtained image bearing member is installed in an image forming apparatus having a lubricant material applicator, the duration against abrasion and damage of the image bearing member is significantly improved and the cleaning ability ameliorates without causing filming. Also this improvement is stably sustained for a long time. Furthermore, contamination of the charging roller is reduced, and the working life length of the cleaning blade is elongated. Therefore, an image forming apparatus that stably produces quality images for an extended period of time is provided.

Next, the image forming apparatus is described in detail with reference to the accompanying drawings.

Image Forming Apparatus

Figure 1:
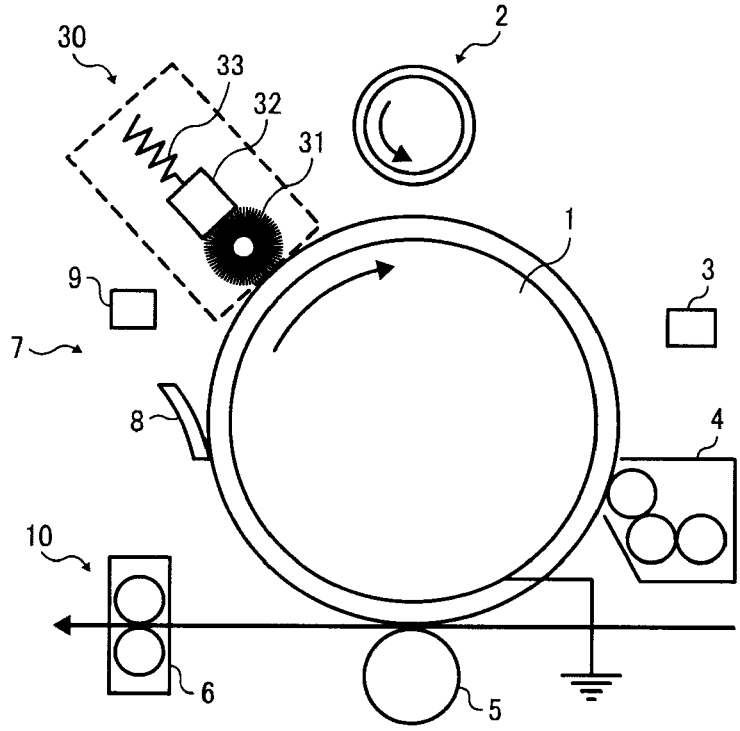
FIG. 1 is a schematic diagram illustrating an example of the image forming apparatus of the present invention.

FIG. 1 is a schematic diagram illustrating an example of the image forming apparatus of the present invention. This is only a representative example and the present invention is not limited thereto. The variations that are described later are also within the scope of the present invention.

An image bearing member 1 illustrated in FIG. 1 has a drum form but is not limited thereto. An image bearing member may employ a sheet form or an endless belt form. A charging device 2 employs a roller charging system but is not limited thereto (e.g., corona charging system). A latent image formation unit 3 is specifically an irradiation device to form a latent electrostatic image on the surface of the image bearing member 1.

Any known development device, transfer device, and fixing device can be used as a development device 4, a transfer device 5 and a fixing device 6.

A reference numeral 8 represents a cleaning device 8 and a cleaning blade in FIG. 1 but is not limited thereto.

Reference numerals 9 and 30 are a discharging device and a lubricant material applicator, respectively.

As an example of the lubricant material applicator, a system is illustrated in FIG. 1 in which a solid lubricant material 32 is pressed by a pressure spring 33 and applied to the surface of the image bearing member via a fur brush.

The image forming apparatus of the present invention includes an image bearing member, a charging device, a development device, and a cleaning device with other optional devices such as a lubricant material applicator, an irradiation device as a latent image formation unit, a transfer device, a fixing device, and a discharging device. Other devices can be also added to the image forming apparatus.

Charging Device

Any known charging devices can be used as the charging device of the present invention.

Specific examples thereof include, but are not limited to, a corona charging system such as a corotron, or a scoroton in which a high voltage is applied to a wire, a solid discharging system in which a high frequency voltage is applied to electrodes pinching an insulation board instead of wire, a contact type roller charging system in which a high voltage is applied to a member having a roller to charge an image bearing member while the member is in contact with the image bearing member, a vicinity disposition type roller charging system in which a member having a roller form charges an image bearing member with a gap between the roller and an image formation area of 100 μm or less, or a contact charging system using a brush, a film, a blade, etc., to charge an image bearing member while they are in contact with the image bearing member Among these charging devices (systems), the contact type roller charging system is advantageous for the present invention in terms that contamination of the charging roller is extremely reduced in addition to extreme improvement in the cleaning ability.

Different from the corona charging system, the charger in the roller charging system is used in contact with an image bearing member. Therefore, toner remaining on the image bearing member resulting from bad cleaning performance has an increasing adverse impact with regard to contamination on the charger.

A contaminated charger deteriorates in terms of charging ability, charing uniformity, contamination on the surface of an image bearing member. Alternatively, the surface of an image bearing member may be damaged by the remaining toner, which causes a big problem such that the deterioration of the image quality is accelerated.

In the present invention, a charger employing a roller charging system is preferably made of an elastic material that hardly provides mechanical stress on an image bearing member.

The vicinity disposition type roller charging system is a charging system in which a gap is provided for a charging roller or a non-image area of an image bearing member to arrange the charging system in the vicinity of the image bearing member.

Figure 2:
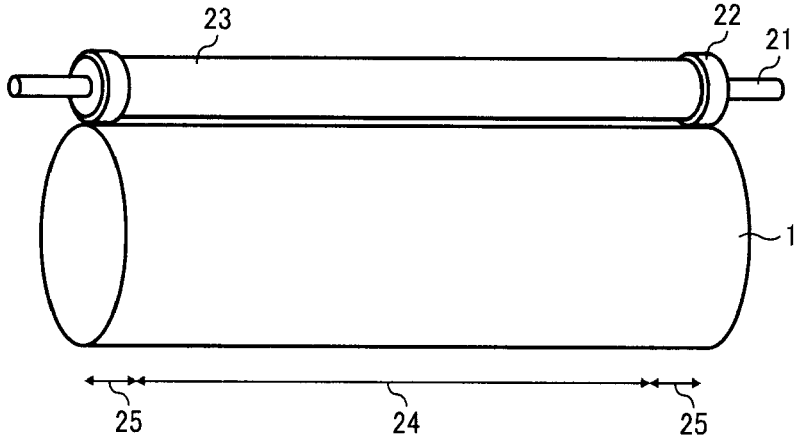
FIG. 2 is a schematic diagram illustrating an example of the roller charging system of vicinity arrangement type in the present invention.

For example, as illustrated in FIG. 2, a spacer (gap formation member 22) having a uniform thickness is provided to the non-image area of the charging roller 23, which results in formation of a gap between the charging roller 23 and the image bearing member 1. Reference numerals 21, 24, and 25 represent a metal shaft, an image formation area, and a non-image formation area, respectively.

The gap between the image bearing member 1 and the charging roller 23 is preferably small, which is 100 μm or less, and more preferably from 30 μm to 70 μm.

Therefore, contamination on the charging roller by development material or paper dust during repetitive use is reduced in comparison with the contact type charging system. Thus, charging lowering, production of abnormal images and abrasion can be limited. However, although the gap is formed in the image formation area, the charger 23 is still arranged in the vicinity of the image bearing member 1 so that an adverse impact of the contamination on the charging roller 1 is not completely eliminated. Therefore, the present invention is suitably used in both of the contact type and the vicinity type. In the vicinity type roller charging system, the surface of the charging roller is preferably hard to maintain the accuracy of the minute gap. For example, such a charging roller having a hard surface can be made by forming a resistance adjustment layer of a thermoplastic resin composition in which a polymer type ion electroconductive agent is dispersed followed by a curing filming treatment for the surface of the resistance adjustment layer by a curing agent.

In addition, a power source for charging is connected to a roller in the roller charging system, thereby causing vicinity discharging in the space between the surface of an image bearing member and the surface of a charging roller to charge the image bearing member. An overlapped alternate voltage formed by overlapping an AC voltage to a DC voltage can be used as the voltage applied to the image bearing member. Therefore, variation in the charging voltage due to the fluctuation of the minute gap can be reduced, which leads to improvement of the uniformity of charging and reduction of unevenness in image density or residual images. As a result, quality images can be produced. However, an overlapped alternate voltage accelerates deterioration of the surface of an image bearing member, which may significantly degrade the abrasion duration or damage duration of the image bearing member.

In the present invention, since a lubricant material is applied to the surface of an image bearing member and the provision amount thereof is stable in any situation. Thus, the surface of an image bearing member is constantly protected so that the image bearing member maintains a high abrasion resistance and damage durability.

As a result of stable maintenance of the surface status, the lubricant material is continuously provided in a stable manner. This leads to drastic improvement in sustainability of the effect of the cleaning ability.

In the present invention, the corona charging system can be suitably used.

In the corona charging system, a high voltage is applied to a wire having a diameter of from 40 to 100 μm, thereby ionizing the air around and the ionized air is transferred toward the image bearing member to charge the image bearing member. The wire can be formed of tungsten, molybdenum, stainless copper, titanium, or other alloyed metals. Corona charging system is typified into corotron and scorotron. A scorotron has a structure in which screen electrodes (grid) are arranged on a corotron. The screen electrodes are arranged with a gap between them of from 1 to 3 mm and stretched at a position 1 to 2 mm away from an image bearing member. The charging voltage is restricted by a voltage applied to the grid electrodes so that the surface voltage saturates. Therefore, the charging voltage can be controlled by the grid potential to conduct uniform charging. In the present invention, a scorotron that can perform even charging with less uneven charging. For a high speed performance, a double wire type in which two wires are suspended is particularly preferable. In addition, among the two wire type, a structure in which the two wires are separated is also suitable.

In addition, in the present invention, both corona charging system and roller charging system can be employed for a tandem type image forming apparatus having multiple image formation elements, which is effective. Particularly, a tandem type image forming apparatus that employs a scrotron system for an image formation element having a development device for black toner and a roller charging system for the other colors is highly capable of dealing with a high speed printing of an image mainly formed by frequently used characters.

In addition, in comparison with an image forming apparatus that uses a scrotron for all the image formation elements, the production of ozone can be reduced and the image quality is relatively stabilized even when the image bearing member is repetitively used for an extended period of time.

Furthermore, layout flexibility in the image forming apparatus is high, which is particularly suitable for a tandem type image forming apparatus in consideration that the image forming apparatus tends to be large in size.

The image bearing member for use in the present invention maintains good performance in any combination of the charging systems without affecting the image quality because a lubricant material is uniformly applied in a suitable amount. Therefore, as in the case described above in which different charging devices are used in one image forming apparatus, such a different charging system stably produces quality images without an adverse impact on the image quality even during repetitive use for an extended period of time.

The friction index of the surface of an image bearing member increases when it is exposed to ozone, etc. The amount of ozone produced in the corona charging system is large. Therefore, the ozone production amount is not ignorable.

However, in the present invention, a lubricant material is applied to the surface of an image bearing member and stably provided for a long time. Therefore, the rise in the friction index of the surface of an image bearing member is reduced and consequently, the behavior of the cleaning blade is stabilized, which is advantageous in terms of the cleaning ability.

In addition, any of these charging devices can be provided more than one, which is particularly effective in high speed performance.

Irradiation Device

The latent image formation unit 3 is specifically an irradiation device to form a latent electrostatic image on the surface of the image bearing member 1. Any device that irradiates an image bearing member with light absorbed by the charge generation material in the image bearing member can be used as the irradiation device.

The charged image bearing member is irradiated with light, which is absorbed by the charge generation material to generate a pair of charges. One charge of the pair moves to the surface to cancel the surface charge and thus a latent electrostatic image is formed thereon. Typical illuminating sources, for example, a fluorescent lamp, a tungsten lamp, a halogen lamp, a mercury lamp, a sodium lamp, a light emitting diode (LED), a semiconductor laser (LD), electroluminescence (EL), etc. can be used as the light source of the irradiation device as long as the light source satisfies the condition mentioned above. Among these, the light emitting diode or the semi-conductor laser is advantageous and most suitable in terms of high speed performance and size reduction of an image forming apparatus. Various kinds of optical filters, for example, a sharp cut filter, a band-pass filter, a near infrared filter, a dichroic filter, a coherent filter and a color conversion filter, can be used in combination with these light sources to irradiate an image bearing member with light having only a particular wavelength.

In addition, a multi-beam irradiation device is preferable in the present invention.

Also, the speed of the performance of an image forming apparatus is improved by increasing the number of rotation of a polygon mirror and the number of image scanning frequency in the sub-scanning direction. However, there is a limit to an increase in the number of rotation of a polygon mirror. Thus, a multi-beam scanning irradiation method using a multi-beam recording head is employed in which multiple light beam sources are arranged in the sub-scanning direction to scan an image bearing member with multiple beams in the primary scanning direction in one scanning. According to the method using the multi-beam recording head, the number of rotation of a polygon mirror required in the case of one-beam light source is reduced to 1/n thereof for a light source using "n" light beams. That is, the rotation speed can be "n" times as fast as that in a single light beam light source. In addition, the scanning speed has thus an allowance and the scanning density can be increased so that an image with a high definition can be output at a high speed.

Development Device

The development process is a process in which a latent electrostatic image formed by the irradiation device is developed with toner to form a toner image on the image bearing member.

A negative image (reverse development) is obtained when the latent electrostatic image is developed with toner having the same polarity with that of the image bearing member, and, a positive image, when developed with toner having an opposite polarity to that of the image bearing member. Development system is typified into a single component development system using only toner, and a two component development system using a mixture of toner and carriers. Both systems are suitable in the present invention. In addition, when a full color image is developed by overlapping multiple color toner images atop on an image bearing member, the previously developed toner image may be disturbed when a toner image is overlapped thereon if a development method is used in which a toner image is developed in contact with the image bearing member. Thus, a system, for example, a jumping development system, in which an image is developed without a contact between the image bearing member and the development device is preferably used.

Transfer Device

The transfer process is a process of transferring the toner image formed on the image bearing member to a transfer material (e.g., transfer medium such as paper). A charging device can be used as the transfer device. For example, a transfer charger or a combination thereof with a separation charger can be suitably used. The transfer system can be classified into a direct transfer system in which a toner image is directly transferred from the image bearing member to a transfer medium by the transfer device described above, and an intermediate transfer system in which a toner image on the image bearing member is temporarily transferred to an intermediate transfer body and then transferred to a transfer medium such as paper. Both transfer systems can be suitably used.

In addition, a fixed voltage system or a fixed current system can be employed when an image is transferred. The fixed current system is more preferable because it is stable and the amount of transfer charge is maintained at the same level. The higher the transfer current, the better the transferability. As the linear speed of the image bearing member increases, the transferability tends to deteriorate. Thus, an increase in the transfer current is preferable. In addition, when the transfer current is high, the amount of charge flown in the image bearing member is reduced at discharging. Therefore, this is preferable in order to reduce the impact of the electrostatic fatigue. However, when the transfer current is too high and the surface of the image bearing member is positively charged, the voltage is not erased in the discharging process. Thus, when the next process (i.e., the charging process) starts, the charging is may not be sufficient.

Fixing Device

The fixing process is a process of fixing a toner image transferred to a transfer medium such as paper thereon by heat and pressure. Any method can be employed as the fixing method as long as it fixes toner on the transfer medium. To be specific, heat and/or pressure are applied. A combination of a heating roller and a pressure roller, or a combination thereof with an endless belt is also suitable.

Cleaning Device

The cleaning process is a process of cleaning the surface of an image bearing member of toner remaining thereon after development and transfer. Any method can be employed as long as it removes the remaining toner from the surface of the image bearing member. Specific examples of the cleaning devices include, but are not limited to, a fur brush, a blade, a magnetic brush, an electrostatic brush, a magnetic roller or a combination thereof.

The surface of the image bearing member is contaminated with various kinds of foreign objects such as development material, paper dust, and products by discharging in addition to the toner remaining on the image bearing member, which have an adverse impact on the image quality. Therefore, such foreign objects are also removed in the cleaning process. From this point of view, the cleaning blade is excellent. However, the foreign object is accumulated on the surface of an image bearing member during repetitive use and thus the behavior of the cleaning blade is unstable. This causes bad cleaning performance, resulting in production of abnormal images.

In the present invention, a lubricant material is applied to the surface of an image bearing member and thus the concavo-convex form of the surface of an image bearing member is stably maintained for a long time. Therefore, the behavior of the cleaning blade is stabilized and resultantly foreign objects are hardly attached or easily removed.

In addition, abrasion between the cleaning blade and the image bearing member is reduced, which prevents bad cleaning performance and filming. That is, the present invention stably demonstrates such performance for a long period of time by controlling the concavo-convex form of the surface of an image bearing member. This performance is fully utilized by using a cleaning blade as the cleaning device.

In the present invention, it is more preferable that the cleaning blade is provided in contact with an image bearing member against the rotation direction of the image bearing member. Thus, the blade prevents toner from slipping therethrough.

Discharging Device

The discharging process is a process of discharging the image bearing member to remove a latent electrostatic residual contrast image after removal of the residual toner in the cleaning process because the latent electrostatic residual contrast image may be visualized or result in a ghost image in the next image formation. Any device can be used as long as the charge generation material absorbs the light emitted from the device. For example, a fluorescent lamp, a tungsten lamp, a halogen lamp, a mercury lamp, a sodium lamp, a light emitting diode (LED), a semiconductor laser (LD), a xenon lamp and electroluminescence (EL) can be used as the discharging device and a combination of these and the optical filter mentioned above in the irradiation device is also suitable. In addition to the optical light irradiation system, a method of discharging by application of a reversed bias can be employed, which is preferable in terms of limiting the metal fatigue. However, as described above, irradiation of discharging light to an image bearing member encourages electrostatic fatigue and a discharging device is removed to meet the demand for size reduction. But when a latent electrostatic image contrast remains or the image bearing member is partially positively charged due to transfer before the next image formation process starts, a residual image or a ghost image is encouraged to occur. Therefore, it is preferable to provide a discharging device.

Lubricant Material Applicator

In the present invention, a mechanism of applying a lubricant to the surface of an image bearing member is provided as described above. The behavior of the cleaning blade is stabilized by applying a lubricant material to the surface of an image bearing member and thus turning inward and/or outward and chip-off of a cleaning blade is prevented. Therefore, its anticipated adverse impact such as bad cleaning performance and filming can be prevented.

In addition, the lubricant material applied to the surface of an image bearing member also prevents deterioration of the surface of an image bearing member due to charging. As a result, abrasion resistance and durability of the image bearing member is extremely improved and the concavo-convex form of the surface is stably maintained. Thus, the image bearing member sustains good performance for a long time.

The application method of a lubricant material includes a method of solidifying a lubricant material, scraping the solid lubricant material with a brush and applying it to an image bearing member, a method in which a lubricant material is directly brought into contact with an image bearing member, a method in which a powder mixture of a lubricant material with a development agent is prepared, and supplied and applied to the surface of an image bearing member in the development process, a method in which a lubricant is supplied to the surface of an image bearing member by a charging device or a cleaning device, etc. In the present invention, a lubricant material that is applied to the surface of an image bearing member can be used in any manner. Among the methods, the method of applying the lubricant by scraping it with a brush before application is most preferable. For example, the lubricant material application device illustrated in FIG. 1 includes a fur brush 31 as an application member, a lubricant material 32, and a pressure spring that presses the lubricant material 33 to the direction of the fur brush 31. The lubricant material 32 is a solid lubricant having a bar form and is pressed by the pressure spring 33 with a predetermined pressure. The lubricant 32 is scraped by rotation of the fur brush 31 and applied to the surface of the image bearing member 1. The pressure spring 33 is advantageous because it helps to constantly apply the same amount of the lubricant material 32 to the surface of the image bearing member 1 by the fur brush 31 even when the lubricant material 32 is reduced over time.

In addition, another method is suitable in which the lubricant material applicator is integrated into the development device to apply the lubricant material 32 to the surface of the image bearing member 1 together with toner in the development process.

As an example, the lubricant material applicator illustrated in FIG. 1 is removed and lubricant material powder is mixed with a development agent. In this mechanism, the lubricant is attached to the surface of an image bearing member at the same time toner is developed thereon the surface of an image bearing member. No separate space is needed for application of a lubricant material, which is advantageous in terms of the size reduction. This is particularly suitable for a tandem type image forming apparatus which requires an ample space.

Typically, this method causes uneven application of a lubricant material to the surface of an image bearing member, which leads to occurrence of uneven wear, or production of abnormal images. To the contrary, the lubricant material is evenly attached to the image bearing member having the surface texture of the present invention and the amount of the lubricant material attached hardly changes over repetitive use. Thus, the image quality is stabilized for a long time.

Alternatively, in a specific method of applying a lubricant material to the surface of an image bearing member by integrating a lubricant applicator into a cleaning device or a charging device, a brush is provide to the cleaning device or the charging device. The lubricant material is in contact with the brush and indirectly applied to the surface of an image bearing member via the brush.

However, the method of integrating a lubricant material applicator into a cleaning device or a charging device is disadvantageous when a lubricant material is attached in a great amount. The charging property and the cleaning ability are degraded by the great amount of the lubricant. Therefore, in the present invention, it is preferable that a lubricant material applicator is provided separately or integrated into the development device.

In addition, another method is preferably used in which a blade is brought into contact with the surface of an image bearing member to uniformly extend coated lubricant material thereon while in contact therewith.

In this method, the cleaning blade can bear this function of the application blade but it is preferable to provide an application blade dedicated for application of a lubricant material independently from the cleaning blade. The blade for applying a lubricant material is preferably in contact with the image bearing member along the rotation direction of the image bearing member. This improves the flatting property of the lubricant material on the surface of an image bearing member so that good cleaning performance is sustained by a small amount of the lubricant material. In addition, the blade for applying a lubricant material is arranged between the cleaning device and the charging device, that is, downstream relative to the cleaning process and upstream relative to the charging process.

Any lubricant material that uniformly attaches the surface of an image bearing member and resultantly imparts lubricant properties thereto can be used as the lubricant material for use in the present invention.

Specific examples thereof include, but are not limited to, metal salts of aliphatic acid such as lead oleate, zinc oleate, zinc oleate, zinc stearated, copper oleate, cobalt oleate, ferric stearate, copper stearate, calcium stearate, aluminum stearate, zinc palmitate, copper palmitate, and zinc linolenate, and fluorine-based resins such as polytetrafluoroethylene, polycholoro trifluolo ethylene, polyvinilydene fluoride, polytrifluorochloroethylene, dichlcrodifluoroethylene, copolymers of tetrafluoroethylene-ethylene.

In addition, waxes can also be used and ester-based waxes or olefin-based waxes are preferable.

The ester based waxes represent compounds having an ester bonding, e.g., natural waxes such as carnauba wax, candelilla wax, and rice wax, and montan wax. Specific examples of the olefin based waxes include, but are not limited to, synthesis waxes such as polyethylene wax, and polypropylene wax. Among these, metal salts of stearic acid, more specifically, zinc stearate, are preferably used in the present invention in terms of the amount of application, and protection of the surface of an image bearing member from charging.

Image Forming Apparatus Employing Tandem System

The image forming apparatus of the present invention has an image bearing member having a high abrasion resistance and durability, the cleaning ability of the image bearing member is improved, and filming is reduced. Therefore, this is particularly suitable for printing images having a large image area.

From this point of view, this is advantageous for an original not mainly having letters, but images, i.e., a full color image. Particularly, since the abrasion resistance and durability of an image bearing member is highly improved, the variation of the image bearing members is reduced. Therefore, the present invention is suitable for an image forming apparatus that produces full color images by a tandem arrangement in which multiple image bearing members are used. A tandem arrangement image forming apparatus includes the same number of image bearing members as the number of development units separately provided for corresponding color toners, thereby independently conducting development of each color toner in parallel followed by overlapping of each color toner image to obtain a full color image. To be specific, at least four color development units and image bearing members of yellow (Y), magenta (M), cyan (C), and black (K) required for full color printing are provided, thereby achieving extremely high speed full color printing in comparison with a single drum system in which processes are repeated four times to obtain a full color image.

Figure 3:
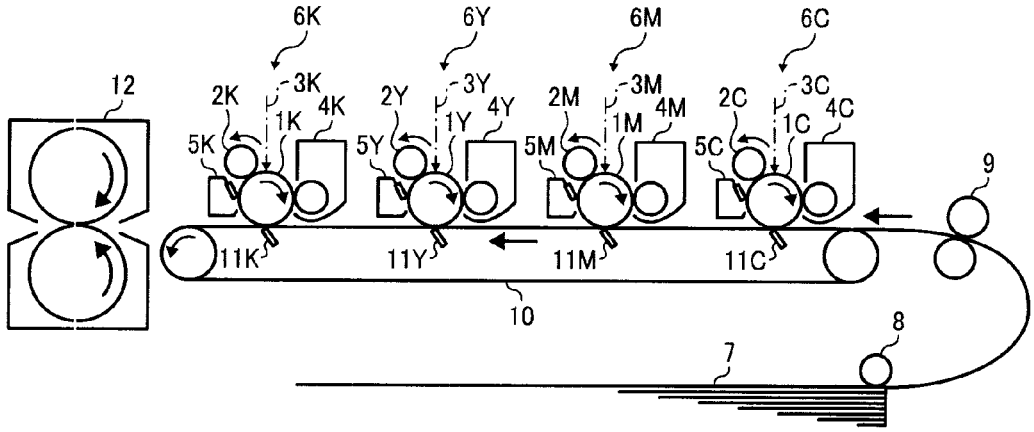
FIG. 3 is another schematic diagram illustrating an example of the image forming apparatus of the present invention.

FIG. 3 is a schematic diagram illustrating a full color image forming apparatus employing a tandem arrangement for use in the present invention. In FIG. 3, the reference numerals 1C, 1M, 1Y and 1K) represent image bearing member having a drum form. The image bearing members 1C, 1M, 1Y, and 1K rotate in the direction indicated by an arrow and there are provided therearound at least charging devices 2C, 2M, 2Y, and 2K, development device 4C, 4M, 4Y, and 4K, and cleaning devices 5C, 5M, 5Y, and 5K arranged according to the rotation direction of the image bearing members.

An irradiation device (not shown) emits laser beams 3C, 3M, 3Y, and 3K from the rear side of the image bearing members between the charging devices 2C, 2M, 2Y, and 2K and the development device 4C, 4M, 4Y, and 4K to form latent electrostatic images on the image bearing members 1C, 1M, 1Y, and 1K. Four development components 6C, 6M, 6Y, and 6K including the image bearing members 1C, 1M, 1Y, and 1K are arranged along a transfer belt 10 functioning as a transfer medium conveyor device. The transfer belt 10 is in contact with the image bearing members 1C, 1M, 1Y, and 1K between the development device 4C, 4M, 4Y, and 4K and the cleaning devices 5C, 5M, 5Y, and 5K of each development component 6C, 6M, 6Y, and 6K. Transfer brushes 11C, 11M, 11Y, and 11K that apply a transfer bias are provided on the side of the transfer belt 10 reverse to the side thereof on which the image bearing members 1C, 1M, 1Y, and 1K are in contact. Each image formation component 6C, 6M, 6Y, and 6K is of the same structure except that toners contained in the development devices 4C, 4M, 4Y, and 4K have different colors from each other.

The full color image forming apparatus having the structure illustrated in FIG. 3 forms images as follows. In the image formation component 6C, 6M, 6Y, and 6K, the image bearing members 1C, 1M, 1Y, and 1K are charged by the charging devices 2C, 2M, 2Y, and 2K that rotate in the direction indicated by an arrow (the same direction as the rotation direction of the image bearing members 1C, 1M, 1Y, and 1K) and irradiated with the laser beams 3C, 3M, 3Y, and 3K by the irradiation device (not shown) situated outside the image bearing members 1C, 1M, 1Y, and 1K to form latent electrostatic images corresponding to an image of each color. Then, the latent electrostatic images are developed by the development devices 4C, 4M, 4Y, and 4K to form toner images. The development devices 4C, 4M, 4Y, and 4K develop the latent electrostatic images with toner of C (cyan), M (magenta), Y (yellow), and K (black), respectively. Respective toner images formed on the four image bearing members 1C, 1M, 1Y, and 1K are overlapped on a transfer medium 7. The transfer medium 7 is sent out from a tray by a feeding roller 8, temporarily held at a pair of registration rollers 9 and fed to the transfer belt 10 in synchronization with image formation on the image bearing members 1C, 1M, 1Y, and 1K. The transfer medium 7 held on the transfer belt 10 is transferred to the contact point (transfer portion) with the image bearing members 1C, 1M, 1Y, and 1K where each color toner image is transferred.

The toner images on the image bearing members 1C, 1M, 1Y, and 1K are transferred to the transfer medium 7 by an electric field formed by a potential difference between the transfer bias applied to the transfer brushes 11C, 11M, 11Y, and 11K and the voltage of the image bearing members 1C, 1M, 1Y, and 1K. The transfer medium 7 on which four color toner images are overlapped through the four transfer portions are conveyed to a fixing device 12 where the toner is fixed followed by discharging of the transfer medium 7 to a discharging portion (not shown). In addition, toner which has not been transferred to the image bearing members 1C, 1M, 1Y, and 1K and remains thereon are collected by the cleaning devices 5C, 5M, 5Y, and 5K.

Figure 4:
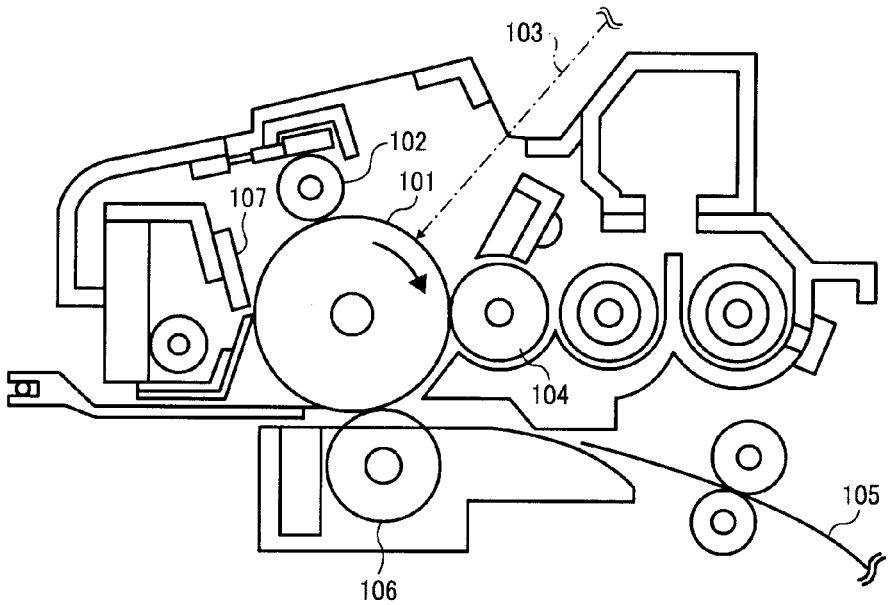
FIG. 4 is a schematic diagram illustrating an example of the process cartridge for use in the image forming apparatus of the present invention.

The image formation elements are arranged in the sequence of C (cyan), M (magenta), Y (yellow), and K (black) from the upstream to the downstream relative to the transfer direction of the transfer medium, but are not limited thereto. The sequence of the color is arbitrarily selected. In addition, when a document of only black color is output, a mechanism to suspend the image formation elements 6C, 6M, and 6Y) other than the black color is particularly suitable for the present invention. Furthermore, a charging device 102 illustrated in FIG. 4 is in contact with an image bearing member 101. Alternatively, the vicinity type roller charging system having a suitable gap (about 10 to about 200 μm) between both as illustrated in FIG. 2 is suitably applicable.

A charging device having a corona charging system can be used but if the corona charging system is provided more than one, the amount of ozone produced extremely increases, which requires a device such as air stream designing.

Process Cartridge

The image formation device as described above can be assembled into a photocopier, a facsimile machine, or a printer in a fixed manner and each image formation element can be incorporated into such an apparatus in a form of a process cartridge.

The process cartridge is a device (part) including an image bearing member and at least one device selected from other optional devices such as a charging device, a development device, a cleaning device and a lubricant material applicator and detachably attachable to an image forming apparatus. There is no specific limit to the form of a process cartridge but a typical form thereof is as illustrated in FIG. 4. Reference numerals 101, 102, 103, 104, 105, 106, and 107 in FIG. 4 represent a drum, a charging device, beams of light, a development device, a transfer medium, a transfer body, and a cleaning unit, respectively.

Image Formation Method

The image forming apparatus of the present invention includes at least a charging process using the charging device described above and a particular image bearing member, a development process using the development device described above, a cleaning process using the cleaning device described above, and a lubricant material application process using the lubricant material applicator described above with optional processes such as an irradiation process, a transfer process, a fixing process, a discharging process, etc. Any other processes can be optionally added.

Next, the image bearing member for use in the present invention is described with reference to the accompanying drawings.

Layer Structure of Image Bearing Member

Figure 5:
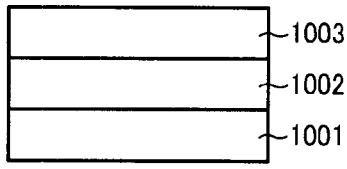
FIG. 5 is a schematic diagram illustrating an example of the layer structure of the image bearing member in for use in the present invention.
Figure 6:
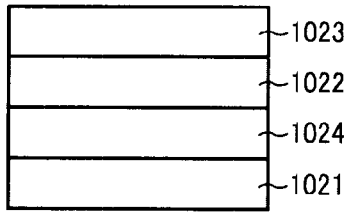
FIG. 6 is a schematic diagram illustrating another example of the layer structure of the image bearing member for use in the present invention.

The layer structure of the image bearing member for use in the present invention is formed of multiple layers including at least a photosensitive layer and a protection layer. Specific examples of the layer structures are described as follows. FIG. 5 is a diagram illustrating an image bearing member having an electroconductive substrate 1001 on which a photosensitive layer 1002 and a protective layer 1003 are laminated, in that sequence. In addition, as illustrated in FIG. 6, an undercoating layer 1024 can be provided between a photosensitive layer 1022 and an electroconductive substrate 1021. In addition, the undercoating layer may have a two layer structure. The reference numeral 1023 represents a protection layer.

Figure 7:
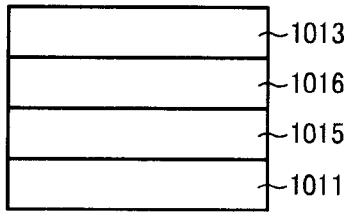
FIG. 7 is a schematic diagram illustrating another example of the layer structure of the image bearing member for use in the present invention.
Figure 8:
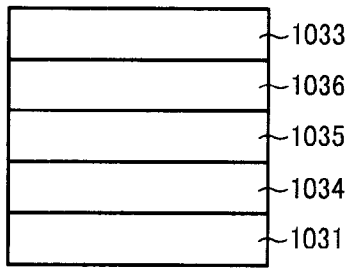
FIG. 8 is a schematic diagram illustrating another example of the layer structure of the image bearing member for use in the present invention.
Figure 9:
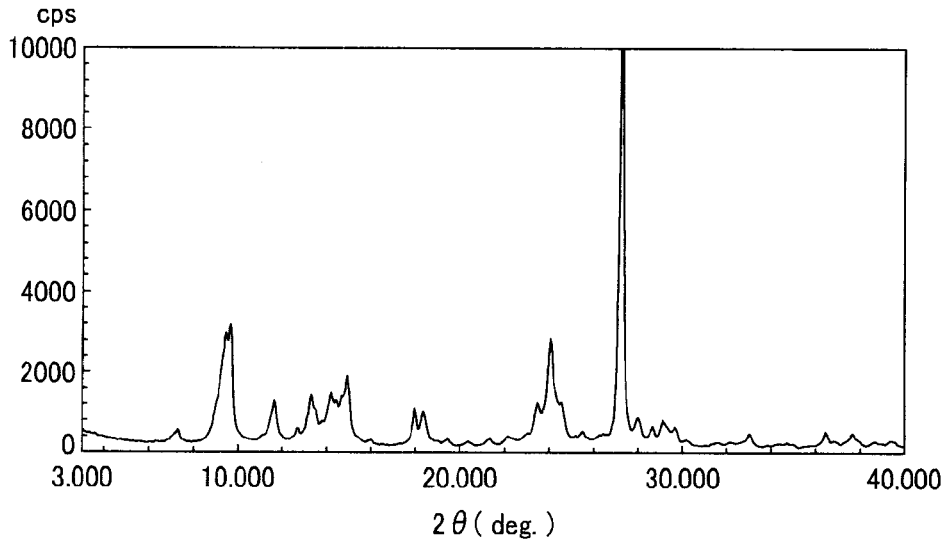
FIG. 9 is a graph illustrating an X-ray diffraction spectrum of the charge generation material for use in Examples described later with an Y axis of the counts per second (cps) and an X axis of an angle (2θ)

FIG. 7 is a diagram illustrating an image bearing member having a laminate structure in which a charge generation layer 1015, a charge transport layer 1016, and a protection layer 1013 are laminated on an electroconductive substrate 1011, in that sequence. In addition, as illustrated in FIG. 9, an undercoating layer 1034 can be provided between a charge generation layer 1035 and an electroconductive substrate 1031.

Reference numerals 1033 and 1036 represent a protection layer and a charge transport layer, respectively. In addition, the undercoating layer may have a two layer structure. In the present invention, a photosensitive layer having a laminate structure is preferable to a single layer structure. In addition, an undercoating layer is preferably formed and a two layer structure thereof is more preferable. These layer structures are for the illustration purpose only and the present invention is not limited thereto.

Electroconductive Substrate

The electroconductive substrate can be formed by using material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, an endless nickel belt and an endless stainless belt described in JP S52-36016-A can be used as the electroconductive substrate.

Furthermore, the electroconductive substrate can be formed by dispersing electroconductive powder in a binder resin on the above-mentioned electroconductive substrate to form an electroconductive layer (formed by coating, etc.). Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder. Specific examples of the binder resins which are used together with the electroconductive powder include, but are not limited to, thermoplastic resins, thermosetting resins, and optical curable resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenolic resin, and an alkyd resin. Such an electroconductive layer can be formed by dispersing such electroconductive powder and the binder resin in a solvent, for example, tetrahydrofuran (THF), dichloromethane (MDC), methyl ethyl ketone (MEK), and toluene and applying the resultant to an electroconductive substrate. In addition, an electroconductive substrate in which an electroconductive layer is formed on a cylindrical substrate by using a heat contraction tube can be used as the electroconductive substrate of the present invention. The heat contraction tube is formed of material containing electroconductive powder. Specific examples of the material include, but are not limited to, polyvinyl chloride, polypropylene, polyester, polystyrene, polyvinylidene chloride, polyethylene, chloride rubber, and polytetrafluoroethylene based fluorine resin.

Among these, a cylindrical substrate formed of aluminum which can be easily subject to anodization treatment. is suitably used. This aluminum represents solid aluminum and alloy thereof. To be specific, aluminum of JIS 1,000 to 1,999, 3,000 to 3,999, and 6,000 to 6,999 or alloy thereof are most suitable. Anodized layer (film) is obtained by anodization treatment of metal, or alloy thereof in an electrolyte solution. Among these, a film referred to as alumite obtained by anodization of aluminum or alloy thereof hardly causes a rise in a residual voltage, and is effective to prevent background fouling occurring when reverse development is used.

The anodization treatment is conducted in an acid bathing using such as chromic acid, sulfuric acid, oxalic acid, phosphoric acid, acidum boricum, and sulfamic acid. Among these, sulfuric acid bathing is most suitable. A specific example thereof is conducted in the following conditions:

Density of sulfuric acid: 10 to 20%
Temperature of bathing: 5 to 25
Current density: 1 to 4 A/dm$^2$
Electrolyzation voltage: 5 to 30 V
Treatment time: about 5 to about 60 minutes The thus prepared anodization film is porous and has high insulation property so that the surface is extremely in unstable condition. Therefore, the anodization film changes over time and the physical values thereof are liable to change. To avoid this, the anodization film is preferably subject to sealing treatment. The sealing treatment includes a method of dipping the anodization film in an aqueous solution containing nickel fluoride and nickel acetate, a method of dipping the anodization film in boiled water, a method of using steam under pressure, etc. Among these, the method of dipping the anodization film in an aqueous solution containing nickel acetate is most preferable. Subsequent to the sealing treatment, the anodization film is subject to washing treatment. This is to remove metal salts extra attached by the sealing treatment. Metal salts that excessively remains on the surface of the electroconductive substrate (anodization film) have an adverse impact on the quality of film (layer) formed on the anodization film and in addition, cause the background fouling since a low resistance component generally remains. This washing treatment may be conducted only once but generally conducted in multiple steps. The washing liquid obtained after the final washing treatment is preferably as clean (deionized) as possible. In addition, the washing processes in the multi-steps preferably include a process of physical rubbing washing with a contact member. The thickness of the thus formed anodization film is preferably from about 5 to about 15 μm. A film that is excessively thin tends to have insufficient barrier effect as the anodization film and by contrast, a film that is excessively thick tends to have an excessively high time constant as the electrode, which may cause occurrence of residual voltage and deterioration of the response of the image bearing member.

Photosensitive Layer

Next, the photosensitive layer is described.

The photosensitive layer can be of a single layer structure or a laminate structure. The laminate structure is described first.

The laminate photosensitive layer has a structure formed of at least a charge generation layer and a charge transport layer.

Charge Generation Layer

The charge generation layer is a layer mainly formed of a charge generation material. Any known charge generation material can be used for the charge generation layer.

Specific examples thereof include, but are not limited to, azo pigments such as monoazo pigments, disazo pigments, asymmetry disazo pigments, trisazo pigments, azo pigments having a carbazole skeleton (refer to JP S53-95033-A), azo pigments having a distyryl benzene skeleton (refer to JP S53-133445-A), azo pigments having a triphenylamine skeleton (refer to JP S53-132347-A), azo pigments having a diphenylamine skeleton, azo pigments having a dibenzothiophene skeleton (refer to JP S54-21728-A), azo pigments having a fluorenone skeleton (refer to JP S54-22834-A), azo pigments having an oxadiazole skeleton (refer to JP S54-12742-A), azo pigments having a bis-stilbene skeleton (refer to JP S54-17733-A), azo pigments having a distilyloxadiazole skeleton (refer to JP S54-2129-A), azo pigments having a distylylcarbazole skeleton (refer to JP S54-14967-A); azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments, and phthalocyanine based pigments such as metal phthalocyanine represented by the following chemical structure (11), and metal free phthalocyanine.

Chemical structure 11

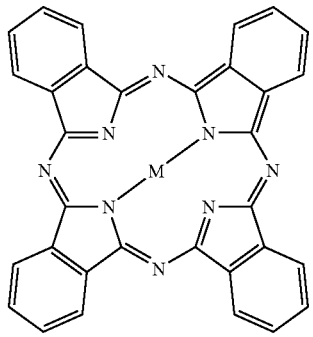

M (center metal) of the chemical structure 1 represents a metal element or non-metal (hydrogen atom).

Specific example of M (center metal) include, but are not limited to, H, Li, Be, Na, Mg, Al, Si, K, Ca, Sc. Ti, V. Cr, Mn, Fe, Co, Ni, Cu, Zn, ga, Ge, Y, Zr, Nb, Mo, Tc, Ru, Rh, Pd, Ag, Cd, In, Sn, Sb, Ba, Hf, ta, W, Re, Os, Ir, Pt, Au, Hg, TI, La, Ce, Pr, Nd, Pm, Sm, Eu, Gd, Tb, Dy, Ho, Er, Tm, Yb, Lu, Th, Pa, U, Np, and Am or two or more elements such as oxides thereof, fluorides thereof, hydroxides thereof, and bromide thereof.

The charge generation material having a phthalocyanine skeleton in the present invention has at least a basic skeleton structure of the general chemical structure (11) and includes a dimer or higher structure, and even a polymer structure. In addition, the charge generation material also includes the basic skeleton with various kinds of substitution groups. Among these phthalocyanines, titanyl phthalocyanine including TiO as the center metal, metal-free phthalocyanine, chrologallium phthalocyanine, hydroxygallium phthalocyanine are particularly preferable in terms of the characteristics of an image bearing member. In addition, these phthalocyanines are known to have various kinds of crystal types. For example, titanylphthalocyanine has α, β, γ, m, Y, etc., and copper phthalocyanine has α, β, γ, etc. The characteristics of the phthalocyanines having the same center metal vary depending on the crystal type. The characteristics of the image bearing member using the phthalocyanine pigments having various kinds of crystal types are reported to change accordingly (refer to Denshi Shashin Gakkaishi. Vol. 29, issue 4 published in 1990). For this reason, the selection of the phthalocyanine crystal type is extremely important in terms of the characteristics of an image bearing member.

Among these phthalocyanine pigments, the titanyl phthalocyanine crystal having an X-ray (Cu—Kα: wavelength of 1.542 Å) diffraction spectrum such that the main peak is observed at a Bragg (2θ) angle of 27.2±0.2° has particularly high sensitivity and is suitably used in the present invention in terms of high speed image formation. Furthermore, among these, the titanyl phthalocyanine crystal having an X-ray (Cu—Kα: wavelength of 1.542 Å) diffraction spectrum such that such that the maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as the lowest angle diffraction peak, and having no peak between the peak of 9.4°±0.2° peak and the peak of 7.3°±0.2° and no peak at 26.3° is extremely suitable because it has a high charge generation efficiency, and good electrostatic characteristics with less occurrence of background fouling.

These charge generation materials may be used alone or in combination.

The charge generation material mentioned above contained in the image bearing member for use in the present invention is more suitable in some cases when the particle size of the charge generation material is reduced.

Particularly with regard to the phthalocyanine pigments, the average particle size is preferably 0.25 μm or less and more preferably 0.2 μm or less. The method of manufacturing the charge generation material is described below. The particle size of the charge generation material contained in the charge generation layer is controlled by a method of dispersing the charge generation material followed by removing coarse particles having a particle size larger than 0.25 μm. The average particle size represents the volume average particle diameter and is obtained by an ultra-centrifugal particle size distribution analyzer (CAPA-700, manufactured by Horiba, Ltd.). Median diameter, which corresponds to 50% of the cumulative distribution, is calculated as the volume average particle diameter. However, this method involves a problem that a minute quantity of coarse particles is not detected in some cases. Thus, to be more exact, it is preferable to obtain the size by directly observing the charge generation material powder, or liquid dispersion with an electron microscope.

Next, the method of removing coarse particles after dispersion of the charge generation material is described. That is, in this method, a liquid dispersion in which particles are caused to be as fine as possible is screened with a suitable filter. The liquid dispersion is manufactured by a typical method in which a charge generation material and an optional binder resin are dispersed in a suitable solvent using a ball mill, an attritor, a sand mill, a bead mill, or ultrasonic. The binder resin is selected based on the electrostatic characteristics of an image bearing member and the solvent is selected based on the wettability to a pigment and the dispersion property thereof.

This method is effective in that the coarse particles remaining in a minute quantity which are not detected by naked eyes (or particle size measurement) are removed and consequently the obtained particle size distribution is sharp. To be specific, the liquid dispersion prepared as described above is filtered by a filter having an effective pore diameter of 5 μm or less, and preferably 3 μm or less. According to this method, a liquid dispersion containing only a charge generation material having a small particle size (0.25 μm or less and preferably 0.2 μm or less) is prepared, thereby improving the electrostatic characteristics such as sensitivity and chargeability of an image bearing member and sustaining the effect.

When the particle size of the liquid dispersion to be filtered is too large, or the particle size distribution thereof is too wide, the loss by the filtration tends to be great, which leads to clogging, thereby making filtration impossible. Therefore, with regard to the liquid dispersions before filtration, it is desired to perform the dispersion by which the average particle size is not greater than 0.3 μm with a standard deviation of 0.2 μm. When the average particle size is too large, the loss of the filtration tends to increase and when the standard deviation is too large, the filtration may take extremely long.

The charge generation material mentioned above has en extremely strong intermolecular hydrogen binding force, which is characteristic to a charge generation material having a high sensitivity. Therefore, the particles of the dispersed pigment particles have an extremely strong mutual action therebetween. As a result, the charge generation material particles dispersed by a dispersion device are likely to re-agglomerate by dilution, etc. However, as described above, such agglomerated substance can be removed after the dispersion with a filter having a specific size or less. At this point, since the liquid dispersion is in thixotropic, particles having a size smaller than the effective pore diameter of a filter are also removed. Alternatively, the liquid having a structure viscosity is filtered to have a state close to Newtonian. Thus, the effect of the present invention is improved by removing coarse particles of the charge generation material as described above.

In addition, among the azo pigments, the azo pigments represented by the chemical structure (10) are preferably used. Particularly, asymmetry disazo pigment which has $Cp_1$ different from $Cp_2$ has an excellent carrier generation efficiency, which is effective in terms of high speed performance, and is preferably used as the charge generation material for use in the present invention.

Chemical structure 10

(10)

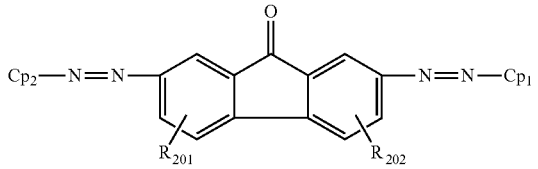

In Chemical structure (10), $Cp_1$ and $Cp_2$ represent coupler remaining groups. $R_{201}$ and $R_{202}$ independently represent hydrogen atom, a halogen atom, an alkyl group, an alkoxy group, and cyano group. $Cp_1$ and $Cp_2$ are represented by the following chemical structure 10a and the asymmetry disazo pigment can be obtained by making the structure thereof different from each other.

Chemical structure 10a (10a)

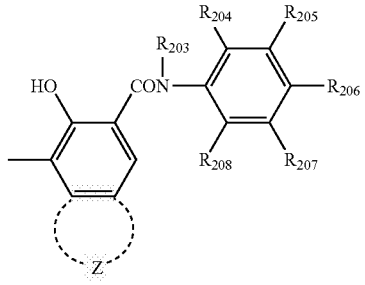

In Chemical structure (10a), $R_{203}$ represents hydrogen atom, an alkyl group such as methyl group and ethyl group, and an aryl group such as phenyl group. $R_{204}$, $R_{205}$, $R_{206}$, $R_{207}$, and $R_{208}$ independently represent. Hydrogen atom, nitro group, cyano group, a halogen atom such as fluorine, chlorine, bromine and iodine, halogenized alkyl group such as trifluoromethyl group, an alkyl group such as methyl group and ethyl group, an alkoxy group such as methoxy group, and ethoxy group, dialkyl amino group, and hydroxyl group. Z represents an atom group required to constitute a substituted or non-substituted carbon cyclic aromatic ring, or a substituted or non-substituted heterocyclic aromatic ring. These charge generation materials can be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, polyacrylamides, polyvinyl benzale, polyester, phenoxy resin, copolymer of vinylchloride and vinyl acetate, polyvinyl acetate, polyphenylene oxide, polyvinylpyridine, cellulose based resin, casein, polyvinyl alcohol, and polyvinyl pyrolidone.

Among these, polyvinyl butyral is preferably used. These binder resins can be used alone or as a mixture of two or more.

Specific examples of the solvents include, but are not limited to, known organic solvents such as isopropanol, acetone, methylethylketone, cyclohexanone, tetrahydrofuran, dioxane, ethylcellosolve, ethyl acetate, methylacetate, dichloromethane, dichloroethane, monochlorobenzene, cyclohexane, toluene, xylene, and ligroin. Among these, ketone based solvents, ester based solvents, and ether based solvents are preferably used. These can be used alone or as a mixture of two or more.

Liquid application of the charge generation layer is prepared by dispersing a charge generation material with an optional binder resin in a solvent with a known dispersion method using a ball mill, an attritor, a sand mill, a bead mill, or ultrasonic. The optional binder resin can be added before or after dispersion of the charge generation material. The liquid application of the charge generation layer is mainly formed of a charge generation material, a solvent, and a binder resin and may also contain additives such as a sensitizer, a dispersion agent, a surface active agent, and silicone oil. A charge transport material, which is described later, can be added to the charge generation layer. The addition amount of the binder resin is from 0 to 500 parts by weight and preferably from 10 to 300 parts by weight based on 100 parts by weight of the charge generation material.

The charge generation layer is formed by applying the liquid application mentioned above to an electroconductive substrate, or an undercoating layer, followed by drying. Known methods such as a dip coating method, a spray coating method, a bead coating method, a nozzle coating method, a spinner coating method, and a ring coating method can be used as the application method. The layer thickness of the charge generating layer is from about 0.01 to about 5 μm and preferably from 0.1 to 2 μm. The liquid application is heated and dried in an oven, etc. after application. The drying temperature of the charge generation layer is preferably from 50 to 160° C., and more preferably from 80 to 140° C.

Charge Transport Layer

The charge transport layer is mainly formed of a charge generation material and a binder resin.

The charge transport material is typified into a positive hole transport material and an electron transport material.

Specific examples of such electron transport structures include, but are not limited to, electron accepting structure material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, condensed heterocyclic quinine, diphenoquinone, benzoquinone, naphtharene tetracarboxylic acid diimide, and aromatic rings having a cyano group or a nitro group.

Specific examples of the positive hole transport materials include, but are not limited to, poly(N-vinylvarbazole) and derivatives thereof, poly(γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, aminobiphenyl derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, distilbene derivatives, enamine derivatives and charge transport materials having a molecular weight of from 600 to 900.

These charge transport materials may be used alone or in combination.

In the present invention, among these charge transport materials, compounds having a distyryl structure are preferable and the distyryl compound represented by the chemical structure 1 is particularly preferable.

Chemical structure 1

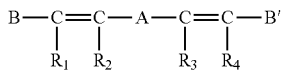

(1)

$R_1$ to $R_4$ independently represent hydrogen atom, an alkyl group having 1 to 4 carbon atoms, an alkoxy group having 1 to 4 carbon atoms, or a substituted or non-substituted phenyl group. The phenyl group can take an alkyl group having 1 to 4 carbon atoms, and an alkoxy group having 1 to 4 carbon atoms as a substitution group.

"A" represents a substituted or a non-substituted arylene group, or a group represented by Chemical structure 1a. "B" and "B'" independently represent a substituted or a non-substituted arylene group, or a group represented by Chemical structure 1b.

Chemical structure 6

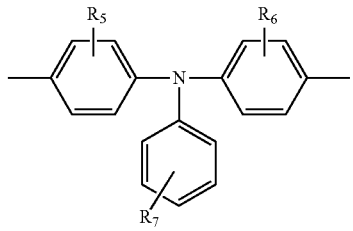

(1a)

$R_5$, $R_6$, and $R_7$ independently represent hydrogen atom, an alkyl group having 1 to 4 carbon atoms, an alkoxy group having 1 to 4 carbon atoms, or a substituted or non-substituted phenyl group. The phenyl group can take an alkyl group having 1 to 4 carbon atoms, and an alkoxy group having 1 to 4 carbon atoms as a substitution group.

Chemical structure 1b (1b)

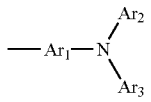

In the Chemical structure 1b, $Ar_1$ represents an arylene group, which may has an alkyl group having 1 to 4 carbon atoms, and an alkoxy group having 1 to 4 carbon atoms as a substitution group. In addition, $Ar_2$ and $Ar_3$ independently represent an aryl group, which may has an alkyl group having 1 to 4 carbon atoms, and an alkoxy group having 1 to 4 carbon atoms as a substitution group.

Among these compounds, the distyryl compound represented by the following Chemical structure 2 is particularly preferable in the present invention.

Chemical structure 2

(2)

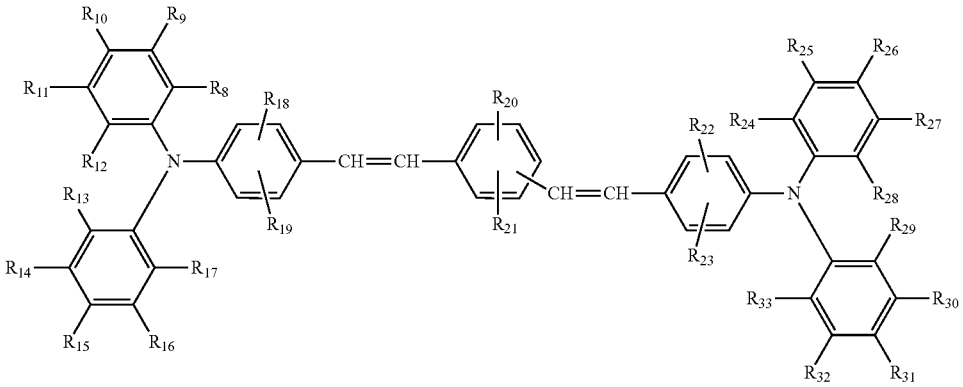

In the chemical structure 2, $R_8$ to $R_{33}$ independently represent hydrogen atom, an alkyl group having 1 to 4 carbon atoms, an alkoxy group having 1 to 4 carbon atoms, or a substituted or non-substituted phenyl group.

In addition, the charge transport material illustrated by the following chemical structure 3 is preferable in the present invention.

Chemical structure 3

(3)

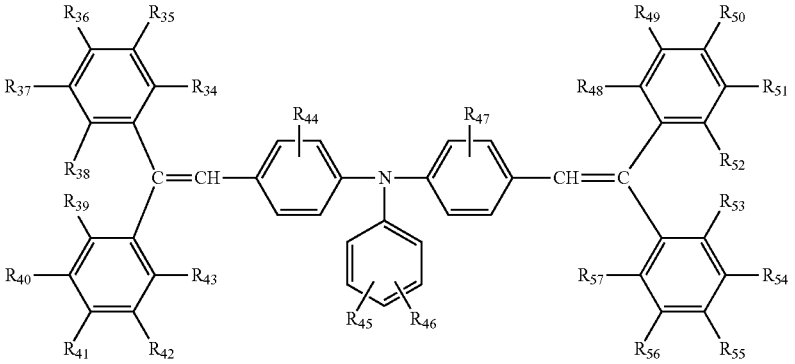

In the chemical structure 3, $R_{34}$ to $R_{57}$ independently represent hydrogen atom, an alkyl group having 1 to 4 carbon atoms, an alkoxy group having 1 to 4 carbon atoms, or a substituted or non-substituted phenyl group.

Specific examples of these compounds used as the charge transport materials in the present invention include, but are not limited to, the following. These compounds are for the illustration purpose only and the present invention is not limited thereto.

No. 1

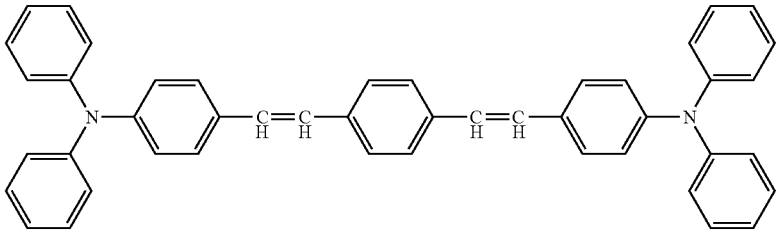

No. 2

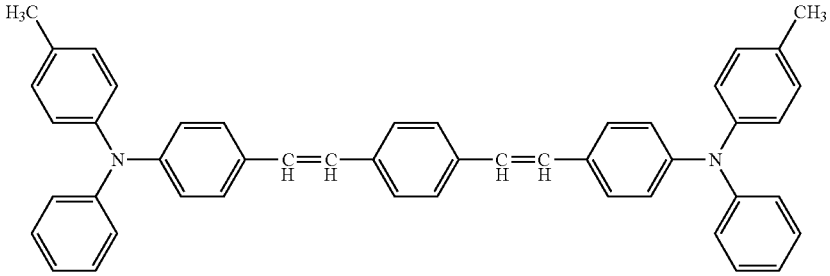

No. 3

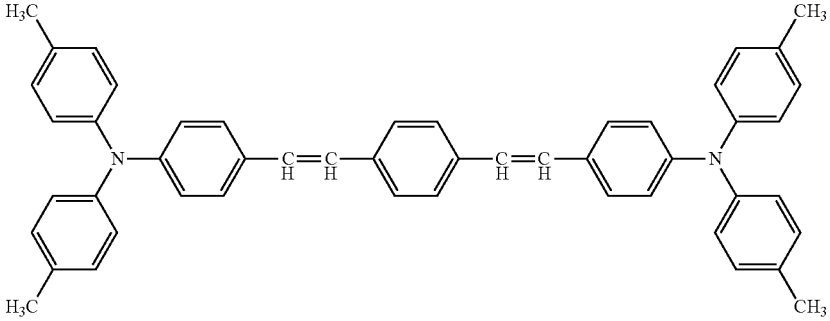

No. 4

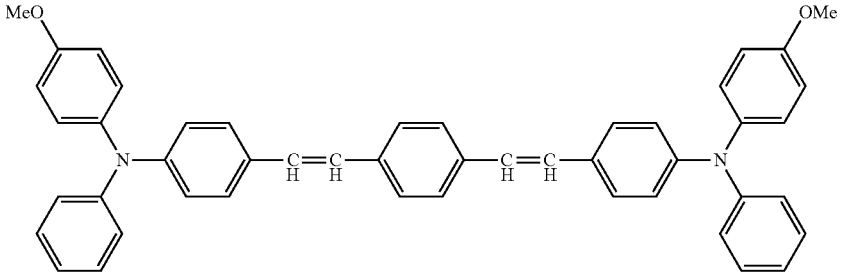

No. 5

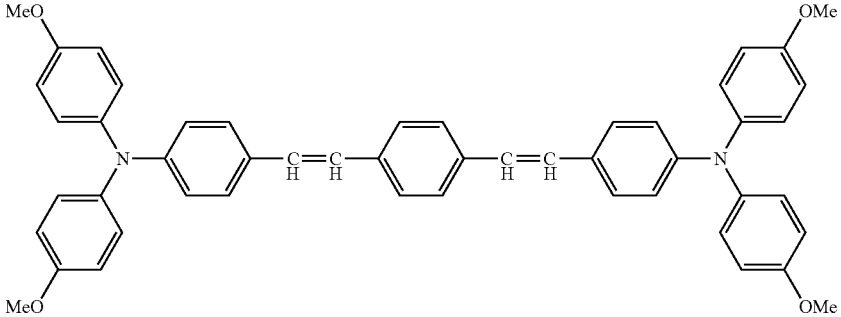

-continued
No. 6
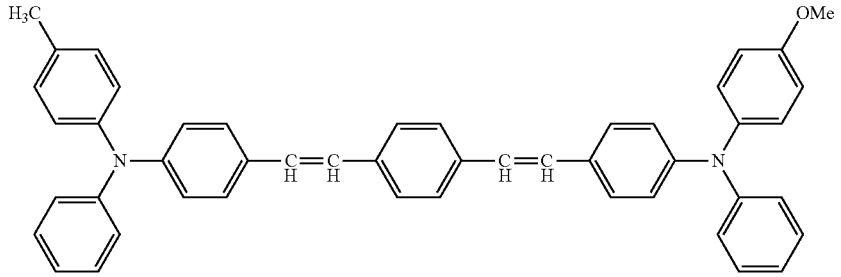
No. 7
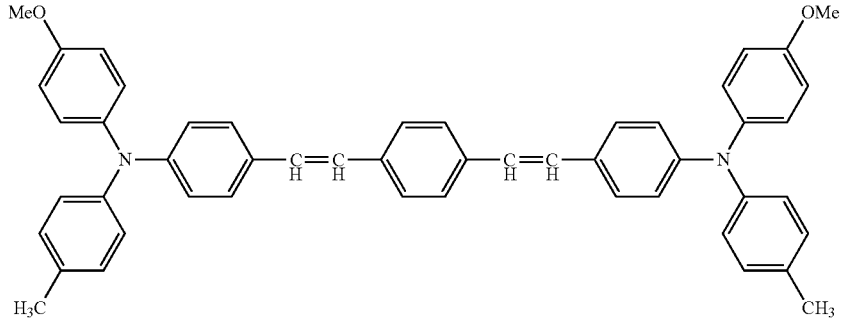
No. 8
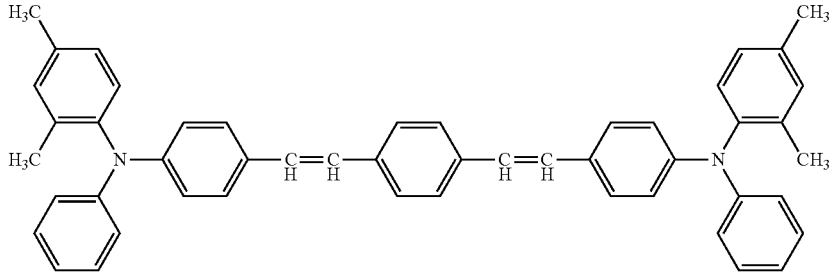
No. 9
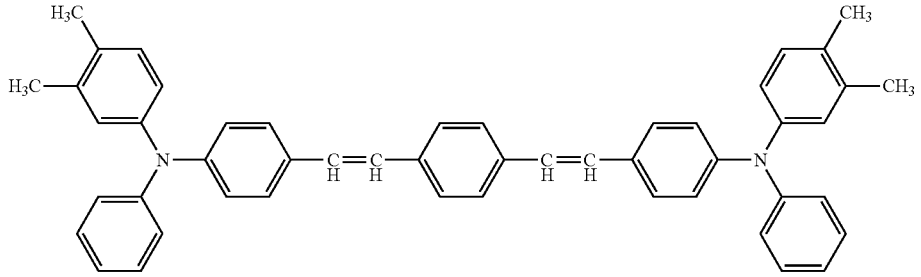
No. 10
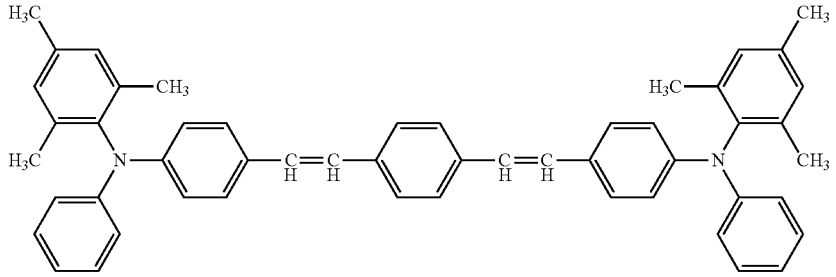

-continued
No. 11
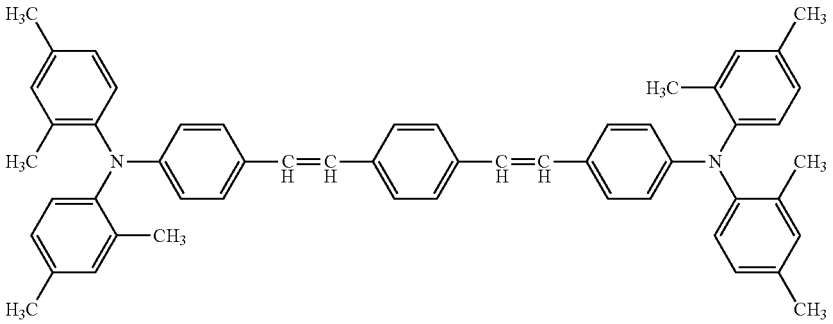
No. 12
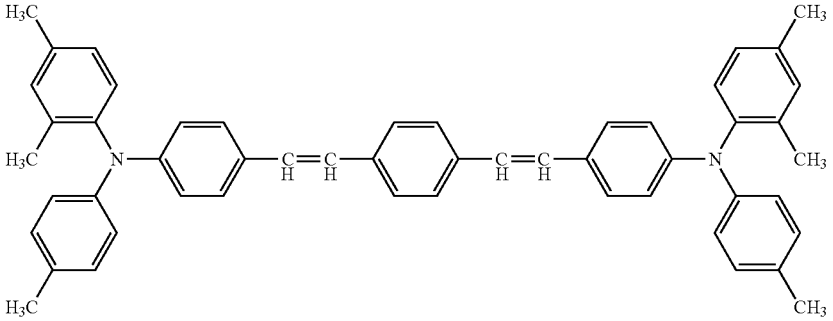
No. 13
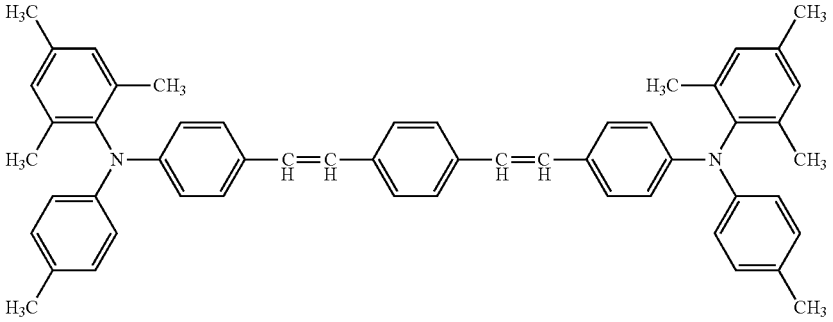
No. 14
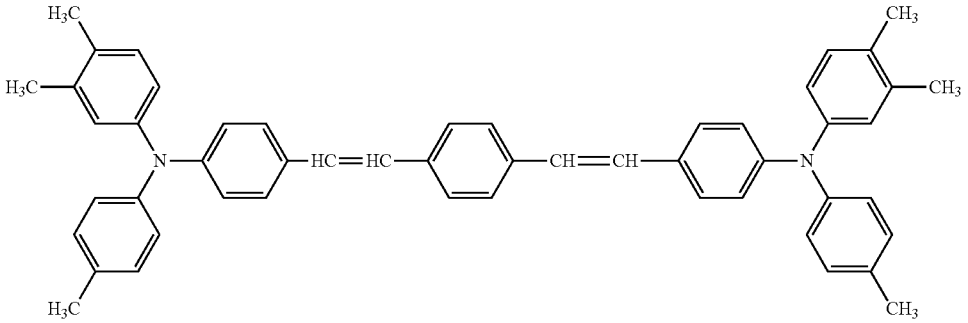
No. 15
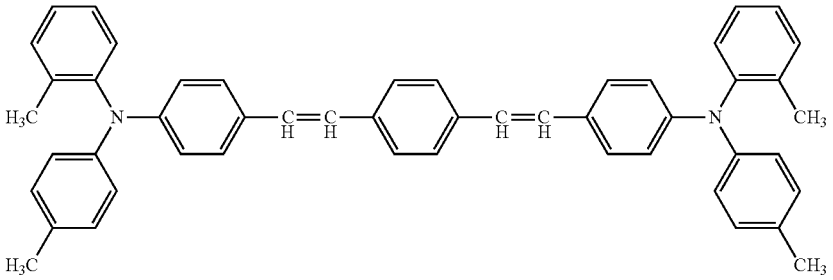

-continued
No. 16
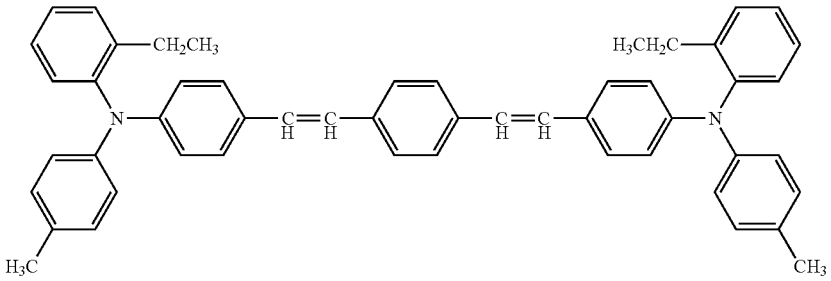
No. 17
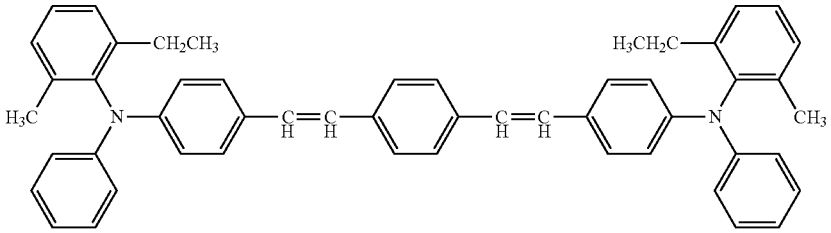
No.18
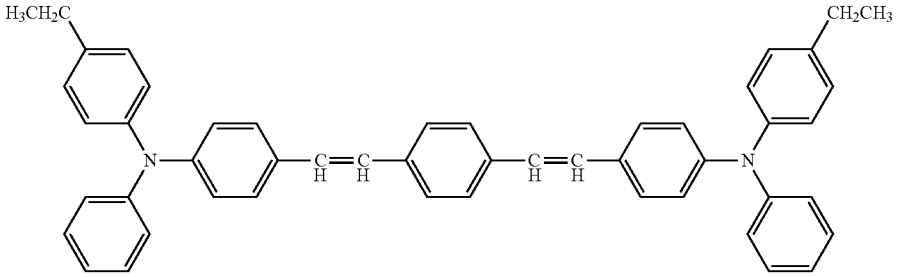
No. 19
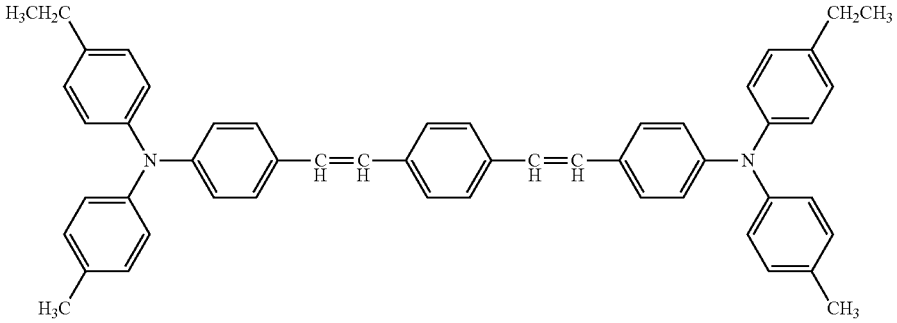
No. 20
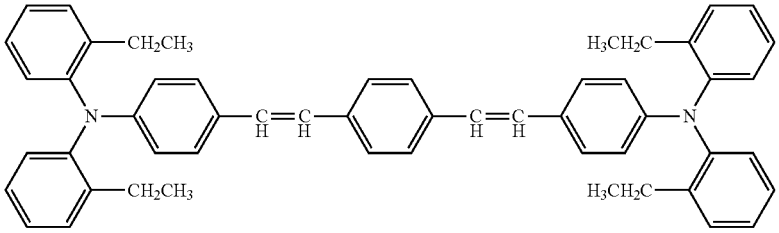

-continued
No. 21
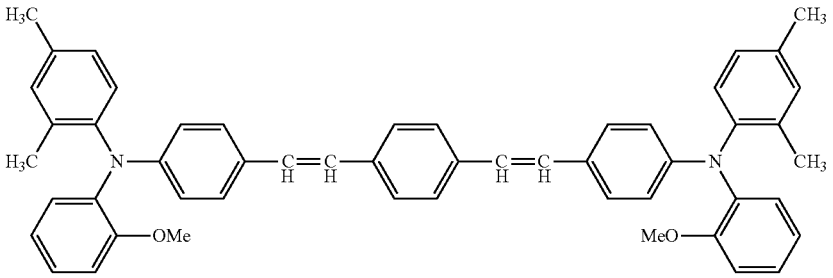
No. 22
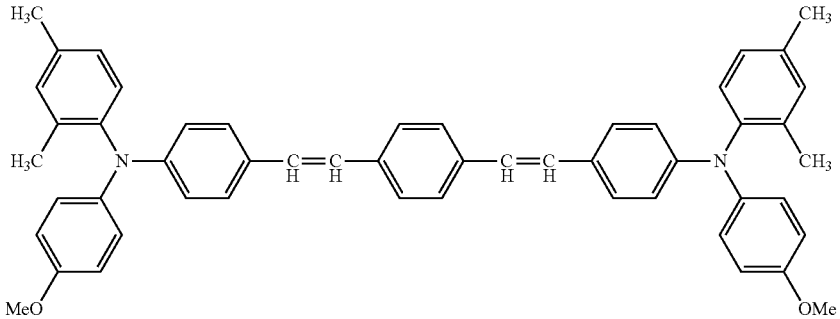
No. 23
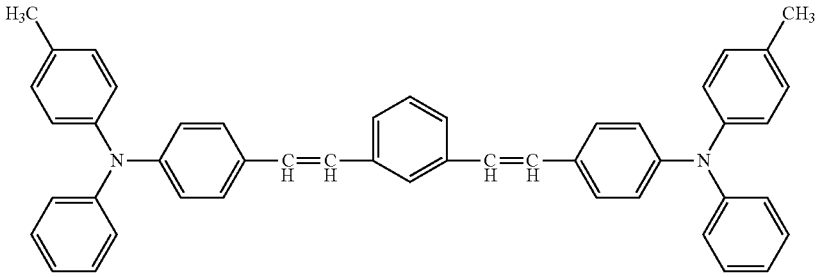
No. 24
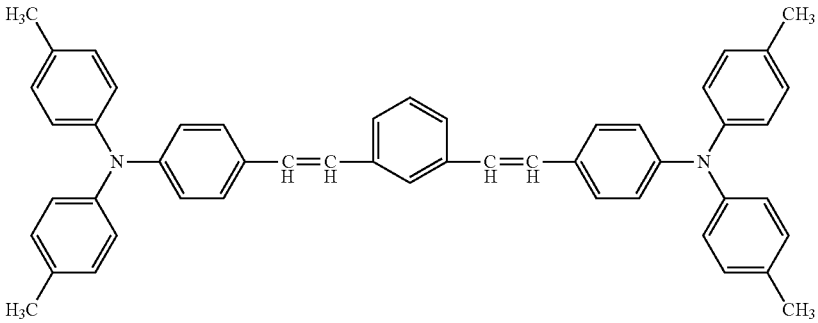
No. 25
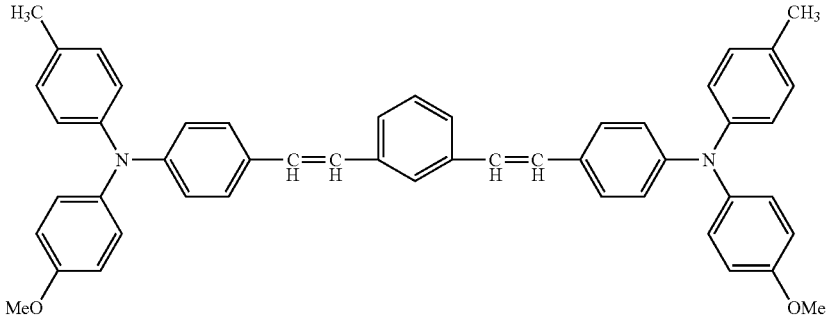

-continued
No. 26
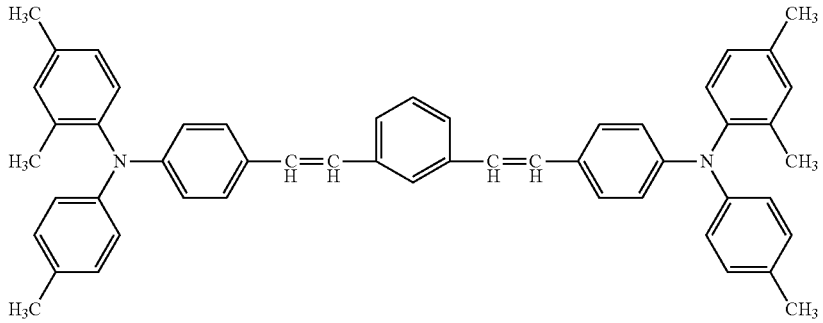
No. 27
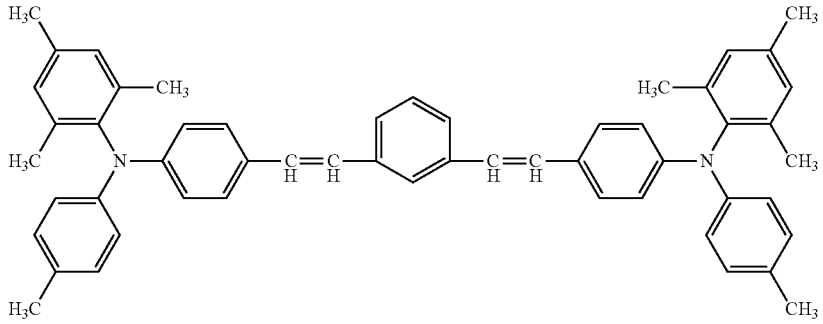
No. 28
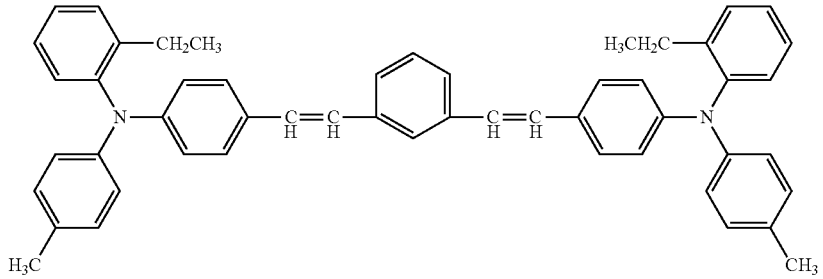
No. 29
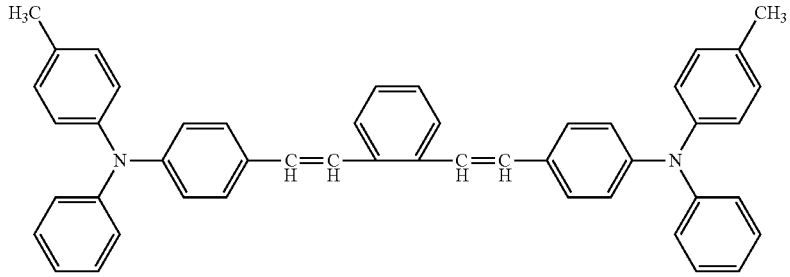
No. 30
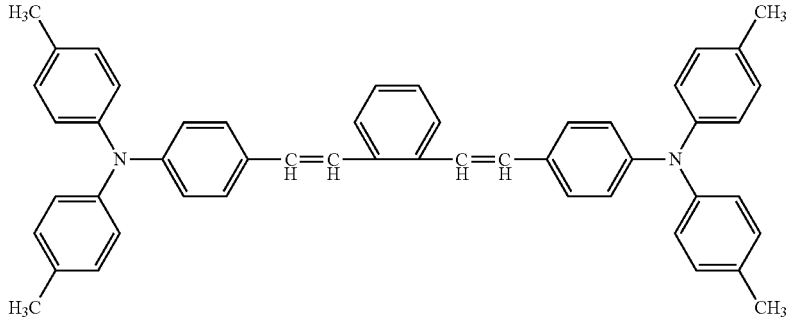

-continued
No. 31
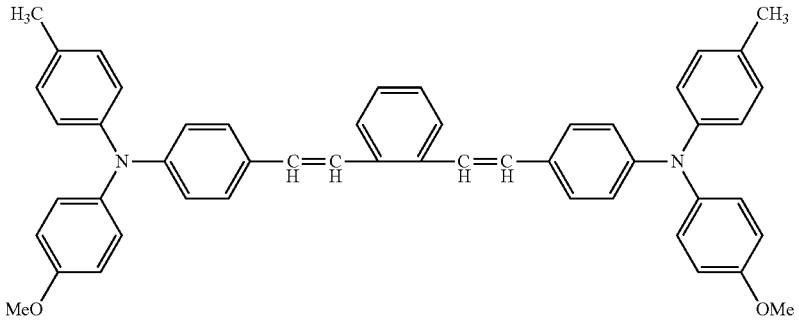
No. 32
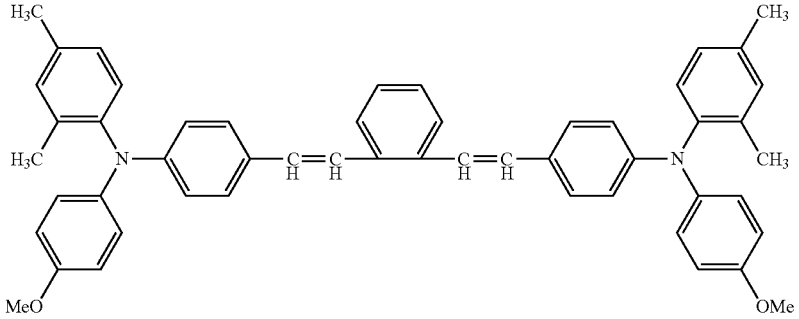
No. 33
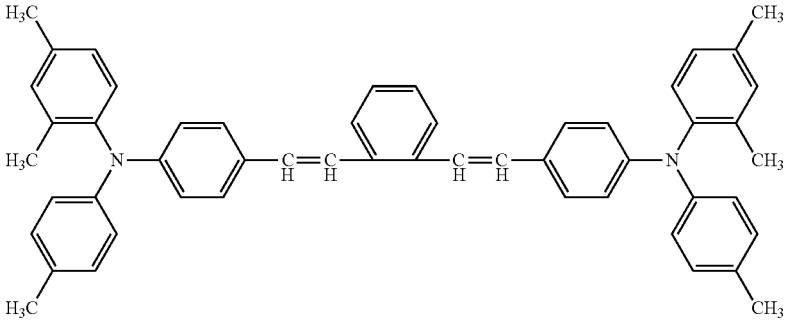
No. 34
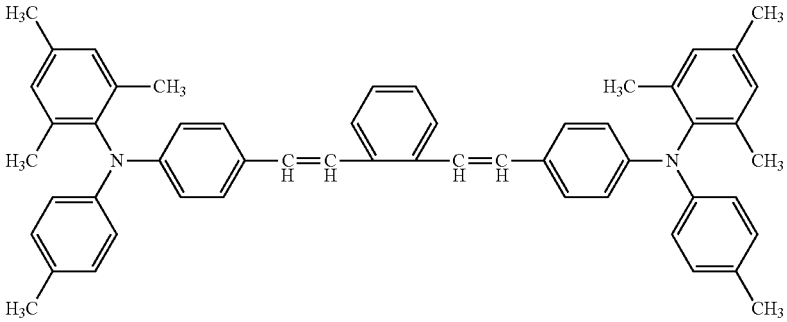
No. 35
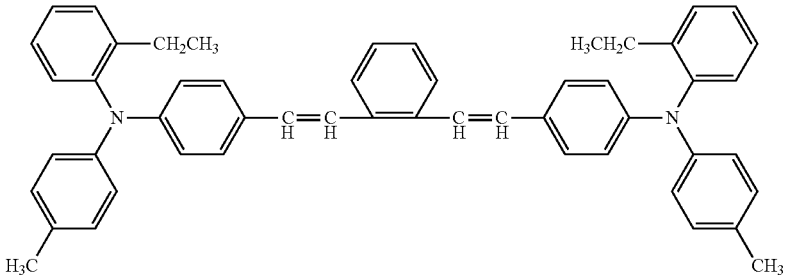

-continued
No. 36
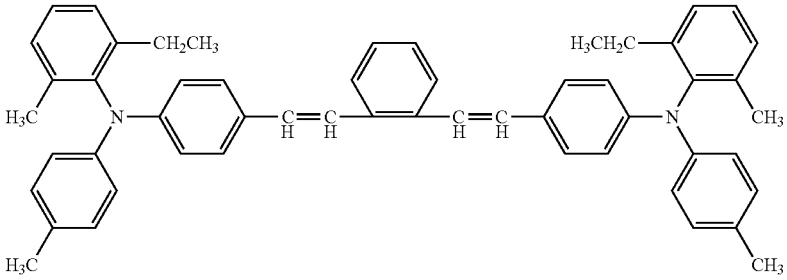
No. 37
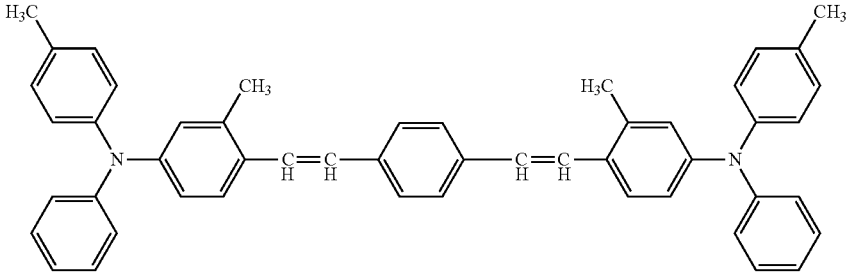
No. 38
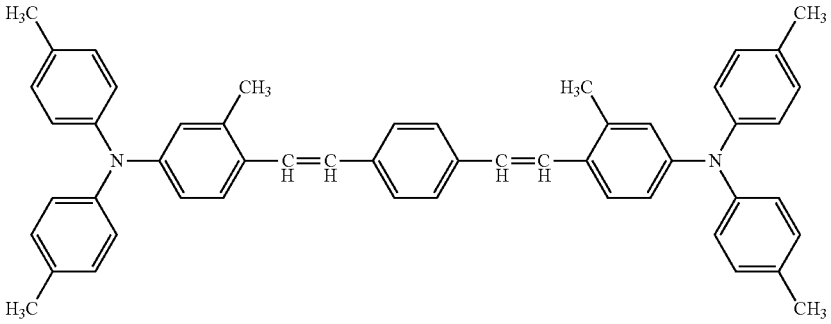
No. 39
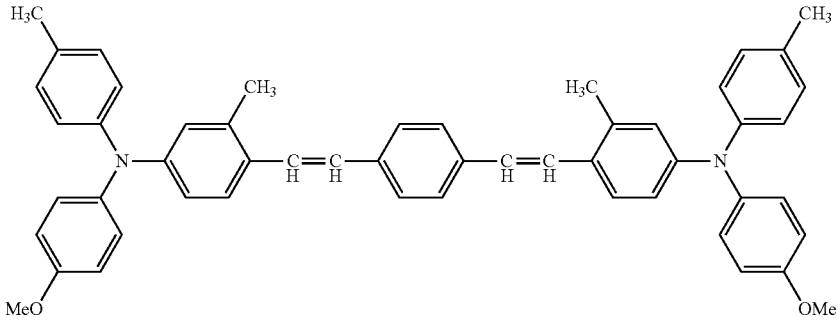
No. 40
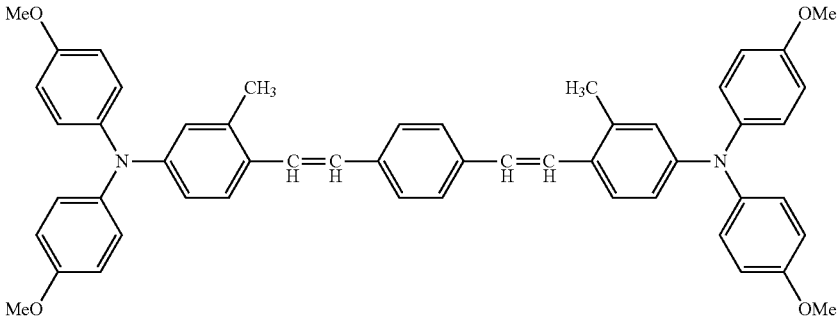

-continued
No. 41
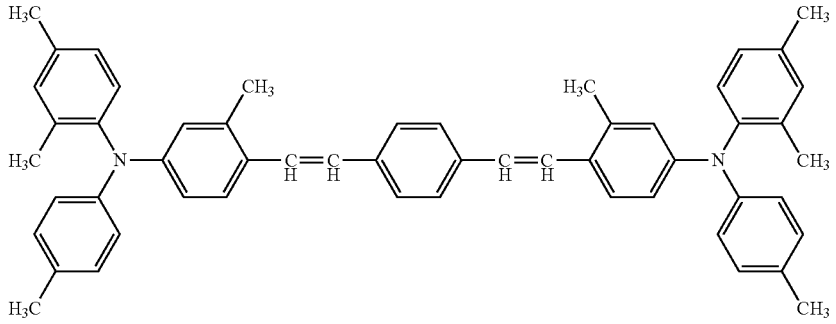
No. 42
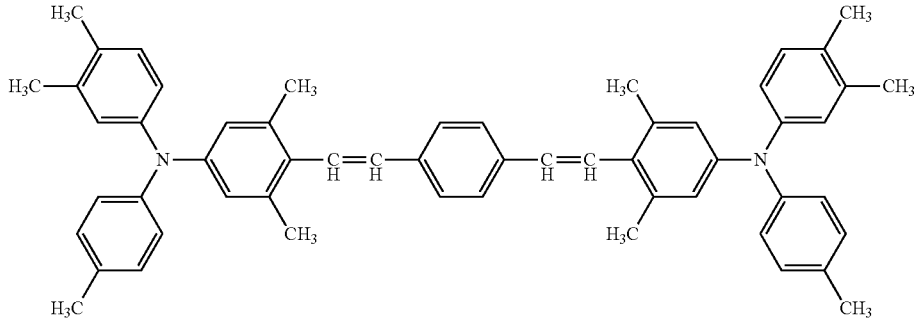
No. 43
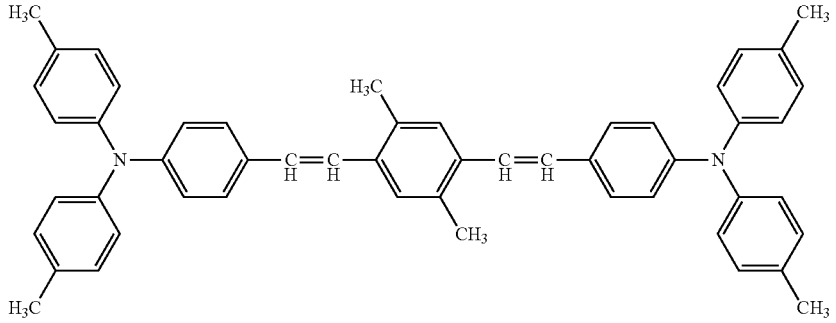
No. 44
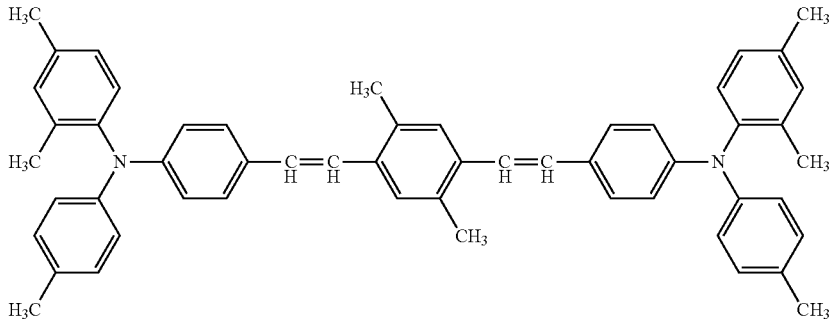

-continued
No. 45
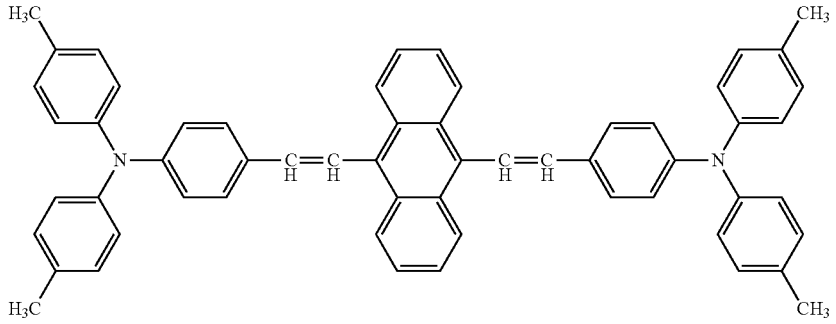
No. 46
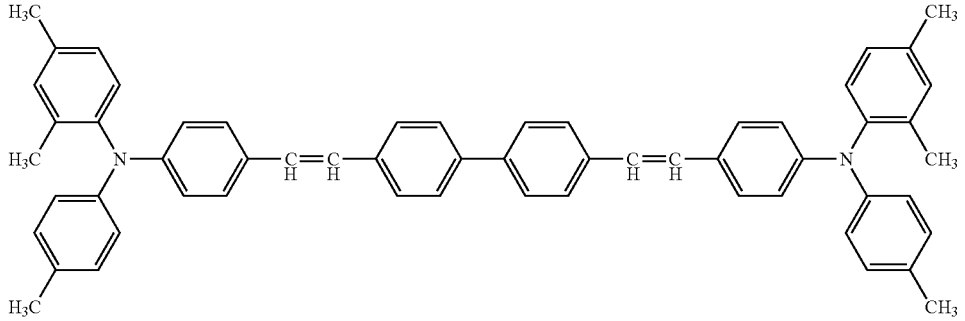
No. 47
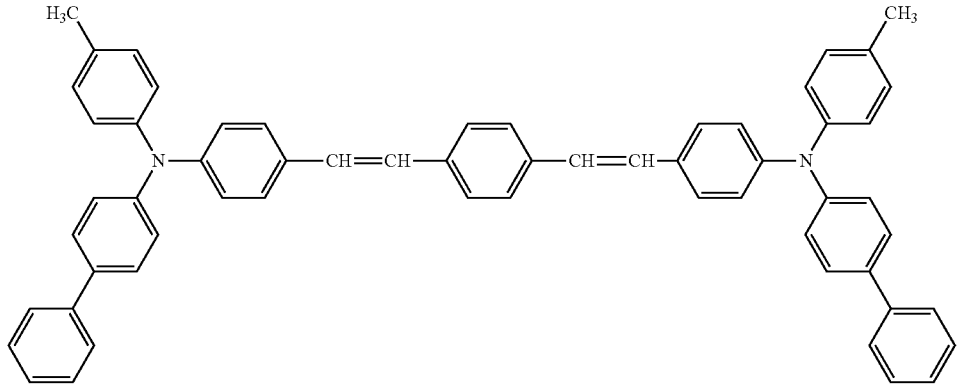
No. 48
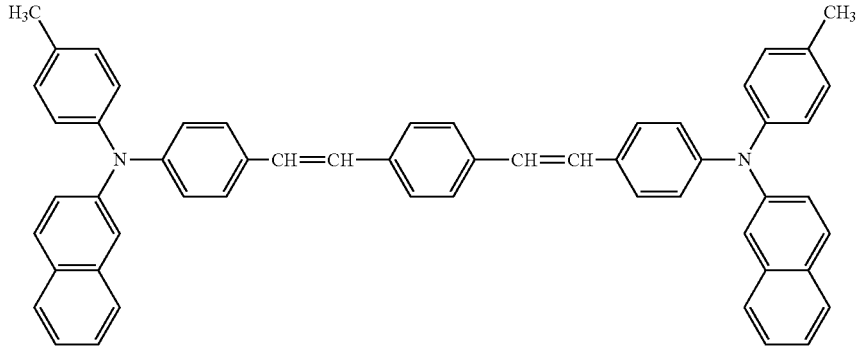

-continued
No. 49
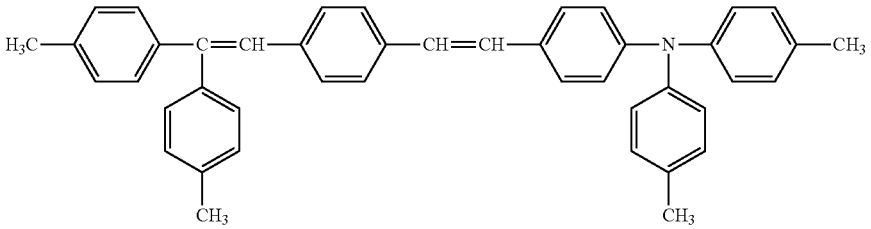
No. 50
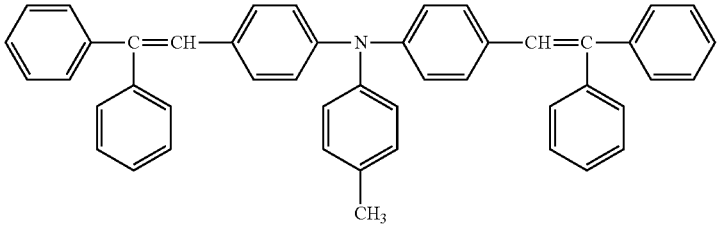
No. 51
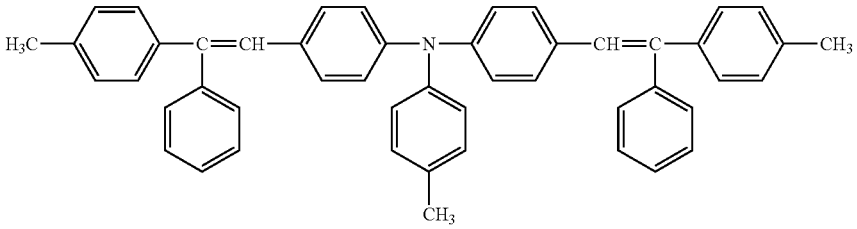
No. 52
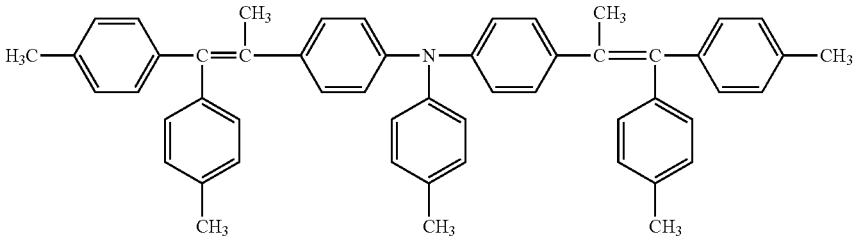
No. 53
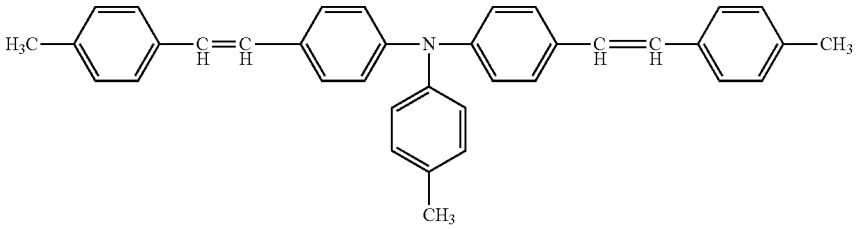
No. 54
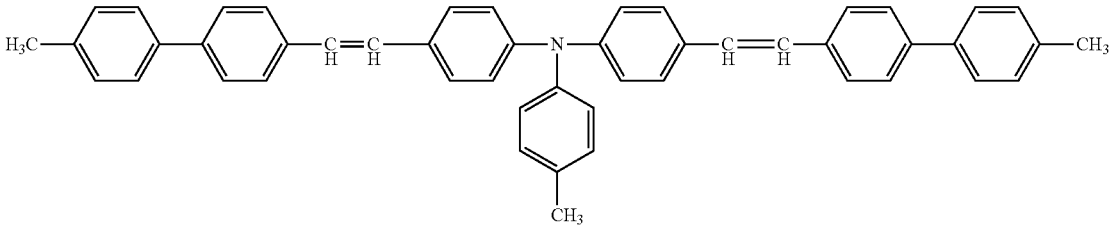

-continued

No. 55

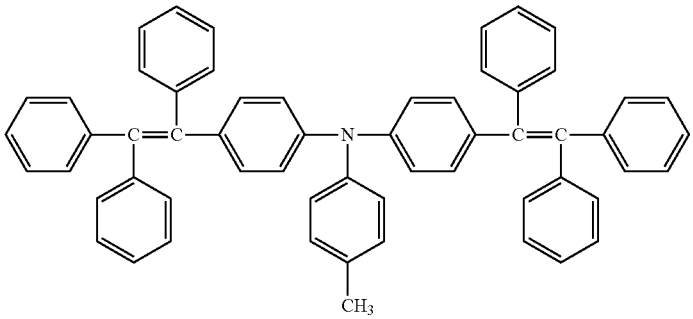

No. 56

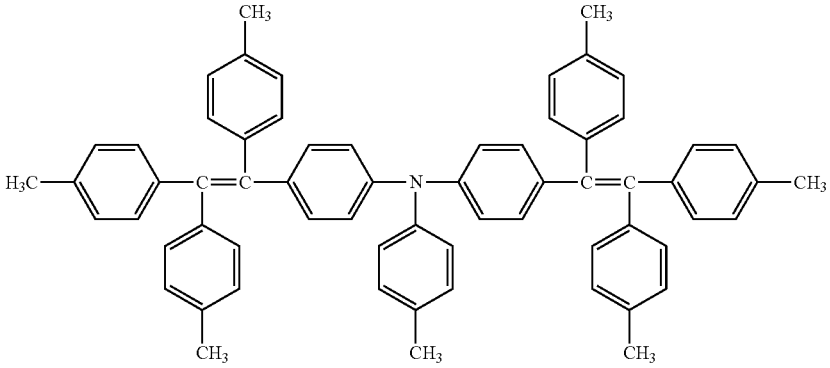

No. 57

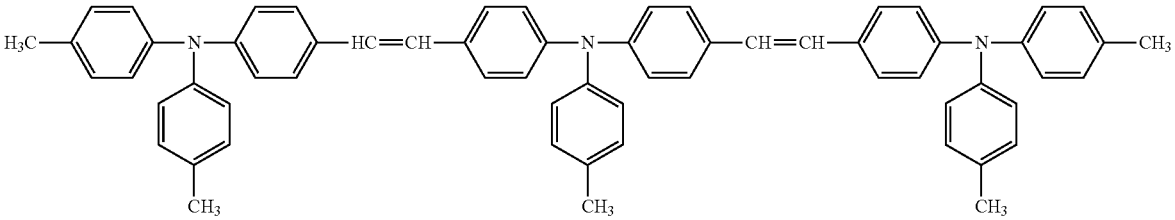

No. 58

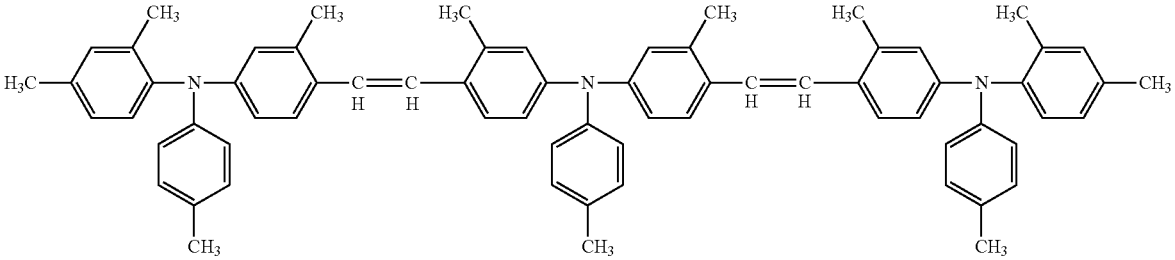

Specific examples of the binder resin include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenolic resins, and alkyd resins. In the present invention, among these binder resins, polycarbonate and polyarylate are preferably used.

In addition, a charge transport layer may contain a charge transport polymer having a function as the charge transport material and a function as a binder resin. Known charge transport materials can be suitably used as the charge transport polymer. A polycarbonate having a triarylamine structure in the main and or branch chain is particularly suitable. Among these, the charge transport materials illustrated by the following specific chemical structures (I) to (X) are suitably used.

Chemical structure (I)

(I)

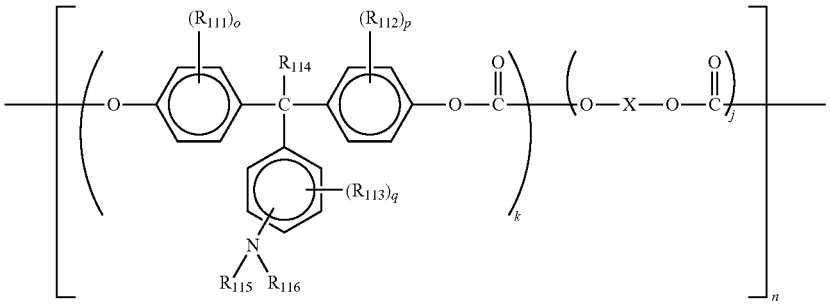

In the chemical structure (I), $R_{111}$, $R_{112}$, and $R_{113}$ independently represent a substituted or non-substituted alkyl group, or a halogen atom, $R_{114}$ represents a hydrogen atom, or a substituted or non-substituted alkyl group, $R_{115}$ and $R_{116}$ represent a substituted or non-substituted aryl group, o, p, and q independently represent 0, 1, 2, 3, or 4 and "k" and "j" represent composition ratio. "k is a number of from 0.1 to 1.0 and j is a number of from 0 to 0.9; n is an integer of from 5 to 5000.

"X" represents a divalent aliphatic group, a divalent alicyclic group or a divalent group represented by the following chemical structure (I-a). In the chemical structure (I), the illustrated compound is in the form of a block copolymer, but the polymer is not limited thereto, and may be a random copolymer.

Chemical structure (I-a)

(I-a)

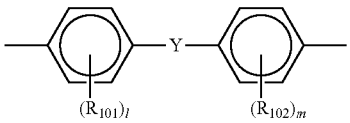

In the chemical structure (I-a), $R_{101}$ and $R_{102}$ independently represent a substituted or unsubstituted alkyl group, a substituted or unsubstituted aryl group, or a halogen atom. "1" and "m" represent 0 or an integer of from 1 to 4; "Y" represents a single bond, a linear alkylene group, a branched alkylene group, a cyclic alkylene group, —O—, —S—, —SO—, —$SO_2$—, —CO—, —CO—O—Z—O—CO— (Z represents a divalent aliphatic group), or a group represented by the following chemical structure (I-b).

Chemical structure I-b (I-b)

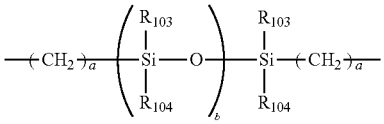

In the chemical structure (I-b), "a" is an integer of from 1 to 20; b is an integer of from 1 to 2,000; and $R_{103}$ and $R_{104}$ independently represent a substituted or unsubstituted alkyl group, or a substituted or unsubstituted aryl group.

Chemical structure II (II)

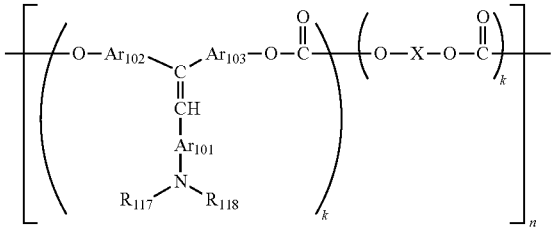

$R_{117}$ and $R_{118}$ independently represent a substituted or unsubstituted aryl group; $Ar_{101}$, $Ar_{102}$ and $Ar_{103}$ independently represent an arylene group. X, k, j and n are defined above in the chemical structure (I). In the chemical structure (II), the illustrated compound is in the form of a block copolymer, but the polymer is not limited thereto, and may be a random copolymer.

Chemical structure III (III)

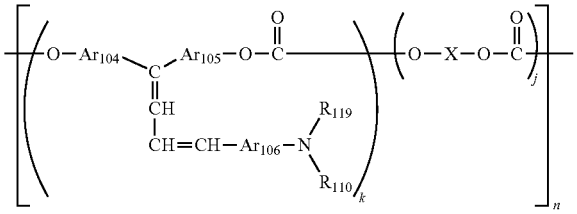

wherein $R_{119}$ and $R_{110}$ independently represent a substituted or unsubstituted aryl group; $Ar_{104}$, $Ar_{105}$ and $Ar_{106}$ independently represent an arylene group. X, k, j and n are defined above in chemical structure (I). In the chemical structure (III), the illustrated compound is in the form of a block copolymer, but the polymer is not limited thereto, and may be a random copolymer.

Chemical structure IV (IV)

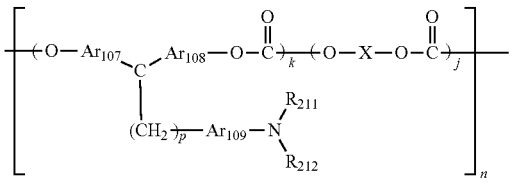

wherein $R_{211}$ and $R_{212}$ independently represent a substituted or unsubstituted aryl group; $Ar_{107}$, $Ar_{108}$ and $Ar_{109}$ independently represent an arylene group, and "p" represents an integer of from 1 to 5. X, k, j and n are defined above in chemical structure (I). In the chemical structure (IV), the illustrated compound is in the form of a block copolymer, but the polymer is not limited thereto, and may be a random copolymer.

Chemical structure V (V)

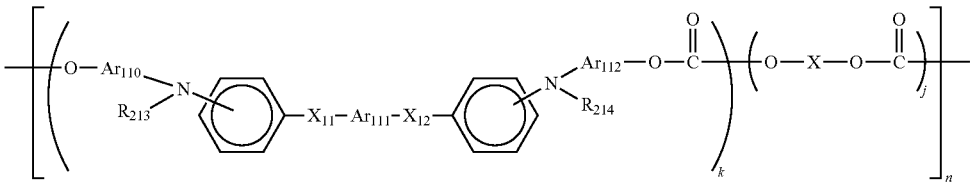

wherein $R_{213}$ and $R_{214}$ independently represent a substituted or unsubstituted aryl group; $Ar_{110}$, $Ar_{111}$ and $Ar_{112}$ independently represent an arylene group; $X_{11}$ and $X_{12}$ independently represent a substituted or unsubstituted ethylene group, or a substituted or unsubstituted vinylene group. X, k, j and n are defined above in chemical structure (I). In the chemical structure (V), the illustrated compound is in the form of a block copolymer, but the polymer is not limited thereto, and may be a random copolymer.

Chemical structure VI (VI)

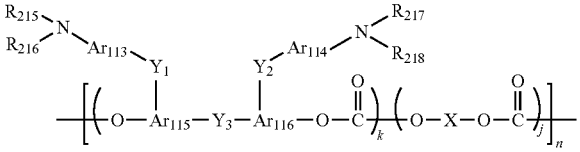

wherein $R_{215}$, $R_{216}$, $R_{217}$ and $R_{218}$ independently represent a substituted or unsubstituted aryl group; $Ar_{113}$, $Ar_{114}$, $Ar_{115}$ and $Ar_{116}$ independently represent an arylene group; $Y_1$, $Y_2$ and $Y_3$ independently represent a single bond, a substituted or unsubstituted alkylene group, a substituted or unsubstituted cycloalkylene group, a substituted or unsubstituted alkylene ether group, an oxygen atom, a sulfur atom, or a vinylene group. X, k, j and n are defined above in chemical structure (I). In the chemical structure (VI), the illustrated compound is in the form of a block copolymer, but the polymer is not limited thereto, and may be a random copolymer.

Chemical structure VII (VII)

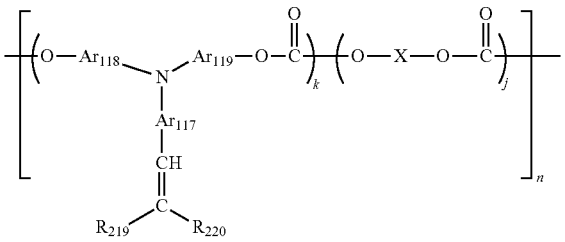

wherein $R_{219}$ and $R_{220}$ independently represent a hydrogen atom, or a substituted or unsubstituted aryl group, and $R_{219}$ and $R_{220}$ optionally share bond connectivity to form a ring. $Ar_{117}$, $Ar_{118}$ and $Ar_{119}$ independently represent an arylene group. X, k, j and n are defined above in chemical structure (I). In the chemical structure (VII), the illustrated compound is in the form of a block copolymer, but the polymer is not limited thereto, and may be a random copolymer.

Chemical structure VIII (VIII)

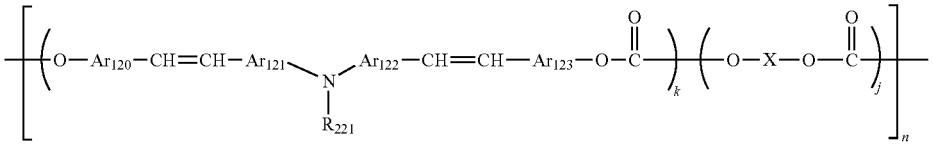

wherein $R_{221}$ represents a substituted or unsubstituted aryl group; $Ar_{120}$, $Ar_{121}$, $Ar_{122}$ and $Ar_{123}$ independently represent an arylene group. X, k, j and n are defined above in chemical structure (I). In the chemical structure (VIII), the illustrated compound is in the form of a block copolymer, but the polymer is not limited thereto, and may be a random copolymer.

Chemical structure IX (IX)

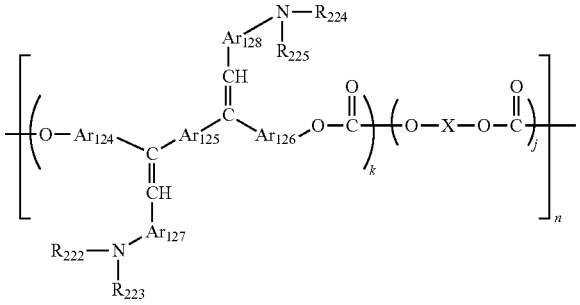

wherein $R_{222}$, $R_{223}$, $R_{224}$ and $R_{225}$ independently represent a substituted or unsubstituted aryl group; $Ar_{124}$, $Ar_{125}$, $Ar_{126}$, $Ar_{127}$ and $Ar_{128}$ independently represent an arylene group. X, k, j and n are defined above in chemical structure (I). In the chemical structure (IX), the illustrated compound is in the form of a block copolymer, but the polymer is not limited thereto, and may be a random copolymer.

Chemical structure X (X)

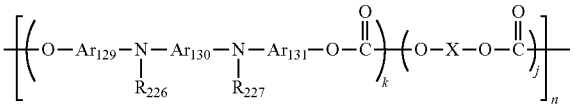

wherein $R_{226}$ and $R_{227}$ independently represent a substituted or unsubstituted aryl group; $Ar_{129}$, $Ar_{130}$ and $Ar_{131}$ independently represent an arylene group. X, k, j and n are defined above in chemical structure (I). In the chemical structure (X), the illustrated compound is in the form of a block copolymer, but the polymer is not limited thereto, and may be a random copolymer.

Specific examples of polycarbonates having these triarylamine structure in the main or branch chain are illustrated below but these compounds are for the illustration purpose only and the present invention is not limited thereto.

Specific compound chemical structure 1
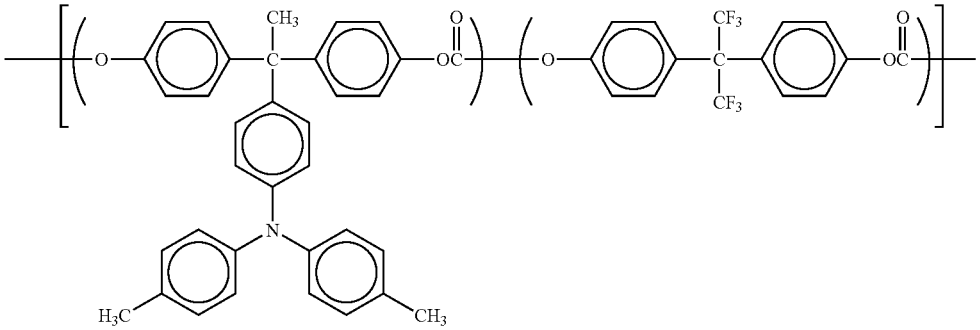
Specific compound chemical structure 2
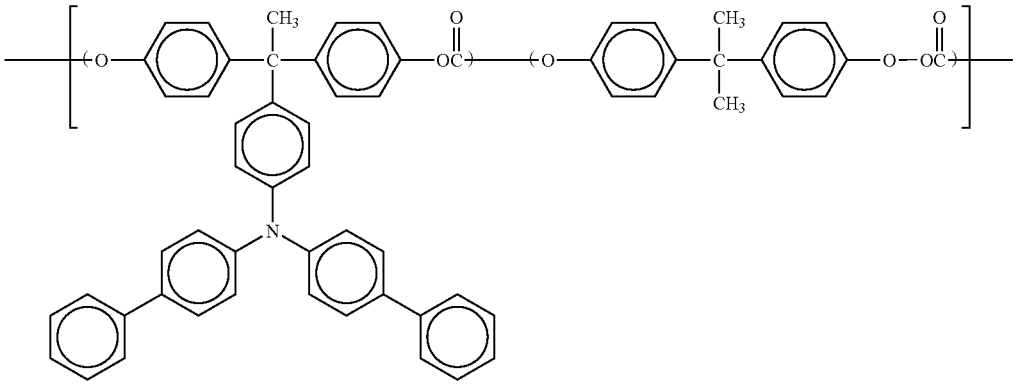
Specific compound chemical structure 3
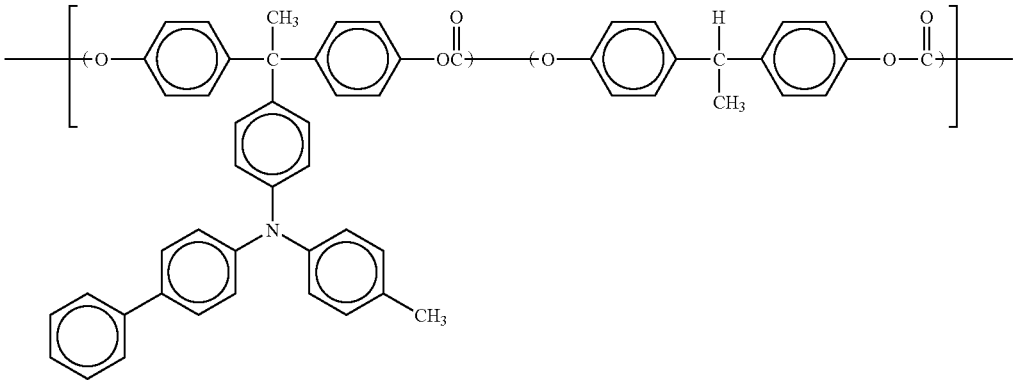
Specific compound chemical structure 4
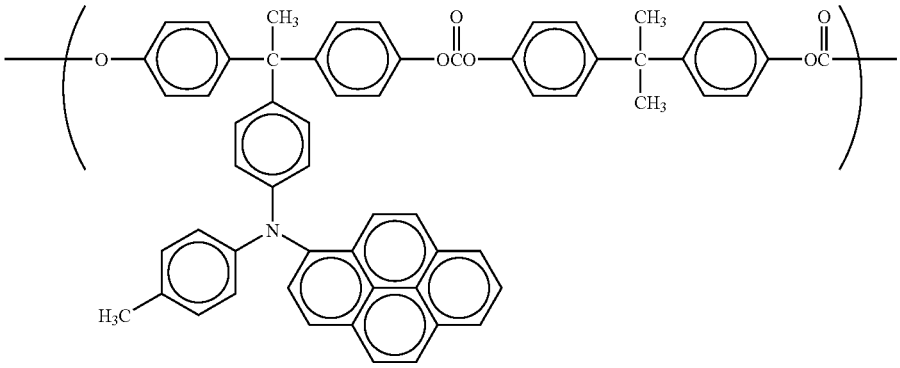

-continued
Specific compound chemical structure 5
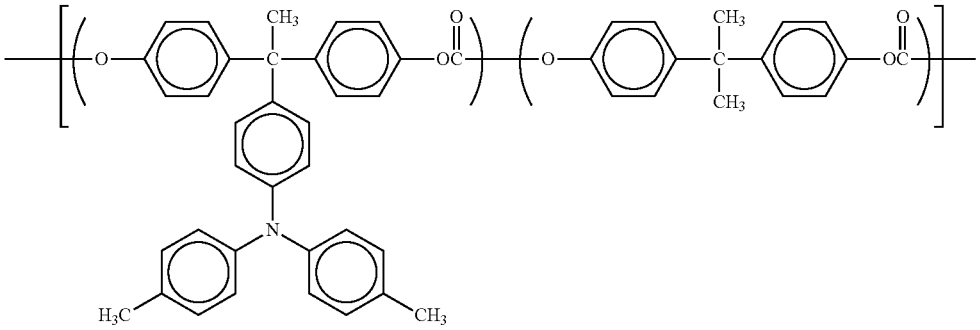
Specific compound chemical structure 6
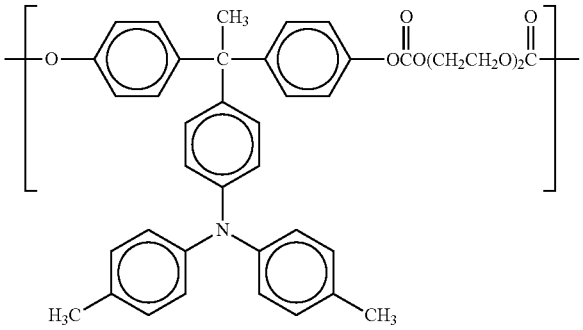
Specific compound chemical structure 7
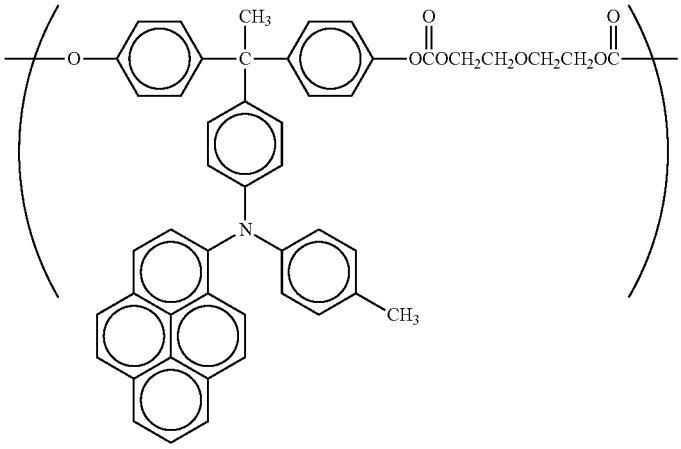
Specific compound chemical structure 8
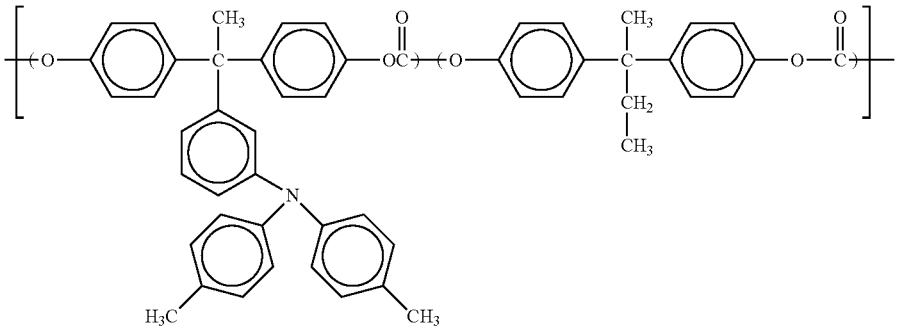

-continued
Specific compound chemical structure 9
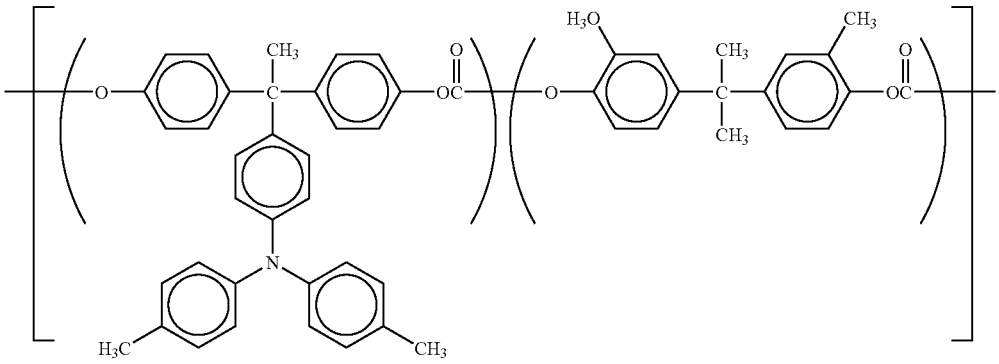
Specific compound chemical structure 10
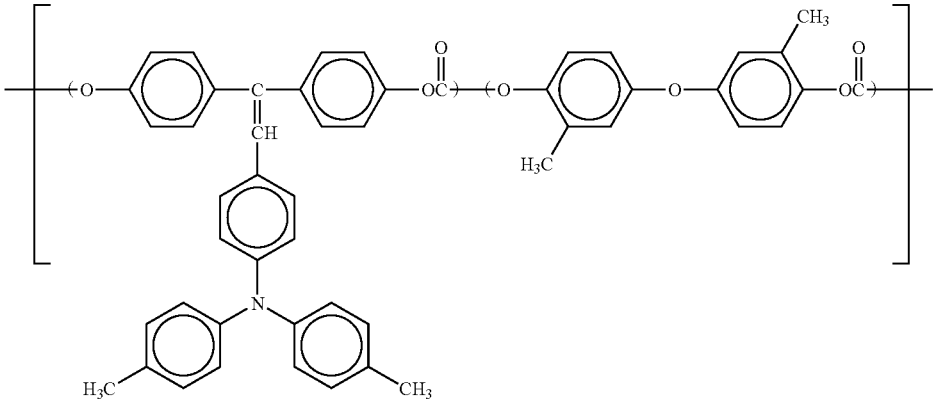
Specific compound chemical structure 11
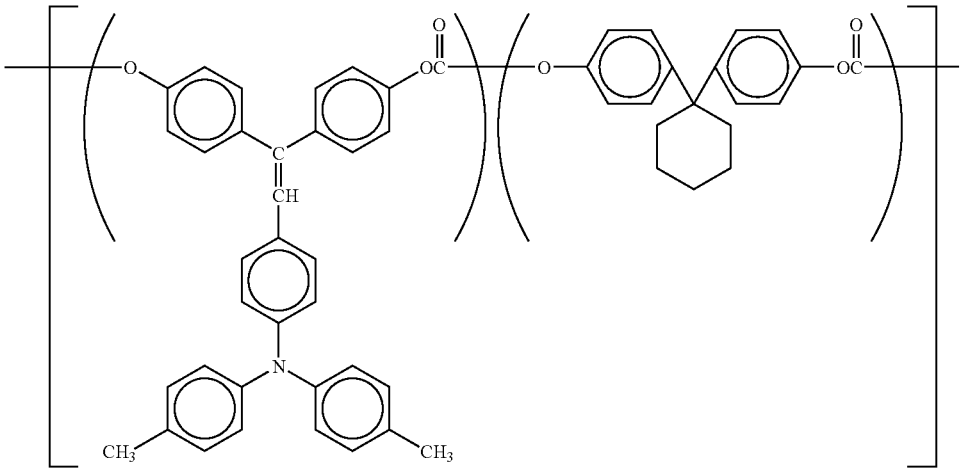

-continued
Specific compound chemical structure 12
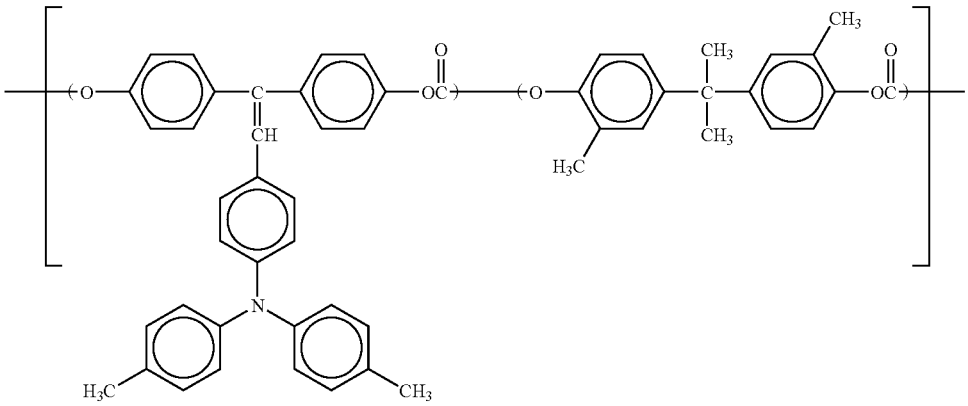
Specific compound chemical structure 13
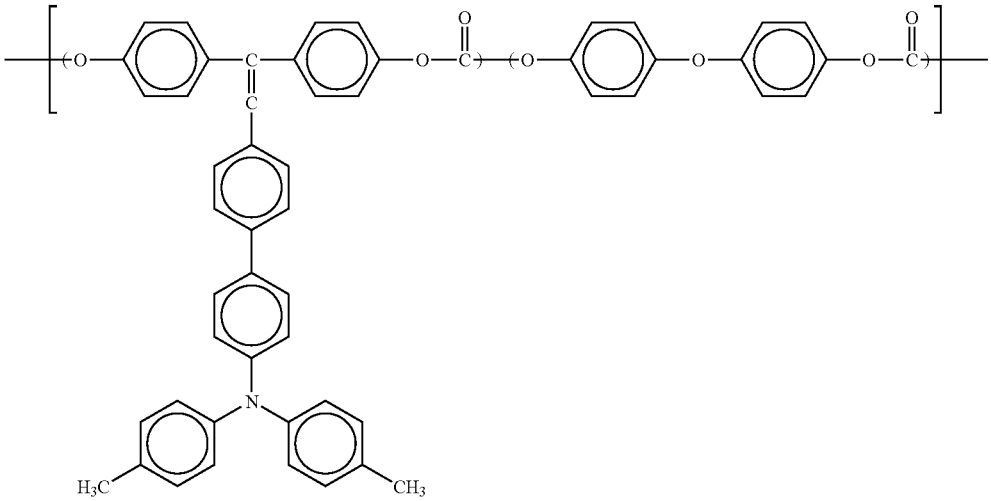
Specific compound chemical structure 14
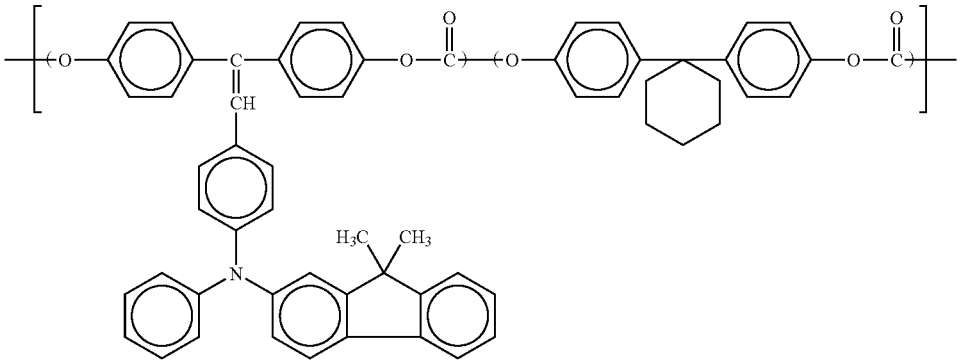

-continued
Specific compound chemical structure 15
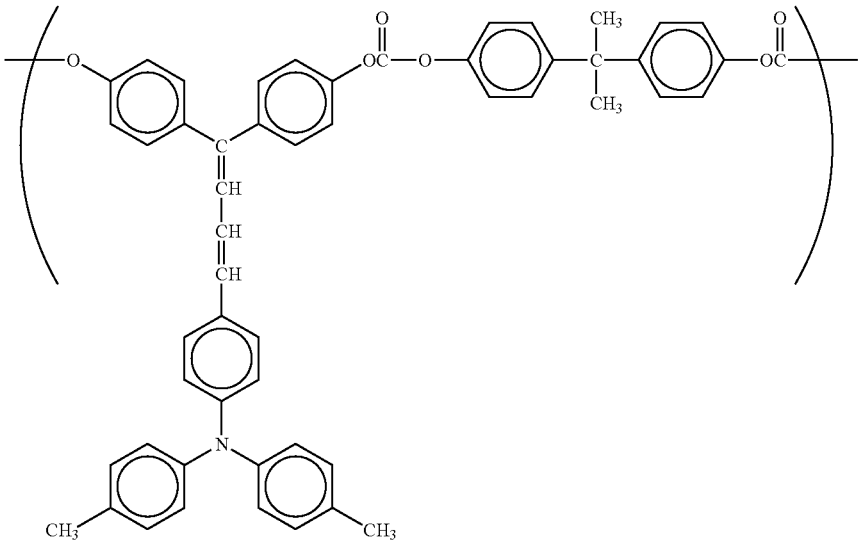
Specific compound chemical structure 16
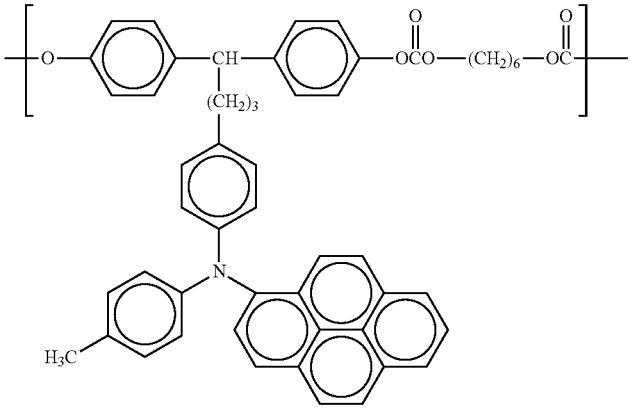
Specific compound chemical structure 17
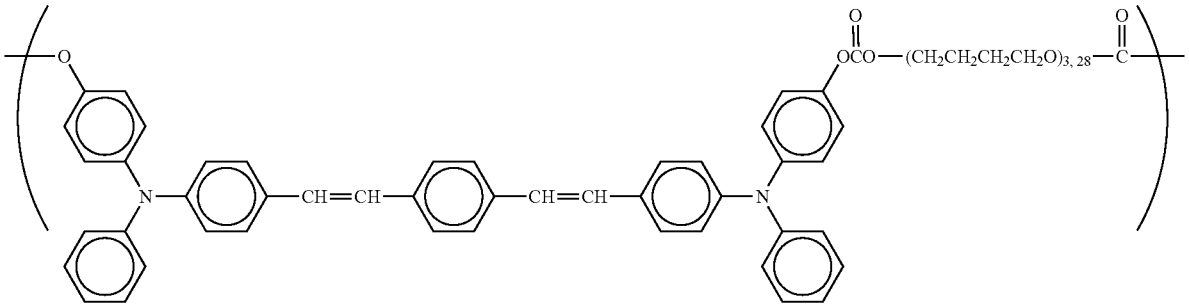
Specific compound chemical structure 18
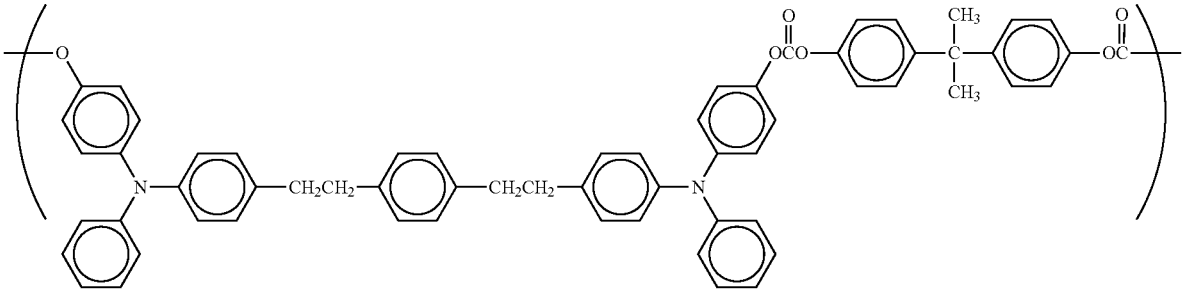

-continued
Specific compound chemical structure 19
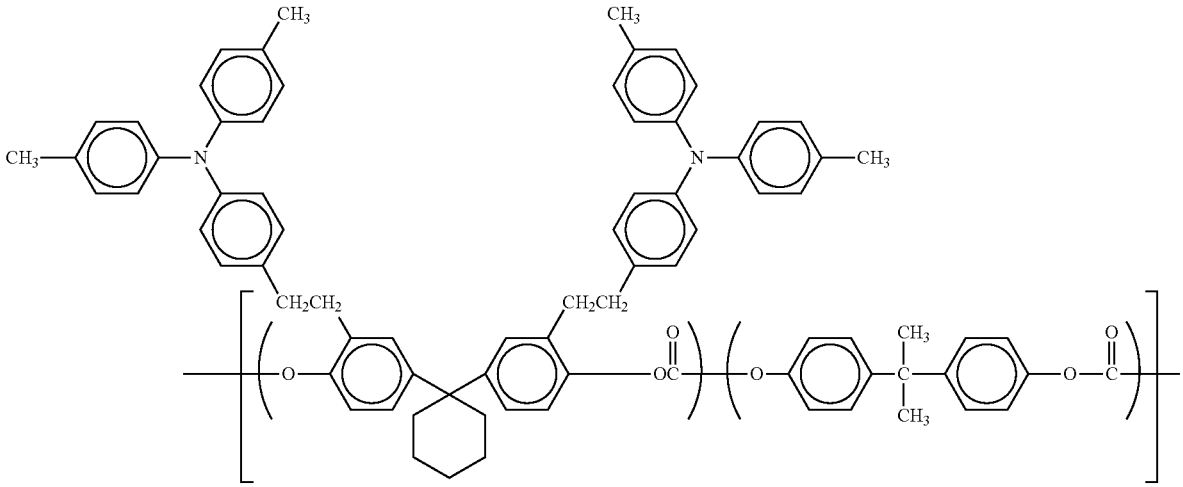
Specific compound chemical structure 20
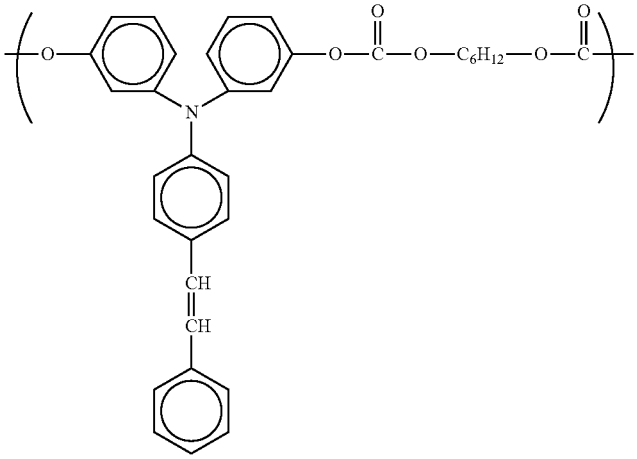
Specific compound chemical structure 21
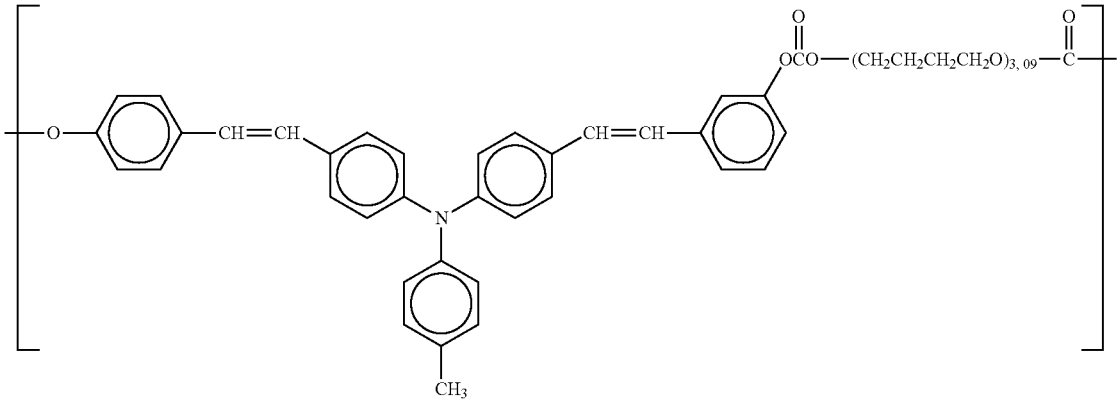

-continued
Specific compound chemical structure 22
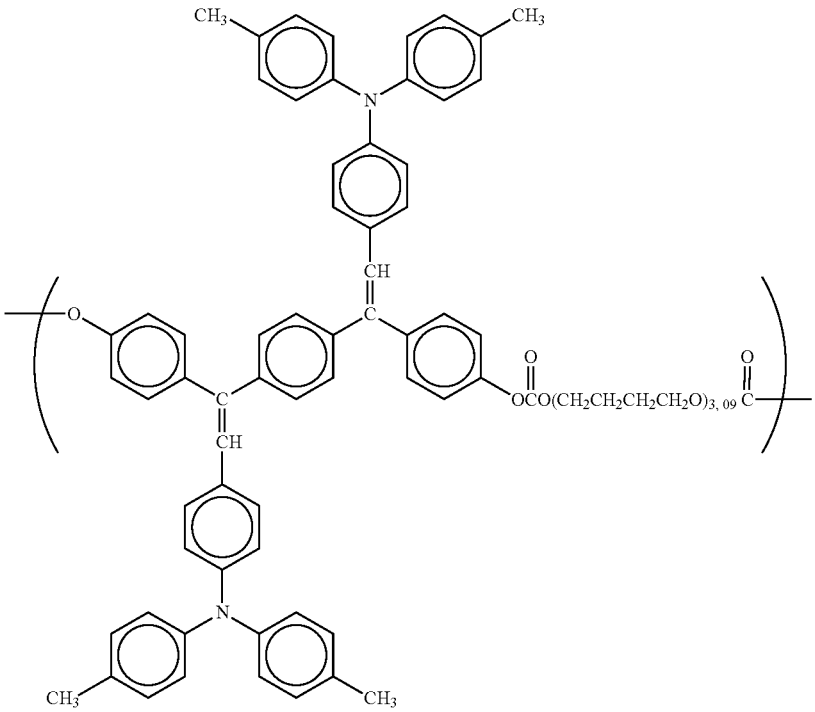
Specific compound chemical structure 23
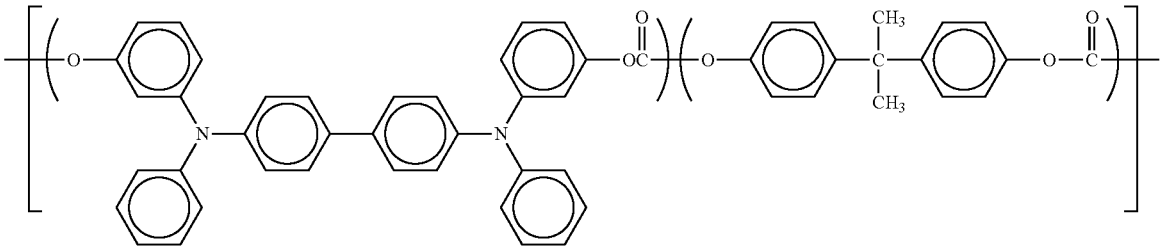
Specific compound chemical structure 24
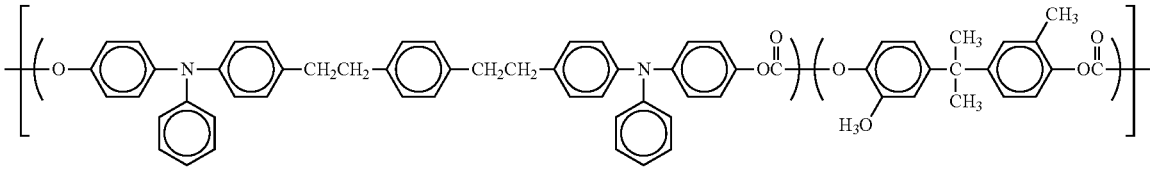
Specific compound chemical structure 25
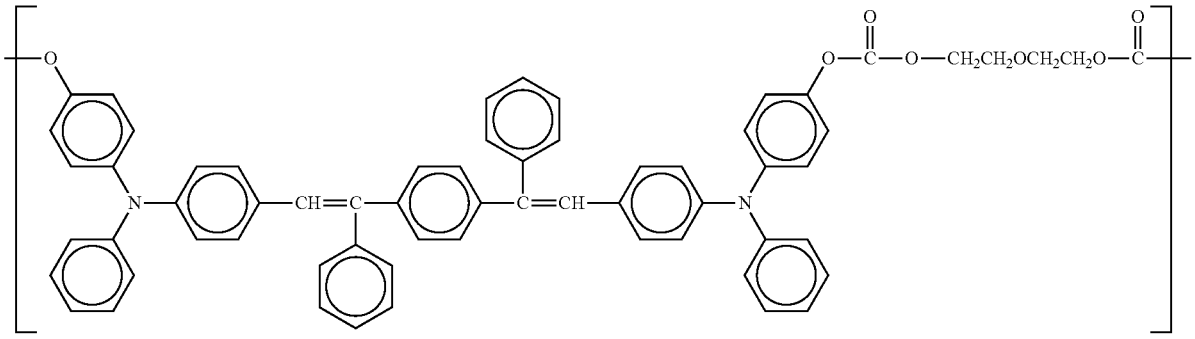

-continued
Specific compound chemical structure 26
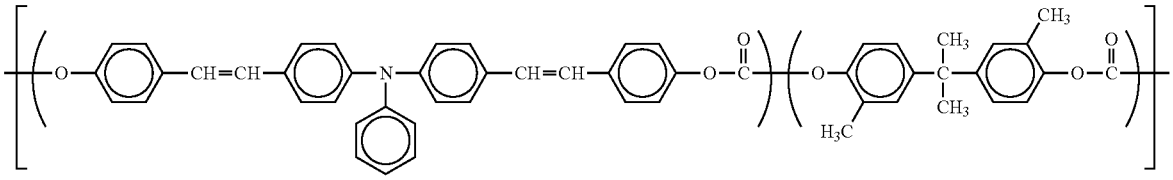
Specific compound chemical structure 27
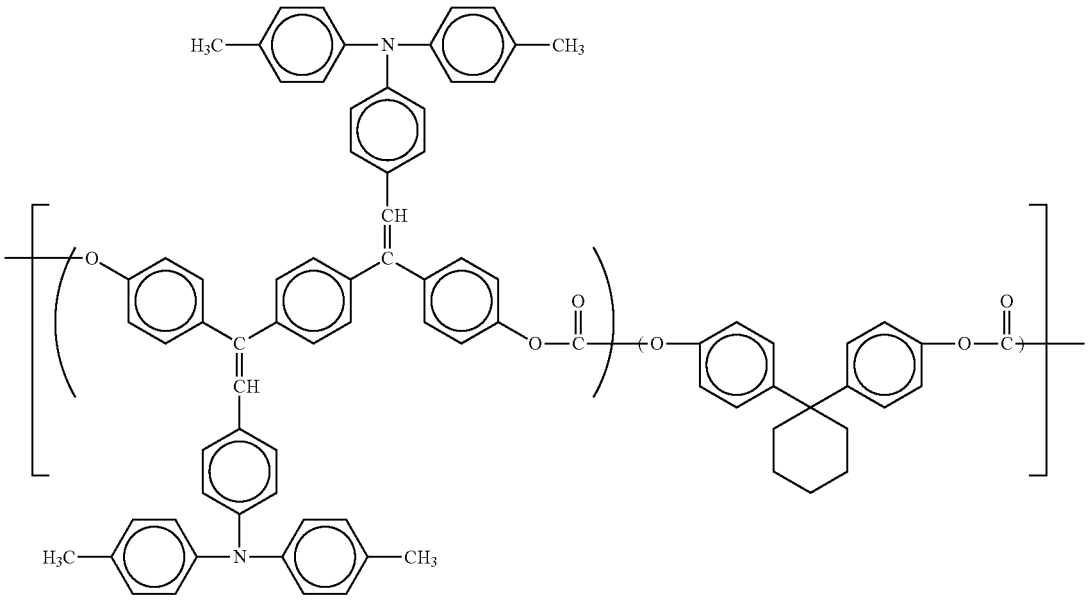
Specific compound chemical structure 28
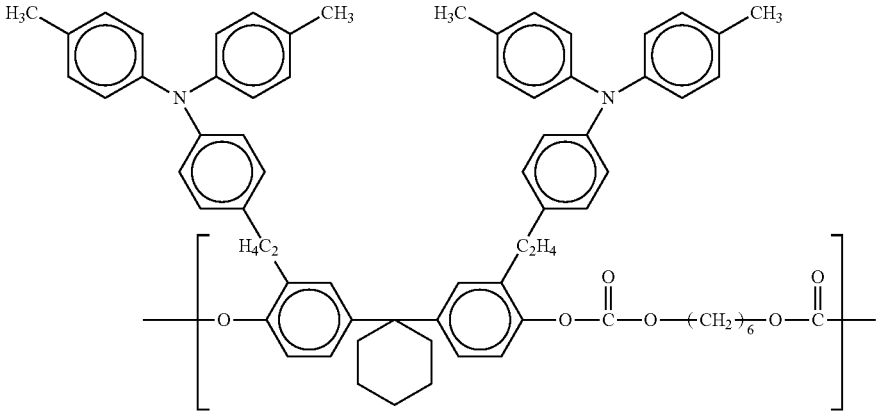

-continued
Specific compound chemical structure 29
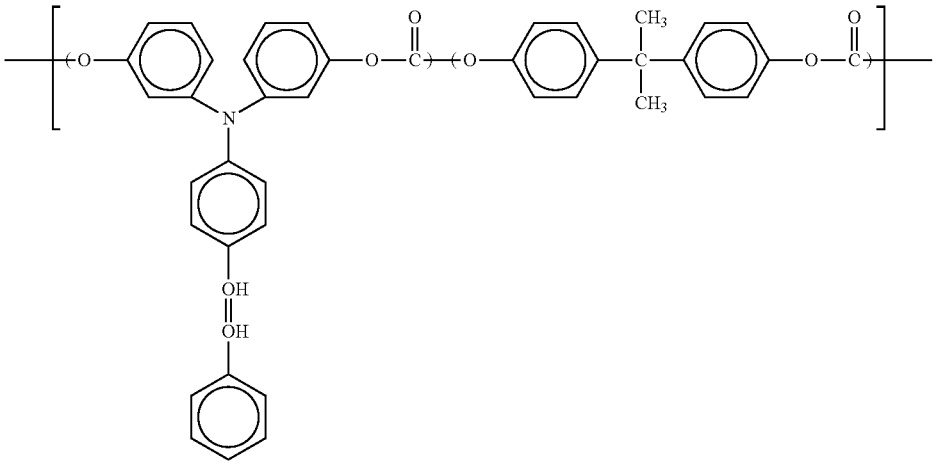
Specific compound chemical structure 30
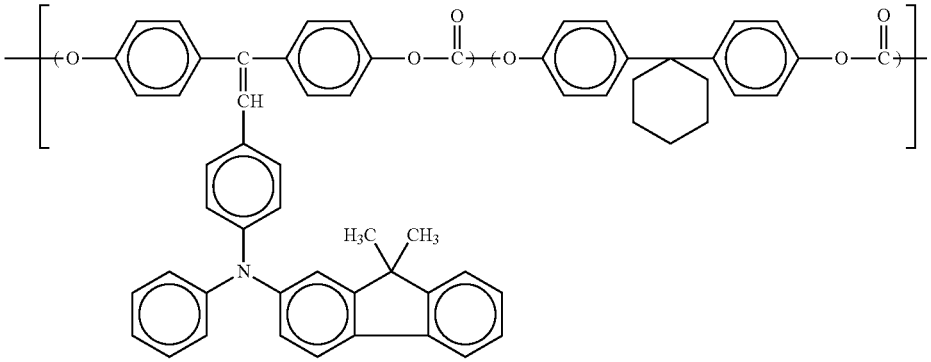
Specific compound chemical structure 31
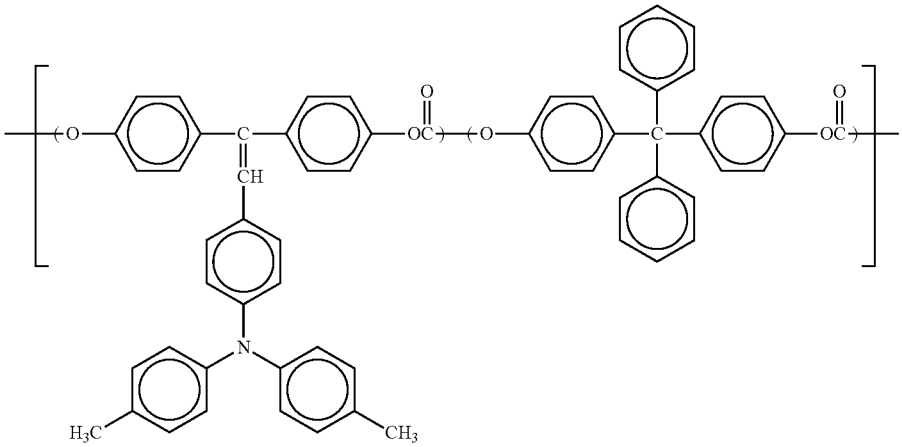

-continued

Specific compound chemical structure 32

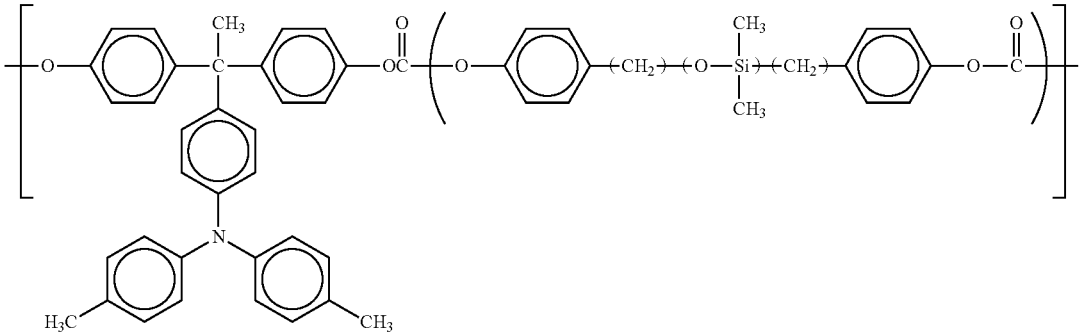

Specific compound chemical structure 33

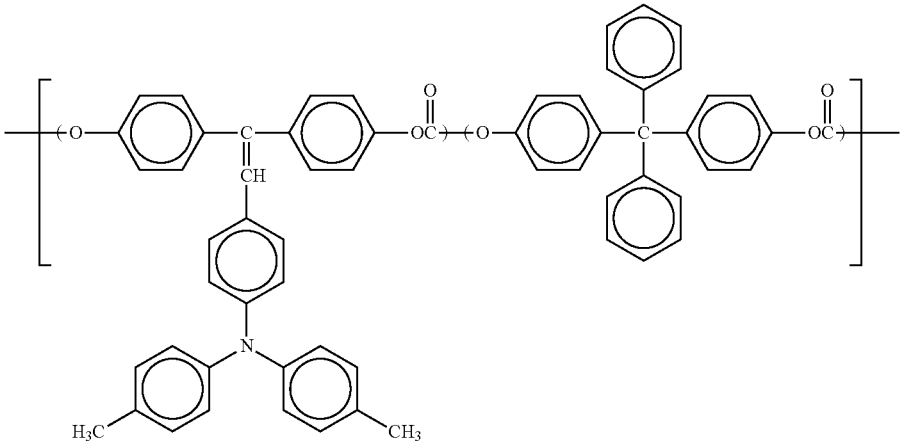

Specific compound chemical structure 34

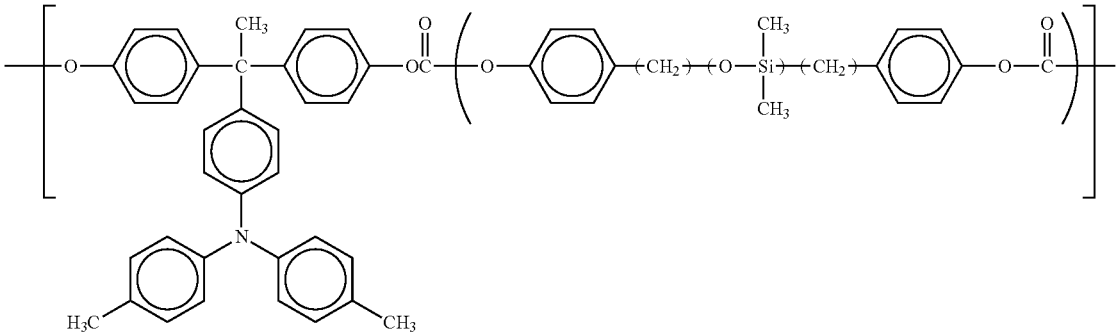

The charge transport polymer having a triarylamine structure in the main or branch chain is polymerized in a form of a monomer, a random copolymer, an alternate copolymer, or a block copolymer. In addition, since these charge transport polymers bear the function as the binder resin, a film forming power is required. Therefore, the polystyrene conversion molecular weight Mw of the charge transport polymer is suitably from 10,000 to 500,000 and preferably from 50,000 to 400,000 according to GPC measurement.

These charge transport polymers are described in JP H08-269183-A, JP H09-71642-A, JP H09-104746-A, JP H09-272735-A, JP H11-29634-A, JP H09-235367-A, JP H09-87376-A, JP H09-110976-A, JPH09-268226-A, JP H09-221544, JP H09-227669-A, JPH09-221544-A, JP H09-227669, JP H09-157678, JP H09-302084, JP H09-302085-A, and JP 2000-26590-A.

The content of the charge transport material is from 20 to 300 parts by weight and preferably from 40 to 150 parts by weight based on 100 parts by weight of the binder resin. In addition, the charge transport material and the binder resin are independently used alone or in combination.

Specific examples of the solvent for use in the liquid application for the charge transport layer include, but are not limited to, tetrahydrofuran, dioxane, dioxolan, toluene, cyclohexanone, cyclopentanone, methylethylketone, xylnene, acetone, diethylether, and methylethylketone. Although a halogen based solvent such as dichloromethane, dichloroethane, and monochlorobenzene is suitable in terms of the characteristics of an image bearing member, the use of it is not recommended in consideration of the burden on the global environment. Among these, ring ethers such as tetrahydrofuran and dioxane, or aromatic hydrocarbons such as toluene, and xylene are preferably used. These can be used alone or as a mixture of two or more.

In addition, an additive such as a plasticizer, a leveling agent, anti-oxidizer, and a lubricant can be optionally added to the liquid application of the charge transport layer. These can be used alone or in combination. Particularly, the charge transport material represented by the chemical structure (1), (2), or (3) has a high melting point, and the molecular structure thereof is a large structure in which pi-conjugated system is spread. Therefore, the material has a high crystal property and a low solubility. Thus, when the film made of the material tends to crack due to attachment of sebum or an internal stress. Cracking or peeling-off of a film (layer) can be prevented by addition of a plasticizer, which is advantageous in the present invention.

Specific examples of the plasticizers include, but are not limited to, dibutyl phthalate and dioctyl phthalate. The addition amount is preferably from 0 to 30% by weight and more preferably from 1 to 10% by weight based on the binder resin.

In the present invention, addition of a compound having an alkylamino group is extremely suitable. A compound having an alkyl amino group is effective in reducing image flow, or reduction in charge which occurs in an atmosphere in which ozone or nitrogen is dense and thus is particularly preferable when the compound having an alkylamino group is used.

Since these charge transport materials have a distyryl structure, they are not stable for an oxidized gas. A mixture of the charge transport material and the compound having an alkyl amino group reduces occurrence of an image flow, reduction in resolution, or reduction in charge in an oxidized gas atmosphere, thereby improving the image quality. In addition, these compounds have a charge transport structure in themselves and thus have little impact on the residual voltage. Therefore, a relatively large amount of the compound can be added.

In the present invention, among the compounds having an alkyl amino group, the compound having the following chemical structure is particularly preferable.

Chemical structure 4

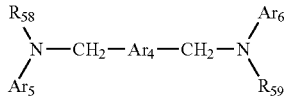

(4)

In the chemical structure (4), $Ar_4$ represents a substituted or non-substituted arylene group. $Ar_5$ and $Ar_6$ independently represent a substituted or non-substituted aryl group, a substituted or non-substituted alkyl group, or a substituted or non-substituted aralkyl group. $R_{58}$ and $R_{59}$ independently represent a substituted or non-substituted alkyl group or a substituted or non-substituted aralkyl group. $Ar_5$ and $R_{58}$ and $Ar_6$ and $R_{59}$ are bonded to each other to form a substituted or non-substituted heterocyclic ring group containing a nitrogen atom.

Chemical structure 5

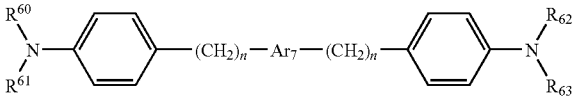

(5)

In the chemical structure (5), $Ar_7$ represents a substituted or non-substituted arylene group. $R_{60}$ to $R_{63}$ independently represent a substituted or non-substituted alkyl group, or a substituted or non-substituted aralkyl group. "n" represents 1 or 2.

Specific examples of the compounds include the material represented by the following chemical structures. These compounds are for the illustration purpose only and the present invention is not limited thereto.

Chemical structure 6

No. 101

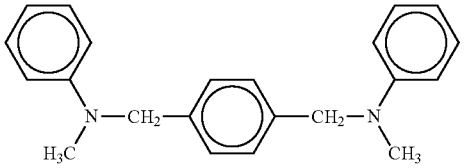

No. 102

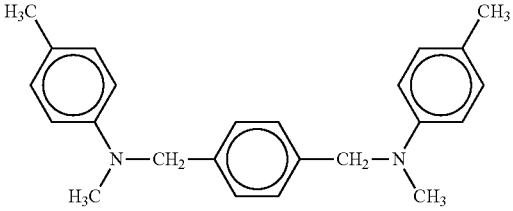

No. 103

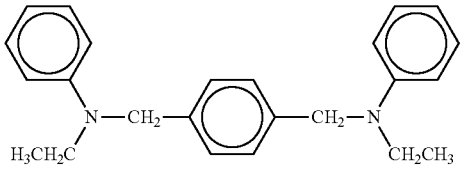

No. 104

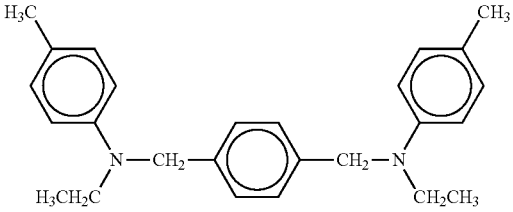

-continued
No. 105
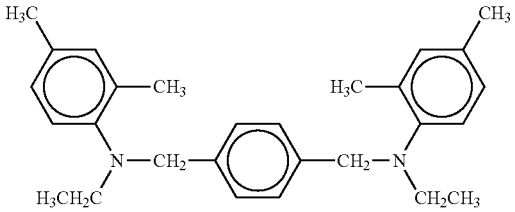
No. 106
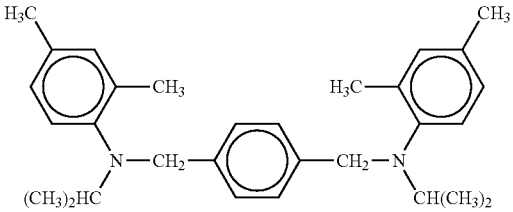
No. 107
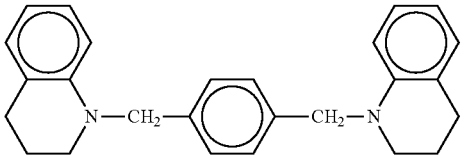
No. 108
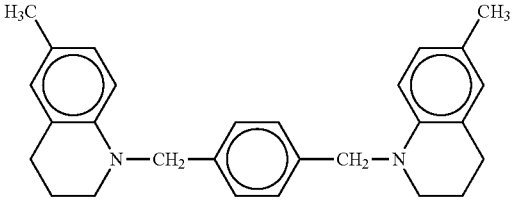
No. 109
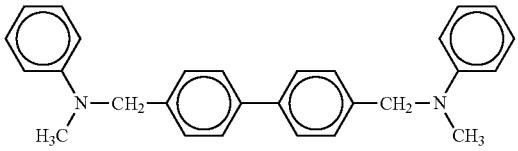
No. 110
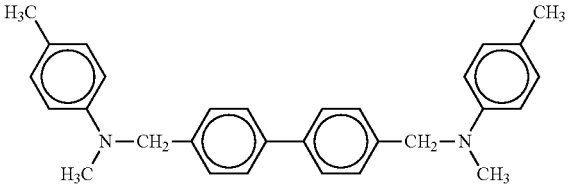
No. 111
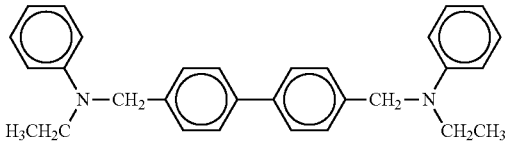
No. 112
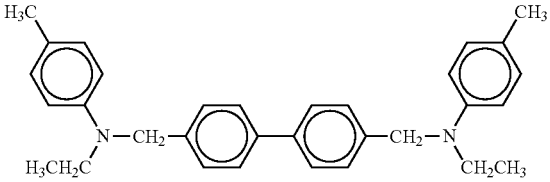
Chemical structure 47
No. 113
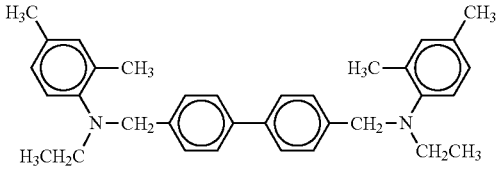
No. 114
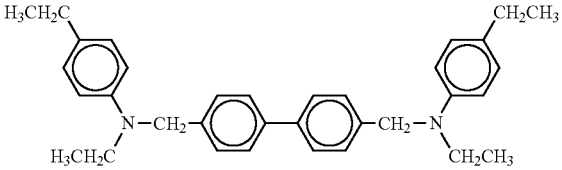
No. 115
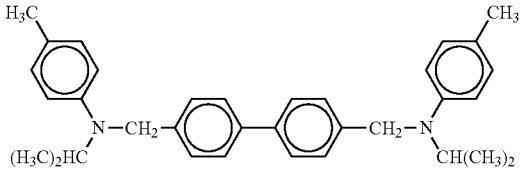
No. 116
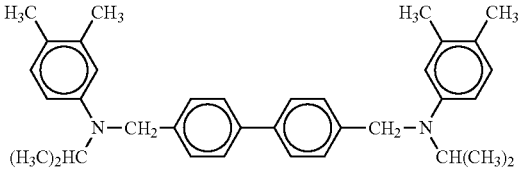
No. 117
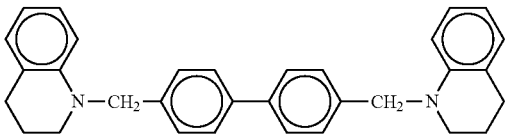
No. 118
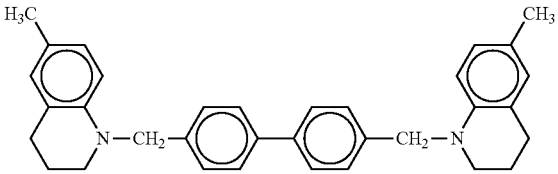

-continued
No. 119
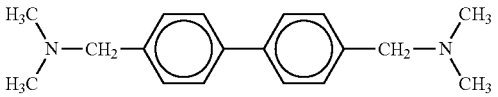
No. 120
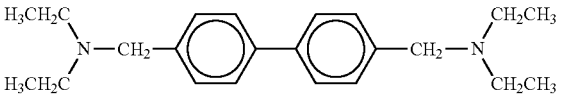
No. 121
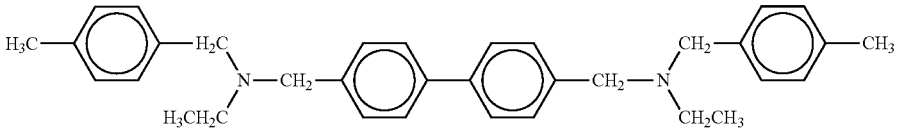
No. 122
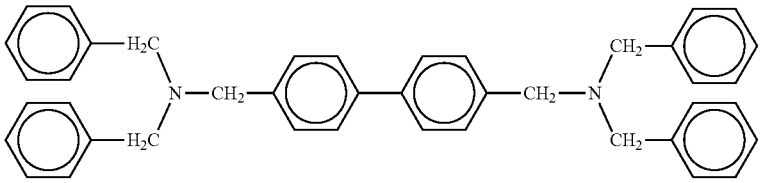
No. 123
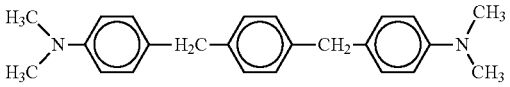
No. 124
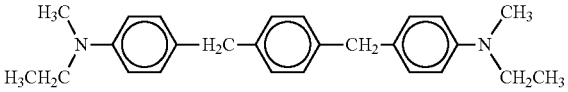
No. 125
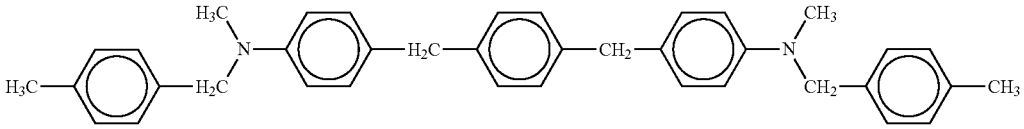
No. 126
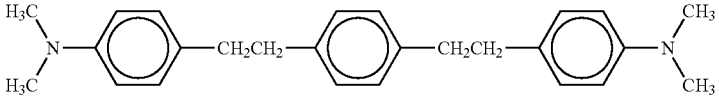
No. 127
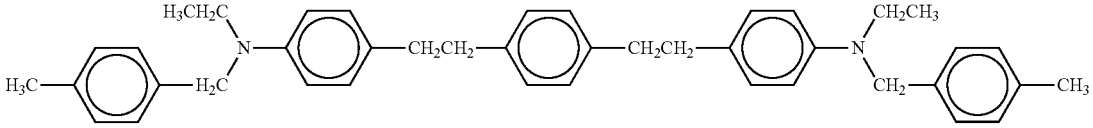
No. 128
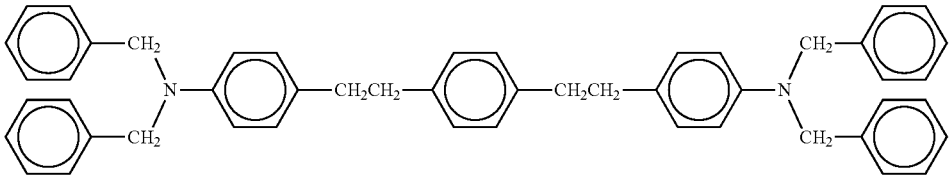
No. 129
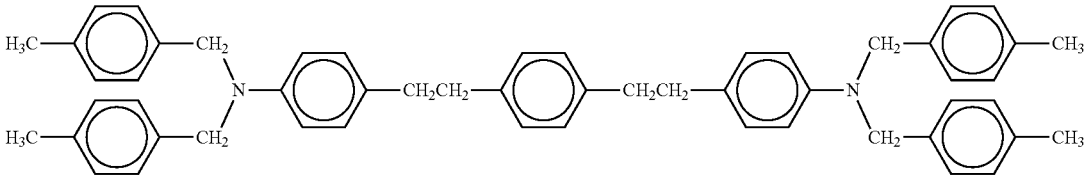
No. 130
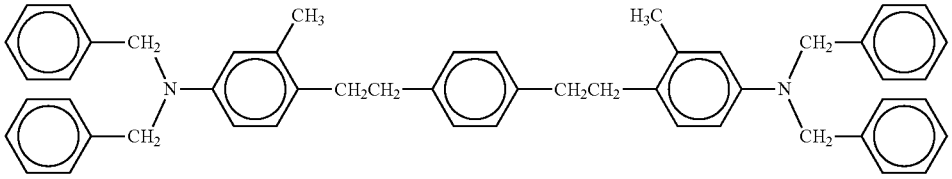

The addition amount of the compound having an alkylamino group represented by the chemical structures (4) and (5) illustrated above is preferably from 0 to 30% by weight and more preferably from 1 to 15% by weight based on the charge transport material. An excessive addition amount of the compound having an alkylamino group tends to cause a sharp rise in the residual voltage. By contrast, when the addition amount is too small, the resolution tends to decrease in a highly dense oxidization gas atmosphere or the layer easily cracks when sebum is attached to the layer.

In the present invention, an anti-oxidant is preferably used.

Specific examples of the anti-oxidants include, but are not limited to, known materials such as phenol based compounds, paraphenylene diamines, hydroquinones, organic sulfur compounds and hindered amines. These are suitable to stabilize the electrostatic characteristics over repetitive use. Among the anti-oxidants, the anti-oxidant represented by the following chemical structure is particularly suitable.

The addition amount of the anti-oxidant is preferably from 0 to 20% by weight and more preferably from 0.1 to 10% by weight based on the charge transport material. An excessive addition amount of such an anti-oxidant tends to cause a sharp rise in the residual voltage. By contrast, when the addition amount is too small, the resolution may decrease in a high dense oxidized gas atmosphere or charge reduction due to electrostatic fatigue may occur.

Specific examples of the leveling agent include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1% by weight and more preferably from 0.01 to 0.05% by weight based on the binder resin. Therefore, coating deficiency of the photosensitive layer or the charge transport layer can be prevented and thus a smooth film is formed.

(6)

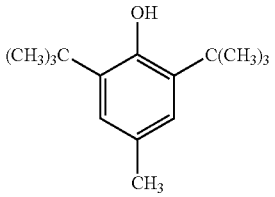

(7)

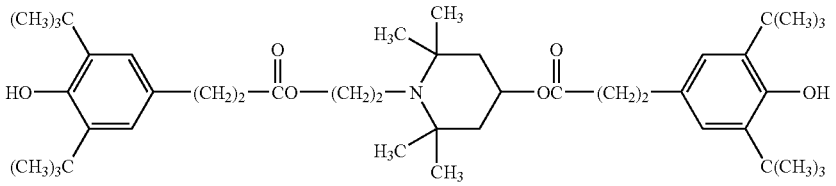

(8)

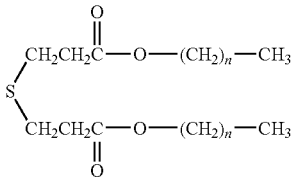

(9)

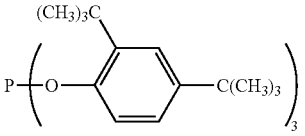

In the Chemical structure (8), "n" represents an integer of from 12 to 18.

As described above, the charge transport materials represented by the chemical structure 1, 2, or 3 tend to be unstable in an oxidized gas atmosphere. However, these can be suitably used in an oxidized gas atmosphere by adding the anti-oxidant since the charge reduction is prevented. In addition, occurrence of image flow is prevented, which is effective to improve the image quality.

In the present invention, a mixture of at least two kinds of such anti-oxidants is preferable to obtain a high effect. In addition, the mixture mixed with the compound represented by the chemical structure (4) or (5) is more effective. This is because these materials have different structure and demonstrate different effects. Each material has its own effect such as anti-oxidization effect for ozone or NOx gas produced by a charging device, prevention effects for decrease in charge caused by release of charges accumulated in the photosensitive layer due to electrostatic fatigue, image flow, reduction in resolution, or ghost.

Therefore, a mixture made of these materials demonstrates a great many effects so that quality images can be stably produced in any environment.

Known methods such as a dip coating method, a spray coating method, a bead coating method, a nozzle coating method, a spinner coating method, and a ring coating method can be used to apply the liquid application of the charge transport layer. Subsequent to application and drying by finger touching, the applied layer is heated and dried in an oven, etc. The drying temperature of the charge transport layer varies depending on the kind of the solvent contained in the liquid application of the charge transport layer and is preferably from 80 to 150° C. and more preferably from 100 to 140° C. The thus obtained charge transport layer has a thickness of from 10 to 50 μm and preferably from 20 to 35 μm. In the present invention, the protection layer is provided on the charge transport layer. Therefore, when a thin charge transport layer is provided, the durability of the image bearing member is not affected.

Photosensitive Layer of Single Layer

In the present invention, a single layered photosensitive layer can be used. The photosensitive layer is formed by dissolving or dispersing the charge generation material, the charge transport material, the binder resin described above, etc. in a suitable solvent and applying the liquid to the electroconductive substrate or the undercoating layer followed by drying. The materials described in the description of the charge generation layer and the charge transport layer can be used as the charge generation material and the charge transport material (electron transport material and positive hole transport material). In addition to the binder resin specified in the description for the charge transport layer, a mixture of the binder resin and the resin specified in the description for the charge generation layer can be used. The charge transport polymers specified above can be also suitably used as the binder resin. The content of the charge generation material is preferably from 5 to 40 parts by weight, and more preferably from 10 to 30 parts by weight and the content of the charge transport material is preferably from 0 to 190 parts by weight, and more preferably from 50 to 150 parts by weight based on 100 parts by weight of the binder resin.

The photosensitive layer is formed by dissolving the charge generation material, the cinder resin, the charge transport material in a solvent such as tetrahydrofuran, dioxane, dichloroethane, cyclohexanone, toluene, methylethylketone, or acetone, followed by application according to a dip coating method, a spray coating method, a bead coating method, or a ring coating method. In addition, various kinds of additives such as a plasticizing agent, a leveling agent, an anti-oxidant, and a lubricant can be added. The photosensitive layer suitably has a thickness of from about 5 to about 25 μm. In the present invention, a laminate photosensitive layer is preferable to a single layer photosensitive layer.

Protection Layer

The protection layer is described next.

The protection layer is formed on the photosensitive layer or the charge transport layer. That is, the protection layer forms the uppermost layer.

An example of the protection layer in the present invention is described.

The protection layer of the present invention contains at least a cured resin and a filler and the surface texture (form) of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

The filler contained in the protection layer of the present invention is described next.

In an image forming apparatus in which a lubricant material is being applied to the surface of the protection layer during production of images, since the protection layer contains a filler, the abrasion resistance and durability of the protection is improved. In addition, the lubricant material is stably applied to the surface of the protection layer no matter what large area an output image has, and no matter how long images are produced, thereby extremely improving the stability of the image quality.

The filler is typified into an organic filler and an inorganic filler.

Specific examples of the organic fillers include, but are not limited to, powders of fluorine-containing resins such as polytetrafluoroethylene, silicone resin powders, and a-carbon powders. Specific examples of the inorganic fillers include, but are not limited to, powders of metals such as copper, tin, aluminum and indium, metal oxides such as silica, tin oxide, zinc oxide, titanium oxide, alumina, zirconia, indium oxide, antimony oxide, bismuth oxide, calcium oxide, tin oxide doped with antimony, indium oxide doped with tin, fluorinated metals such as fluorinated tin, fluorinated calcium, and fluorinated aluminum, potassium titanate and arsenic nitride. Among these fillers, the organic filler generally degrades the applicability of the lubricant material. By contrast, the inorganic filler has a high filler hardness and a high light scattering property, which is advantageous in terms of improvement in abrasion resistance and durability or stability of image quality. Also, the inorganic filler is preferable in that the application amount of a lubricant material is stable. Therefore, the inorganic filler, metal oxides in particular, is suitably used. Furthermore, usage of metal oxides is advantageous in terms of the quality of an applied film. Since the quality of an applied film has a great impact on the image quality and abrasion resistance (durability), formation of an applied film of good quality is preferable to improve the durability of an image bearing member and the image quality.

These metal oxides have their own specific resistance depending on the material thereof. In the present invention, any metal oxides, from one having a low electroconductivity or specific resistance to one having a high insulation property or specific resistance, can be effectively used. Specific examples of the metal oxides having a low specific resistance includes, but are not limited to, tin oxide, indium oxide, antimony oxide, tin oxide doped with antimony, and indium oxide doped with tin. The charge tends to transfer horizontally, the resolution tends to decrease, or image flow tends to occur in these as the addition amount thereof increases. Therefore, in the present invention, when the curing resin contained in the protection layer is cured only by polymerizable compounds having no charge transport structure, these metal oxides having a low specific resistance can be effectively used as the filler. By contrast, specific examples of the metal oxides having a high specific resistance includes, but are not limited to, alumina, zirconia, titanium oxide, and silica. These have a tendency that a decrease in resolution or image flow hardly occurs but the residual voltage rises as the addition amount thereof increases.

Therefore, in the present invention, when the cured resin contained in the protection layer is formed by curing polymerizable compounds having no charge transport structure and polymerizable compounds having a charge transport structure, these metal oxides having a high specific resistance can be effectively used as the filler.

Among these metal oxides, since a alumina, which has a hexagonal close-packed structure, is excellent for abrasion resistance, highly light transmissive, and stable against heat, a alumina is particularly suitable in terms of prevention of occurrence of image blur (flow), improvement in abrasion resistance, quality of applied film, and light transmissiveness. Furthermore, the α alumina is also suitable to stably supply a lubricant material to the surface of a protection layer.

However, since fillers made of the same material do not have necessarily the same respective specific resistance, the criteria is not the material of the filler but the specific resistance thereof. In addition, these fillers can be used alone or in combination, thereby controlling the surface resistance. The specific resistance of the filler can be measured by, for example, using a resistance measuring instrument for powder. Specific processes are as follows: place metal oxide powder in a cell and pinch it with electrodes; adjust the amount of the metal oxide by load such that the metal oxide has a thickness of about 2 mm; apply a voltage between the electrodes; and measure the current to obtain the specific resistance of the metal oxide powder.

The effect of using the filler contained in a protection layer depends on the dispersion property of the filler. When the dispersion property and dispersion stability of the filler is good in the state of liquid dispersion, the effect is sustained in the film obtained by application of the liquid dispersion. When the dispersion property of the filler deteriorates, resulting in agglomeration thereof, the filler is easily detached from the film, thereby causing uneven wear of the surface of the image bearing member, or damaging the surface thereof, which leads to deterioration of damage durability or production of abnormal images with local deficiencies such as black mottles or streaks.

In addition, the lubricant may not be evenly supplied, meaning that a lubricant material is supplied at one part in a large quantity, and not supplied at the other.

In addition, this causes a problem such that the cleaning blade may chip off, leading to cleaning deficiency, and resulting in short working life of the liquid dispersion. Therefore, it is good to improve the dispersion property of the filler in the present invention.

In the present invention, addition of a dispersion agent, or dispersion helper is suitable to improve the dispersion property of a filler. Any known dispersion agent or dispersion helper can be used but a suitable agent or helper should be selected according to the filler used. In the present invention, among the metal oxides used as the filler, a polycarboxylic acid compound, a polycarboxylic acid based wet dispersion agent in particular, is preferably used. Since such a polycarboxylic acid compound has both a hydrophilic group and a hydrophobic group, the metal oxide having a hydrophilic surface has a good affinity with a hydrophobic organic binder resin or organic solvent and the wettability of the filler is high. Therefore, the polycarboxylic acid is good to improve the dispersion property and the dispersion stability.

The greatest characteristic of the polycarboxylic acid is that it has a polycarboxylic acid structure which contains multiple polycarboxylic acids. Among these polycarboxylic acid compounds, a polycarboxylic acid wet dispersion agent is effective. Among them, BYK-P104 and BYK-P105 (manufactured by BYK Chemie GmbH) are extremely suitable.

Furthermore, such a polycarboxylic acid wet dispersion agent has a high acid value since it has a carboxyl group. The dispersion agent having a high acid is absorbed to the surface of a filler, which is hydrophilic and a trap site of charges. Therefore, the dispersion agent is expected to fill the trap site that causes a rise in the residual voltage. Therefore, a synergy effect of great reduction on the residual voltage and improvement in the dispersion property of a filler is expected even when a hydrophilic filler, which has a great impact on the residual voltage, is contained. These technologies are described in Japanese patent No. 3802787 but it does not refer to in detail when a curing resin is used. The acid value is defined by a number of mg of potassium hydroxide required to neutralize carboxyl group contained in 1 g of a resin.

The solvent used during dispersion has a large factor for improvement in the dispersion property or the dispersion stability of a filler. Specific examples of the dispersion solvents for a filler include, but are not limited to, cyclohexanone, cyclopentanone, dioxane, tetrahydrofuran, methylethylketone, acetone, toluene, and xylene. Cyclohexanone and cyclopentanone are particularly suitable to improve the dispersion property and the dispersion stability.

Since these solvents tend to remain in the layer, the solvents are not suitable to use a great amount as a dispersion solvent.

In addition, a combination of these dispersion solvent and the polycarboxylic acid based wet dispersion agent significantly gives a dispersion stability effect in the present invention.

Furthermore, these fillers can be subject to a surface treatment using at least one kind of surface active agents, which is good for improvement in the dispersion property and the dispersion stability in some cases.

Any known materials can be used as the surface active agent.

The average primary particle diameter of the filler is preferably from 0.1 to 1.0 μm and more preferably from 0.2 to 0.5 μm. When the average primary particle diameter of a filler is too small, agglomeration of the filler and degradation of durability on abrasion tend to occur. In addition, stability on supplying a lubricant material to the surface of an image bearing member easily deteriorates, which degrades prevention effect on filming, attachment of a foreign object, or deterioration on a cleaning blade.

To the contrary, when the average primary particle diameter of a filler is too large, the sedimentation tendency is easily prompted, thereby significantly decreasing the life length of the liquid dispersion. In addition, although the supply stability of the lubricant material is improved, the lubricant material may not be supplied uniformly all over the surface of the protection layer, which locally causes image quality deterioration or abnormal image production.

The primary particle diameter of the filler in the present invention means the particle diameter of an average primary particle diameter representing the particle group, and is represented by the number average particle diameter.

Specifically, the filler or an image bearing member having the protection layer containing the filler is severed and the cross section is directly observed by an electron microscope, etc., to obtain the primary particle diameter of the filler followed by average calculation.

In addition, the addition amount of the filler is preferably from 0.1 to 50% by weight and more preferably from 5 to 20% by weight based on all the solid portion contained in the layer containing the filler. When the addition amount of the filler is too small, the supply amount of the lubricant material tends to decrease, or the supply stability easily deteriorates. Thus, suitable abrasion resistance and durability is not obtained, thereby degrading the image quality soon. An addition amount of the filler that is too large tends to raise the residual voltage, cause image blur, reduce the resolution, thereby having an adverse impact on the image quality. Furthermore, when the filler is contained excessively, the mutual interaction between the fillers tends to increase, significantly degrade the dispersion property. Therefore, the filler is easily detached, resulting in significant degradation on duration against abrasion.

Curable (cured) resins are used as the binder resin contained in the protection layer. The curable resins are obtained by one or more kinds of polymerizable compounds. When the production reaction of polymers are classified into chain reaction polymerization and successive polymerization, polymerization is the polymerization reaction form of the former and includes unsaturated polymerization, ring opening polymerization, isomerization polymerization, etc. in which the reaction form mainly proceeds via an intermediate such as an ion or radical. Polymerizable compound represents a compound having a functional group by which the reaction form described above can proceed. In addition, curing typically represents a reaction forming a three dimensional network structure formed by binding monomers or oligomers having the functional group mentioned above upon application of heat, light such as optical light or ultraviolet, or energy such as electron beam or radiation such as gamma ray through, for example, covalent binding.

The curable resin includes thermoplastic resins polymerized by heat, optical curable resins polymerized by light such as ultraviolet and optical light, electron beam curable resins polymerized by electron beam, etc. Optionally, curing agents, catalysts and polymerization initiators are added in combination.

Polymerizable compounds such as monomers or oligomers that include a functional group that causes polymerization reaction are used to obtain the curable resin specified above. Any functional groups that cause polymerization reaction can be used and generally unsaturated polymerizable functional groups and ring opening polymerizable functional groups are well known. Specific examples of the unsaturated polymerizable functional groups include, but are not limited to, carbon carbon double bond, carbon carbon triple bond, carbon oxygen double bond, carbon nitrogen double bond, and carbon nitrogen triple bond. The unsaturated groups therein conduct polymerization reaction via radicals and ions. The ring opening polymerizable functional groups conduct reaction in which polymerization reaction starts and repeats at the same time when the unstable ring structure formed of a carbon ring, an oxo ring, and nitrogen hetero ring that have distortion opens to produce chained polymers mostly via ions as active species. Specific examples thereof include, but are not limited to, groups having carbon carbon double bond such as acryloyl group, methacryloyl group, and vinyl group, functional groups causing ring opening polymerization such as silanol group and a cyclic ether group. Two or more kinds of molecules may be included in the polymerization reaction. In addition, in the curing reaction, as the number of functional groups contained in one molecule of a reactive monomer increases, the obtained three dimensional network structure is solid and firm. Therefore, three or more functional groups are preferably contained in one molecule. Therefore, the curing density is high, thereby improving the hardness, elasticity, uniformity, smoothness of the protection layer, which leads to improvement in durability of an image bearing member using the protection layer, and image quality The protection layer in the present invention can use any known curable resins and being cured is meaningful in terms of the effect regardless of the material and the devices used.

Specific examples of the curable resins include, but are not limited to, phenolic resins, epoxy resins, melamine resins, alkyd resins, urethane resins, amino resins, polyimide resins, siloxane resins, and acryl resins. Among these, phenolic resins, acryl/methacryl resins, and urethane resins are preferably used. Among these, acryl/methacryl resins are particularly preferable in consideration of the merits of the present invention. These curable resins form a three-dimensional network structure and are insoluble in an organic solvent. Therefore, in the present invention, the cured state of the curable resin represents that when, for example, an alcohol based organic solvent is attached to the cured resin, the layer is not dissolved therein.

Any resin can be used as the binder resin for use in the protection layer in the present invention as long as the resin is obtained by curing a polymerizable compound. Preferably, the resin is obtained by curing a polymerizable compound having a charge transport structure and a polymerizable compound having no charge transport structure. When only a polymerizable compound having no charge transport structure is used and cured, the protection layer resultantly has no charge transport function. In this case, although the electroconductive filler described above is dispersed, the image quality tends to be low. Therefore, the resin formed by curing a polymerizable compound having a charge transport structure and a polymerizable compound having no charge transport structure is preferable.

With regard to the polymerizable compound having a charge transport structure, any known materials can be used as long it has a charge transport structure and a functional group reactive with the cured resin described above. The charge transport structure represents a structure contained in a charge transport material, thereby demonstrating the charge transport property. The charge transport structure is typically classified into a structure that transports positive holes, and a structure that transport electrons. Both are included in the present invention. The number of the charge transport structure, i.e., the structure that transports positive holes, or the structure that transport electrons, in a compound is at least one. A charge transport structure having multiple charge transport structures is preferable in terms of the charge transport property. In addition, a charge transport structure demonstrating a bipolar property, meaning that a positive hole transport structure and an electron transport structure are contained in the molecule of a polymerizable compound having a charge transport structure simultaneously, can be also used.

Specific examples of the positive hole transport structures among the charge transport structures include, but are not limited to, structures demonstrating electron donating property such as poly-N-vinylcarbazole, poly-γ-carbazolyl ethylglutamate, condensation product of pyrene-form aldehyde, polyvinylpyrene, polyvinyl phenanthrene, polysilane, oxazole, oxadiazol, imidazole, monoarylamine, diarylamine, triaryl amine, stilbene, α-phenylstilbene, bendidine, diarylmethane, triarylmethane, 9-styryl anthracene, pyrazoline, divinyl benzene, hydrazone, indene, butadiene, bisstilbene, and enamine.

Specific examples of such electron transport structures include, but are not limited to, electron accepting structure material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, condensed heterocyclic quinine, diphenoquinone, benzoquinone, naphtharene tetracarboxylic acid diimide, and aromatic rings having a cyano group or a nitro group.

Next, acryl resins are described in detail as an example of the cured resin.

The polymerizable compound having no charge transport structure for use in the present invention represents a compound having a polymerizable functional group without a positive hole transport structure such as triaryl amine, hydrazone, pyrazoline, or carbazole, or an electron transport structure such as condensed polycyclic quinone, diphenoquinone or an electron absorbing aromatic ring having a cyano group or a nitro group. The polymerizable functional group is any polymerizable functional group which has a carbon-carbon double bond. For example, 1-substituted ethylene functional groups and 1,1-substituted ethylene functional groups are suitably used as the polymerizable functional group.

(1) 1-Substituted Ethylene Functional Group

A specific example of 1-substituted ethylene functional groups is the functional group represented by the following chemical structure 18.

$$CH_2{=}CH{-}X_1 \qquad \text{Chemical structure (18)}$$

In the chemical structure (18), $X_1$ represents an arylene group such as a substituted or non-substituted phenylene group, and a naphthylene group, a substituted or non-substituted alkenylene group, —CO—, —COO—, —CON($R_{228}$) (wherein, $R_{228}$ represents hydrogen, an alkyl group such as methyl group and ethyl group, an aralkyl group such as benzyl group, naphthyl methyl group, and phenethyl group, and an aryl group such as phenyl group and naphthyl group), or —S—. Specific examples of such functional groups include, but are nor limited to, vinyl group, styryl group, 2-methyl-1, 3-butadienyl group, vinyl carbonyl group, acrylcyloxy group, acryloyl amide group, and vinylthio ether group.

(2) 1,1-Substituted Ethylene Functional Group

A specific example of 1,1-substituted ethylene functional groups is the functional group represented by the following chemical structure 19.

$$CH_2{=}CY_4{-}X_2{-} \qquad \text{Chemical structure 19}$$

In the chemical structure, $Y_4$ represents a substituted or non-substituted alkyl group, a substituted or non-substituted aralkyl group, an aryl group such as a substituted or non-substituted phenyl group and naphtylene group, a halogen atom, cyano group, nitro group, an alokoxy group such as methoxy group and ethoxy group, —$COOR_{229}$ ($R_{229}$ represents hydrogen atom, an alkyl group such as a substituted or non-substituted methyl group and ethyl group, an aralkyl group such as a substituted or non-substituted benzyl group, naphthylmethyl group, and phenethyl group, an aryl group such as substituted or non-substituted phenyl group and naphtyl group or —$CONR_{230}R_{231}$ ($R_{230}$ and $R_{231}$ independently represent a hydrogen atom, an alkyl group such as a substituted or non-substituted methyl group and ethyl group, an aralkyl group such as a substituted or non-substituted benzyl group, naphthyl methyl group, and phenethyl group, or an aryl group such as substituted or non-substituted phenyl group and naphtyl group). $X_2$ represents a single bond, the same substitution group as $X_1$, or an alkylene group. At least one of $Y_4$ and $X_2$ is an oxycarbonyl group, cyano group, an alkenylene group and an aromatic ring.

Specific examples of these functional groups include, but are nor limited to, α-acryloyloxy chloride group, methacryloyloxy group, α-cyanoethylene group, α-cyanoacryloyloxy group, α-cyanophenylene group and methacryloyl amino group.

Specific examples of substitution groups further substituted to the substitution groups of $X_1$, $X_2$ and Y include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group. Among these polymerizable functional groups, acryloyloxy group and methacryloyloxy group are particularly preferable.

With regard to the number of the functional groups of the polymerizable compound (monomer or oligomer) having no charge transport structure, the greater, the better. Particularly, a polymerizable compound having 3 or more functional groups is preferable. When a polymerizable compound having 3 or more functional groups is cured, a three dimensional network structure is developed and thus a layer having a high hardness with an extremely high density and a high elasticity is obtained. In addition, a high abrasion resistance and damage resistance are obtained. However, since a great number of bonds are instantly formed in the curing reaction depending on the curing condition and materials, volume contraction or internal stress may occur, which leads to cracking or peeling-off of the layer. If this is the case, a polymerizable compound having one or two functional groups or mixture thereof is used to deal with such cracking or peeling-off.

In addition, it is preferable to use multiple polymerizable compounds having no charge transport structure with different number of functional groups for the polymerizable compound having no charge transport structure.

The image bearing member can have a good combination of mechanical durability, the image quality stability and the electrostatic stability by using a mixture of multiple polymerizable compounds having a charge transport structure with different number of functional groups. Since a polymerizable compound having a small number of functional groups increases the cross-linking density, the electrostatic characteristics of the image bearing member tends to decrease, particularly the residual voltage tends to rise, while the surface hardness increases and filming occurs less. On the other hand, a single use of a polymerizable compound having a greater number of functional groups contributes to reduce the residual voltage and improve the electrostatic characteristics but has an adverse impact on filming etc. In addition, gas transmission property becomes high and anti-gas property tends to deteriorate. The residual voltage is reduced and the voltage is stabilized over repetitive use when multiple polymerizable compounds having a different number of functional groups are mixed for use. Also abrasion resistance and durability is maintained and occurrence of filming is prevented. Consequently, the image quality is stabilized over repetitive use for an extended period of time.

Regardless of the number of functional groups contained in the polymerizable compounds, the effect can be obtained by mixing the polymerizable compounds. However, using only polymerizable compounds having a three or more functional groups is preferable.

Although determining a particularly preferable combination is difficult because the structure of the polymerizable compound should be considered, for example, a combination of a polymerizable compound having three functional groups and a combination of a polymerizable compound having six functional groups is preferable. The ratio of the polymerizable compounds is preferably from 3:7 to 7:3 and more preferably 5:5.

Next, the polymerizable compound having no charge transport structure with three or more functional groups suitable to improve the abrasion resistance is described.

A compound having at least three acryloyloxy groups is obtained by performing ester reaction or ester conversion reaction using, for example, a compound having at least three hydroxyl groups therein and an acrylic acid (salt), a halide acrylate and an ester of acrylate. A compound having at least three methacryloyloxy groups is obtained in the same manner. In addition, the number of the polymerizable functional groups in a monomer having at least three polymerizable functional groups can be the same or different from each other.

The polymerizable compounds having at least three functional groups without having a charge transport structure include the following compounds, but are not limited thereto.

Specific examples of the polymerizable compounds mentioned above for use in the present invention include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl) isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

In addition, the polymerizable compound having no functional group preferably has a ratio (molecular weight/the number of functional groups) of the molecular weight to the number of functional groups in the compound of 250 or less to form a dense cross linking bonds in the photosensitive layer. Furthermore, when the ratio (molecular weight/the number of functional groups) is too large, the surface of such a compound is soft and thus the abrasion resistance thereof tends to deteriorate. Therefore, among the compounds specified above, a sole used of a compound having an extremely long modified (e.g., HPA, EO, PO modified) group is not suitable.

In addition, the content ratio of the polymerizable compound having no charge transport structure is from 20 to less than 80% by weight and preferably from 30 to 70% by weight based on the total weight of the protection layer. When this content ratio is too small, the density of three-dimensional cross-linking bond in the protection layer tends to be low. Therefore, the abrasion resistance thereof is not drastically improved in comparison with a case in which a typical thermoplastic binder resin is used. A monomer content ratio that is too large means that the content of the reactive compounds having a charge transport compound decreases, which may significantly raise the residual voltage. Desired electric characteristics and abrasion resistance vary depending on the process used. Therefore, it is difficult to jump to any conclusion but considering the balance of the combination, the range of from 30 to 70% by weight is most preferred.

Next, the polymerizable compound having a charge transport structure is described.

The polymerizable compound having a charge transport structure for use in the present invention represents a compound having a positive hole transport structure such as triaryl amine, hydrazone, pyrazoline, or carbazole, and/or an electron transport structure such as condensed polycyclic quinone, diphenoquinone or an electron absorbing aromatic ring having a cyano group or a nitro group while having a polymerizable functional group.

The polymerizable functional group specified above for the polymerizable compound mentioned above can be suitably used. Among these, acryloyloxy group and methacryloyloxy group are particularly suitable. The polymerizable compound having a charge transport structure for use in the protection layer for use in the present invention can be used irrespective of the number of functional groups. However, a polymerizable compound that has one functional group is preferable in terms of the stability of the electrostatic characteristics and the layer quality. A polymerizable compound having a charge transport structure having two or more functional groups is advantageous in terms of the cross linking density because multiple bonds are used to fix the compound in the cross linking structure. However, the charge transport structure is extremely bulky, which increases distortion in the layer structure and thus internal stress in the layer. In addition, the intermediate structure (cation radical) during charge transport is not stabilized. This leads to deterioration of the sensitivity due to the charge trap and a rise of the residual voltage.

Any material that can impart the charge transport function can be used to form the charge transport structure of the polymerizable compound having a charge transport structure. Among these, triaryl amine structure is preferable.

For example, a compound having the structure represented by the following chemical structure 12 or 13 is suitably used because it improves the electrostatic characteristics such as sensitivity and residual voltage.

Chemical structures 12 and 13

(12)

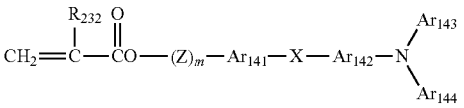

(13)

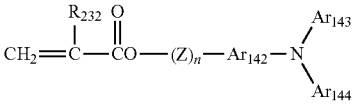

In the Chemical structures 12 and 13, $R_{232}$ represents hydrogen atom, a halogen atom, a substituted or non-substituted alkyl group, a substituted or non-substituted aralkyl group, a substituted or non-substituted aryl group, a cyano group, a nitro group, an alkoxy group, —$COOR_{241}$, wherein $R_{241}$ represents hydrogen atom, a substituted or non-substituted alkyl group, a substituted or non-substituted aralkyl group or a substituted or non-substituted aryl group, a halogenated carbonyl group or $CONR_{242}R_{243}$ wherein $R_{242}$ and $R_{243}$ independently represent hydrogen atom, a halogen atom, a substituted or non-substituted alkyl group, a substituted or non-substituted aralkyl group or a substituted or non-substituted aryl group, $Ar_{141}$ and $Ar_{142}$ independently represent a substituted or non-substituted arylene group. $Ar_{143}$ and $Ar_{144}$ independently represent a substituted or non-substituted aryl group. X represents a single bond, a substituted or non-substituted alkylene group, a substituted or non-substituted cycloalkylene group, a substituted or non-substituted alkylene ether group, oxygen atom, sulfur atom, or vinylene group. Z represents a substituted or non-substituted alkylene group, a substituted or non-substituted divalent alkylene ether group or a divalent alkyleneoxy carbonyl group. m and n represent an integer of from 0 to 3.

Specific examples of the substitution groups in the chemical structures 12 and 13 include, but are not limited to, the following.

In the Chemical structures 12 and 13, among the substitution groups of $R_{232}$, specific examples of the alkyl groups of $R_{232}$ include, but are not limited to, methyl group, ethyl group, propyl group, and butyl group. Specific examples of the aryl groups of $R_{232}$ include, but are not limited to, phenyl group and naphtyl group. Specific examples of the aralkyl groups of $R_{232}$ include, but are nor limited to, benzyl group, phenethyl group, naphtyl methyl group. The alkoxy groups of $R_{232}$ include, but are nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenethyl group. Among these substitution groups for $R_{232}$, hydrogen atom and methyl group are particularly preferable.

$Ar_{143}$ and $Ar_{144}$ represent a substituted or non-substituted aryl group. Specific examples thereof include, but are not limited to, condensed polycyclic hydrocarbon groups, non-condensed ring hydrocarbon groups and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The aryl groups represented by $Ar_{143}$ and $Ar_{144}$ can have a substitution group. Specific examples thereof are as follows:

(1) Halogen atom, cyano group, and nitro group;

(2) Alkyl group, preferably a straight chained or side chained alkyl group having 1 to 12, more preferably 1 to 8 and furthermore preferably from 1 to 4 carbon atoms. These alkyl groups can have a fluorine atom, a hydroxyl group, cyano group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) Alkoxy group (—$OR_{233}$), and $R_{233}$ represents the alkyl group defined in (2).

Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) Aryloxy group, and specific examples of the aryl group of the aryloxy group include, but are not limited to, phenyl group, and naphtyl group. These can contain an alkoxy group having 1 to 4 carbon atoms, an alkyl group having a 1 to 4 carbon atoms, or a halogen atom as a substitution group. Specific examples include, but are not limited to, phenoxy group, 1-naphthyloxy group, 2-naphthyloxy group, 4-methoxyphenoxy group, and 4-methylphenoxy group;

(5) An alkyl mercapto group or an aryl mercapto group; Specific examples thereof include, but are not limited to, methylthio group, ethylthio group, phenylthio group, and p-methylphenylthio group;

(6) Group represented by the following chemical structure:

Chemical structure 14

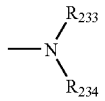

(14)

In Chemical structure 14, $R_{233}$ and $R_{234}$ independently represent a hydrogen atom, the alkyl group defined in (2), or an aryl group.

Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group. $R_{233}$ and $R_{234}$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) An alkylene dioxy group or an alkylene dithio such as methylene dioxy group and methylene dithio group; and (8) A substituted or non-substituted styryl group, a substituted or non-substituted β-phenyl styryl group, diphenyl aminophenyl group, ditolyl aminophenyl group, etc.

The arylene groups represented by $Ar_{141}$ and $Ar_{142}$ are divalent groups derived from the aryl group represented by $Ar_{143}$ and $Ar_{144}$ mentioned above.

X represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkyl group having 1 to 12, more preferably 1 to 8 and furthermore preferably from 1 to 4 carbon atoms is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are note limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylphenyl ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms.

Specific examples thereof include, but are not limited to, cyclohexylidene group, cyclohexylene group, and 3,3-dimethyl cyclohexylidene group.

Specific examples of the substituted or non-substituted alkylene ether group include, but are not limited to, ethyleneoxy, propyleneoxy, ethylene glycol, propylene glycol, diethylene glycol, tetraethylene glycol, and tripropylene glycol, and the alkylene group of the alkylene ethere group may have a substitution group such as hydroxyl group, methyl group and ethyl group.

Vinylene group is represented by the chemical structure 15.

Chemical structure 15

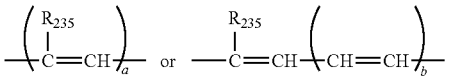

In the chemical structure 15, $R_{235}$ represents hydrogen or an alkyl group (the same as the alkylene groups defined in (2)) and an aryl group (the same as the aryl group represented by $Ar_{143}$, and $Ar_{144}$) and "a" represents 1 or 2 and "b" denotes an integer of from 1 to 3.

Z represents a substituted or non-substituted alkylene group, a substituted or non-substituted divalent alkylene ether group or a divalent alkyleneoxy carbonyl group in the chemical structures 12 and 13.

Specific examples of the alkylene group are the same as the alkylene group specified for X.

Specific examples of the substituted or non-substituted divalent alkylene ether group are the same as the divalent group of the alkylene ether group specified for X.

A specific example of the divalent alkyleneoxy carbonyl group is a divalent caprolactone modified group.

In addition, a preferred polymerizable compound having the charge transport structure for use in the present invention is the compound represented by the following chemical structure 16.

Among the compounds represented by the chemical structure 16 illustrated above, the compounds having methyl group or ethyl group as a substitution group of Rb and Rc are particularly preferred.

The polymerizable compound having a functional group with a charge transport structure for use in the present invention represented by the chemical structures 12, 13, or 16 in particular, is polymerized in a manner that both sides of the carbon-carbon double bond are open. Therefore, the polymerizable compound does not constitute an end of the structure but is set in a chained polymer. The polymerizable compound having a functional group is present in a main chain of a polymer in which cross-linking is formed by polymerization with a polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine Chemical structure 16

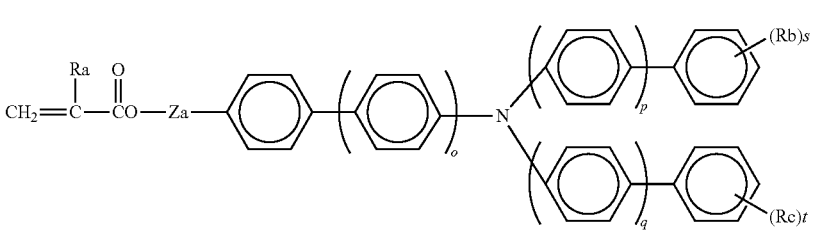

(16)

In Chemical structure 16, "o", "p", "q" represent 0 or 1, Ra represents hydrogen atom or methyl group, Rb and Rc are not hydrogen atom and independently represent an alkyl group having 1 to 6 carbon atoms. "s" and "t" represent an integer of from 0 to 3.

Za represents a single bond, methylene group, ethylene group, or a group represented by the following chemical structure:

Chemical structure 17

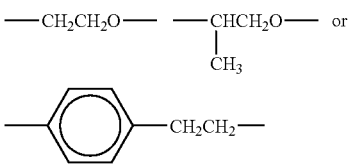

(17)

structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

In the present invention, the particular acrylate compound represented by chemical structure 20 can be suitably used as a radical polymerizable compound having a charge transport structure.

$B_1$—$Ar_5$—CH=CH=$Ar_6$—$B_2$ Chemical structure 20

$Ar_5$ is a monovalent or divalent aromatic hydrocarbon skeleton with or without a substitution group.

Specific examples of the aromatic hydrocarbon skeletons include, but are not limited to, benzene, naphthalene, phenathrene, and biphenyl. Specific examples of the substitution groups include, but are not limited to, an alkyl group having 1 to 12 carbon atoms, an alkoxy group having 1 to 12 carbon atoms, benzyl group, and a halogen atom. In addition, the alkyl group and the alkoxy group may have a halogen atom, or a phenyl group as a substitution group.

$Ar_8$ represents a monovalent or divalent aromatic hydrocarbon skeleton having at least one tertiary amino group, or a monovalent or divalent heterocyclic compound skeleton having at least one tertiary amino group. The aromatic hydrocarbon skeleton having a tertiary amino group is represented by the following chemical structure 21.

Chemical structure 21

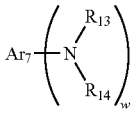

$R_{13}$ and $R_{14}$ independently represent an acyl group, a substituted or non-substituted alkyl group, or a substituted or non-substituted aryl group. $AR_7$ represents aryl group. "w" represents an integer of from 1 to 3.

Specific examples of the acyl groups of $R_{13}$ and $R_{14}$ include, but are not limited to, acetyl group, propionyl group, or benxoyl group.

Specific examples of the substituted or non-substituted alkyl group of $R_{13}$ and $R_{14}$ include, but are not limited to, the alkyl group specified for $Ar_5$.

Specific examples of the substituted or non-substituted aryl group of $R_{13}$ and $R_{14}$ include, but are not limited to, phenyl group, naphtyl group, biphenyl group, terphenyl group, pyrenyl group, fuluorenyl group, azuleryl group, anthril group, triphenylenyl group, crycenyl group and a group represented by the following chemical structure 22.

Chemical structure 22

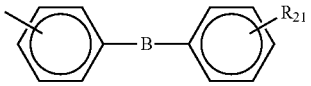

In the chemical structure 22, B is selected from, —O—, —S—, —SO—, —$SO_2$—, —CO—, and the following divalent groups.

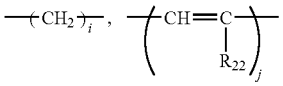

$R_{21}$ represents hydrogen atom, a substituted or non-substituted alkyl group defined for $Ar_5$, an alkoxy group, a halogen atom, a substituted or non-substituted aryl group defined for $R_{13}$, amino group, nitro group, or cyano group, $R_{22}$ represents hydrogen atom, a substituted or non-substituted alkyl group defined for $Ar_5$, or a substituted or non-substituted aryl group defined for $R_{13}$. "i" represents an integer of from 1 to 12 and "j" represents an integer of from 1 to 3.

Specific examples of the alkoxy groups of $R_{21}$ include, but are not limited to, methoxy group, ethoxy group, n-propoxy group, i-propoxy group, n-butoxy group, i-butoxy group, s-butoxy group, t-butoxy group, 2-hydroxy ethoxy group, benzyl oxy group, 4-methylbenzyloxy group, and trifluoromethoxy group.

The halogen atoms of $R_{21}$ are fluorine atom, chlorine atom, bromine atom and iodine atom.

Specific examples of the alkoxy groups of $R_{21}$ include, but are not limited to, diphenylamino group, ditolyl amino group, dibenzyl amino group, and 4-methyl benzyl group.

Specific examples of the aryl group of $AR_7$ include, but are not limited to, phenyl group, naphtyl group, biphenyl group, terphenyl group, pyrenyl group, fuluorenyl group, azulenyl group, anthril group, triphenylenyl group, and crycenyl group.

$AR_7$, $R_{13}$ and $R_{14}$ may include the alkyl group, the alkoxy group, and/or the halogen atom defined for $Ar_5$ as a substitution group.

Specific examples of the heterocyclic compound skeleton having a tertiary amino group include, but are not limited to, heterocyclic compound having an amino structure such as pyrrole, pyrazole, imidazole, triazonle, dioxazole, indol, isoindol, benz imidazole, benz imidazole, benz triazole, benz isoxazine, carbazole, and phenoxazine. These can contain the alkyl group, the alkoxy and the halogen atom defined for $Ar_5$ as a substitution group.

$B_1$ and $B_2$ represent acryloyloxy group, methacryloyloxy group, vinyl group; an alkyl group having an acryloyloxy group, methacryloyloxy group, or vinyl group; or an alkoxy group having an acryloyloxy group, methacryloyloxy group, or vinyl group. The same specified for $Ar_5$ are applied to the alkyl group and the alkoxy group. $B_1$ and $B_2$ are not present at the same time.

In addition to the acrylate compounds represented by the chemical structure 20, the compounds represented by the following chemical structure 23 can be suitably used.

Chemical structure 23

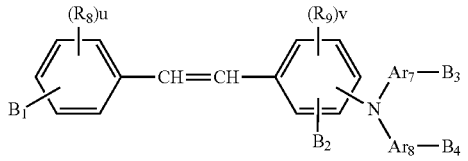

In Chemical structure 23, $R_8$ and $R_9$ represent a substituted or non-substituted alkoxy group, or a halogen atom. $Ar_7$ and $Ar_8$ represent a substituted or non-substituted aryl group, an arylene group, or a substituted or non-substituted benzyl group.

The same specified for $Ar_5$ are applied to the alkyl group, the alkoxy group, and the halogen atom.

The aryl group is the same as defined for $R_{13}$ and $R_{14}$ in the Chemical structure 21. The arylene group is a divalent group deriving from its aryl group.

$B_1$ to $B_4$ represent the same groups as those for $B_1$ and $B_2$ and only one of them is present at the same time. "u" represents an integer of from 0 to 5 and "v" represents an integer of from 0 to 4.

The particular acrylate compound has the following characteristics. The particular acrylate compound is a tertiary amine compound having a stilbene type conjugation structure. By using such a charge transport compound having a developed conjugation structure, the charge infusion property at the cross-linking layer interface is excellent and when the compound is fixed between the cross-linking bondings, the intermolecular interaction is hardly prohibited, meaning that the charge mobility is sustained good.

In addition, the particular acrylate compound contains an acryloyloxy group or a methacryloyloxy group having a high radical polymerization property and is quickly gelatinized at radical polymerization without excessive cross-linking distortion.

The double bonding in the stilbene structure in the molecule is partially used in the polymerization. In addition, the polymerization property of the stilbene structure is relatively low in comparison with that of an acryloyloxy group or a methacryloyloxy group, thereby causing the time lag in the cross-linking reaction, which prevents an increase in distortion. Furthermore, the number of cross-linking reaction per molecule increases since the double bonding in the molecule is used. Thus, the cross-linking density is high. Therefore, duration against abrasion is further improved.

In addition, this double bonding can be adjusted with regard to the polymerization degree depending on the cross-linking condition. Such participation in the cross-linking to the radical polymerization is unique characteristic of the acrylate compound. This does not apply to the structure of the α phenyl stilbene type described above.

Therefore, by using a charge transport compound having a radical polymerizable functional group represented by the chemical structure 20, the chemical structure 23 in particular, good electric characteristics are sustained. In addition, a film (layer) having an extremely high cross-linking density is formed without causing cracking. Therefore, various kinds of characteristics of the image bearing member are satisfied, silica particulates, etc. is prevented from being stuck to the surface of the image bearing member.

With regard to uniformity of the cross-linking structure, the number of the radical polymerizable functional groups is preferably small. With regard to duration against abrasion, the number of the radical polymerizable functional groups is preferably large. In the present invention, selection of the number of the radical polymerizable functional group should be made taking into consideration the balance between the uniformity and duration against abrasion.

Specific examples of the polymerizable compound having one functional group with a charge transport structure include, but are not limited to, the following.

Illustrated Chemical Compound

No. 1

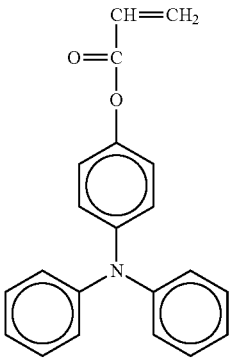

-continued

No. 2

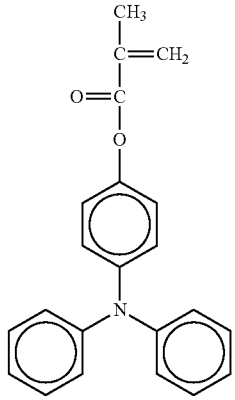

No. 3

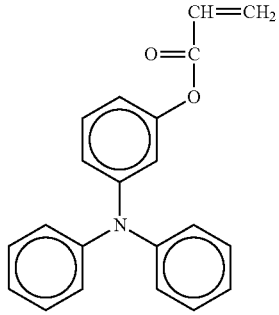

No. 4

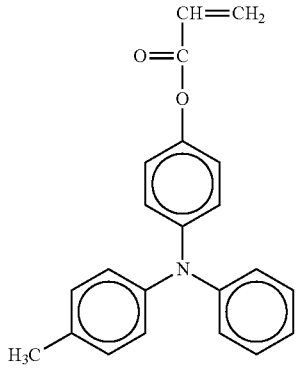

No. 5

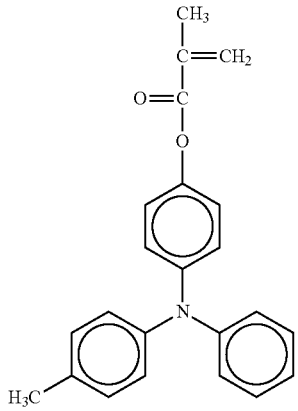

No. 6
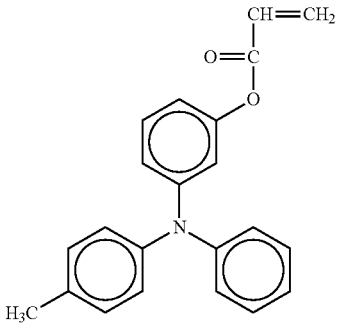
No. 7
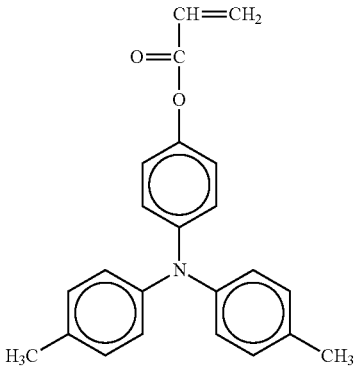
No. 8
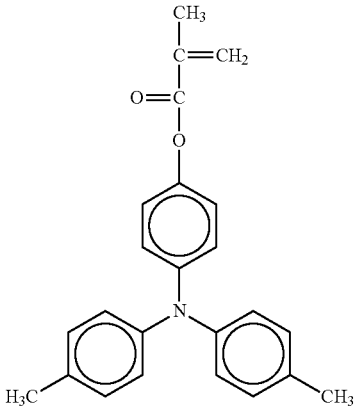
No. 9
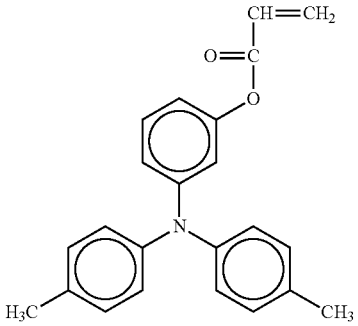
No. 10
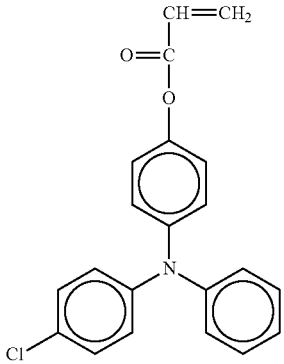
No. 11
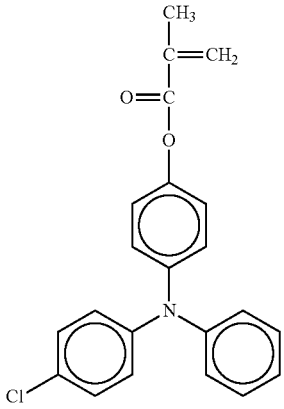
No. 12
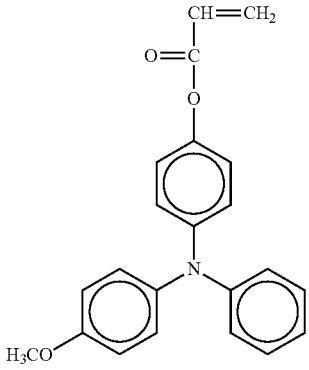
No. 13
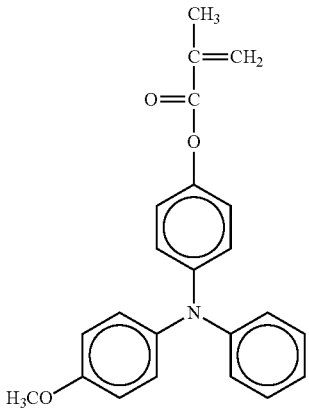

No. 14
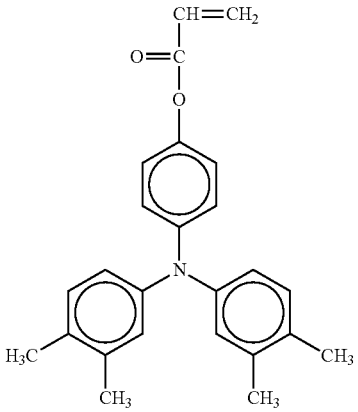
No. 15
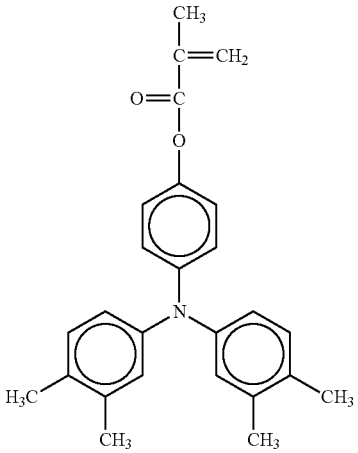
No. 16
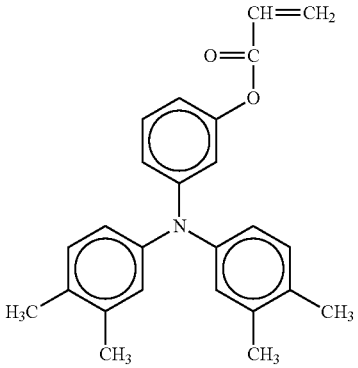
No. 17
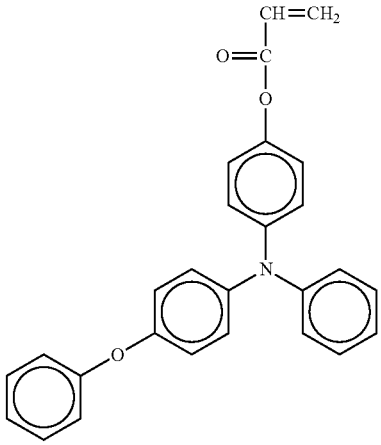
No. 18
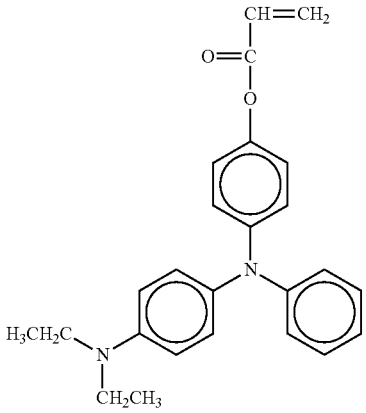
No. 19
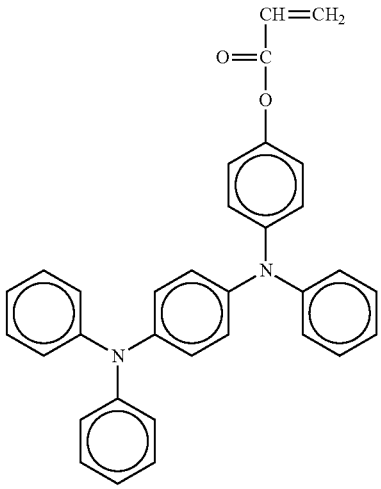

-continued
No. 20
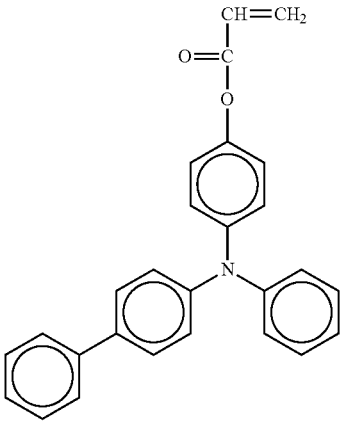
No. 21
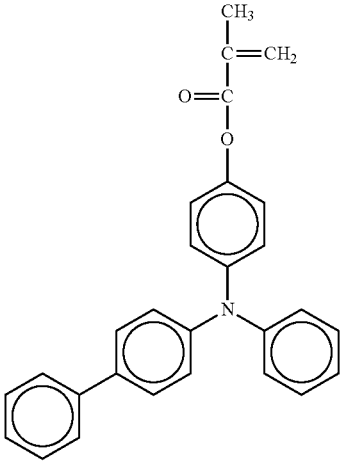
No. 22
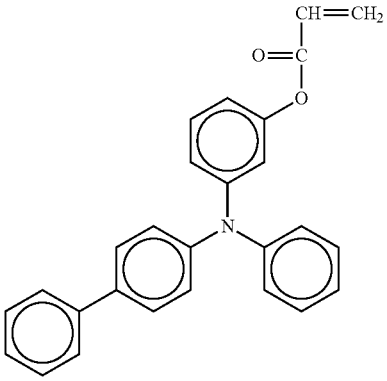
No. 23
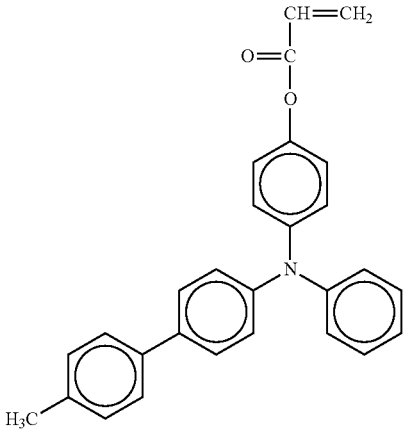
-continued
No. 24
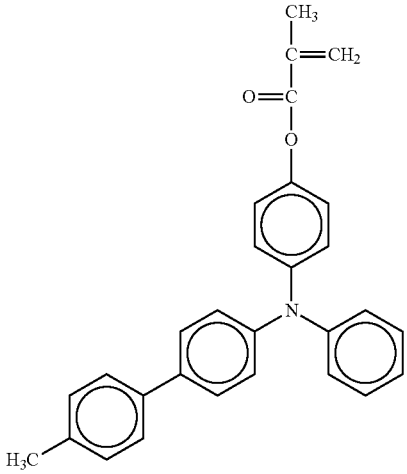
No. 25
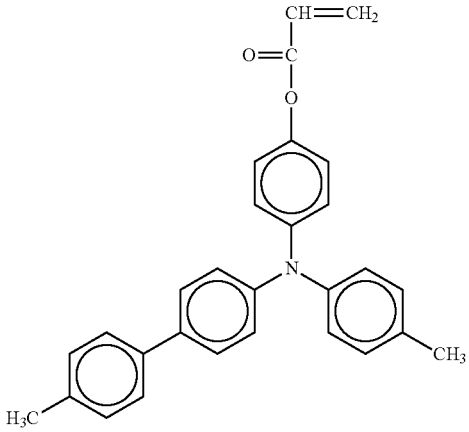
No. 26
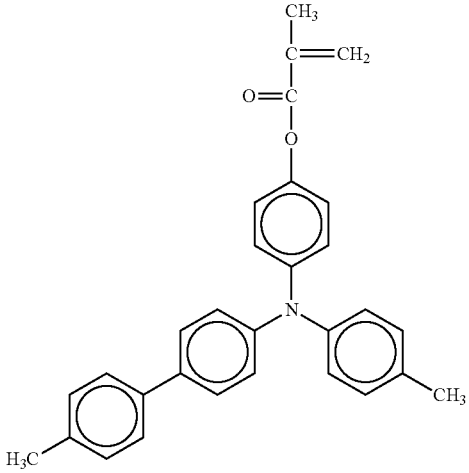

-continued
No. 27
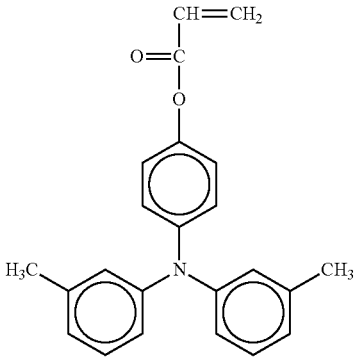
No. 28
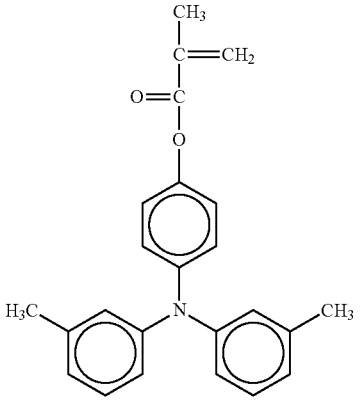
No. 29
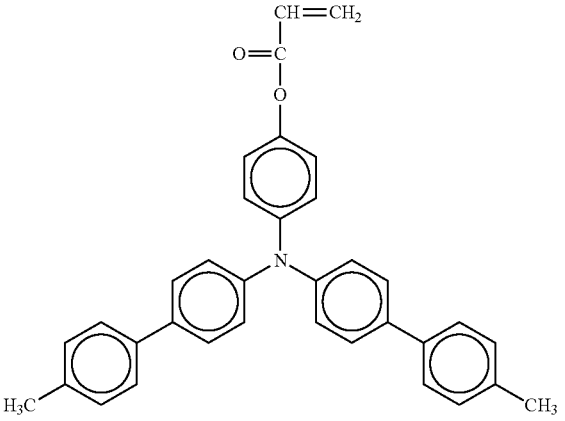
No. 30
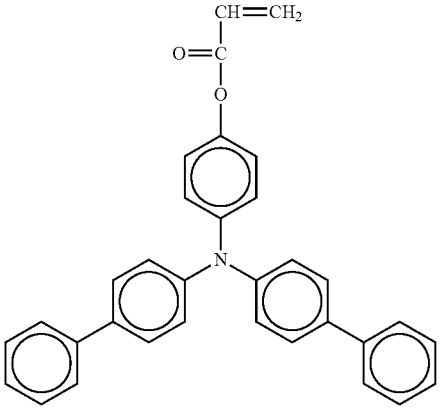
-continued
No. 31
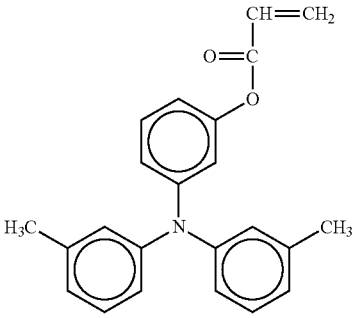
No. 32
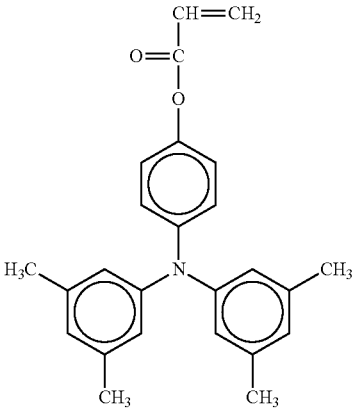
No. 33
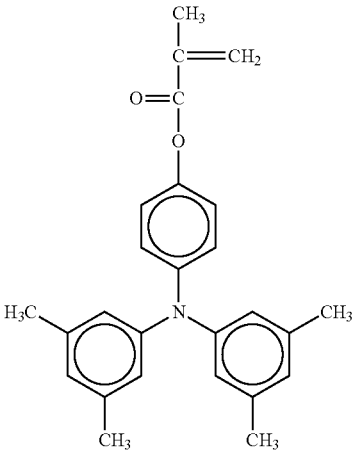
No. 34
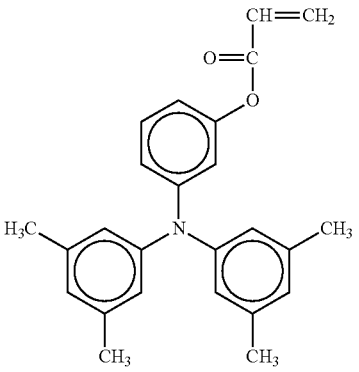

-continued
No. 35
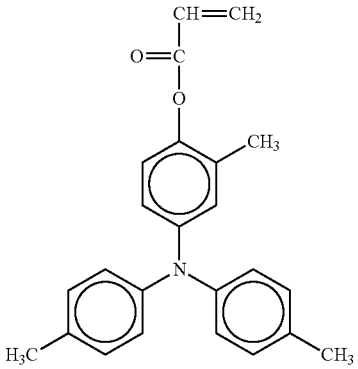
No. 36
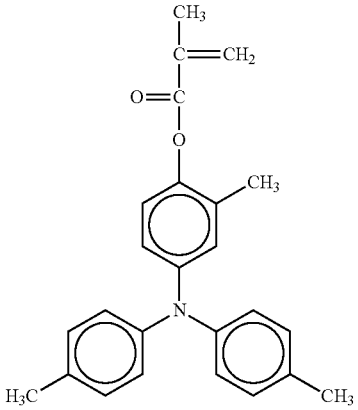
No. 37
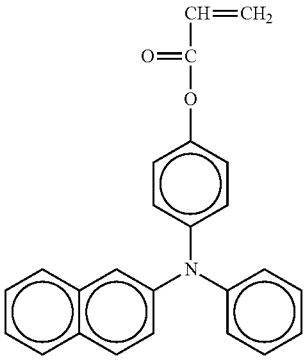
No. 38
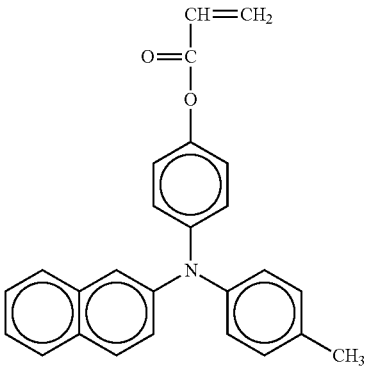
-continued
No. 39
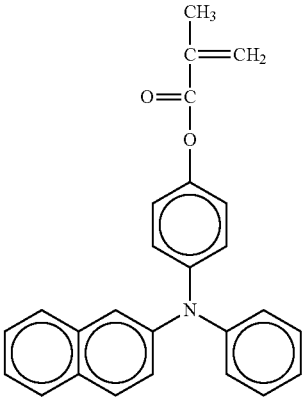
No. 40
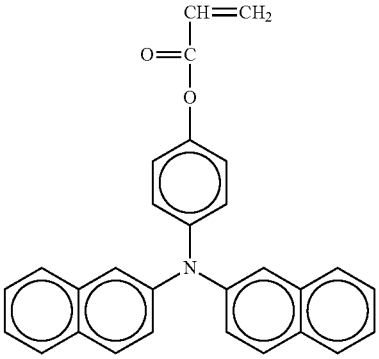
No. 41
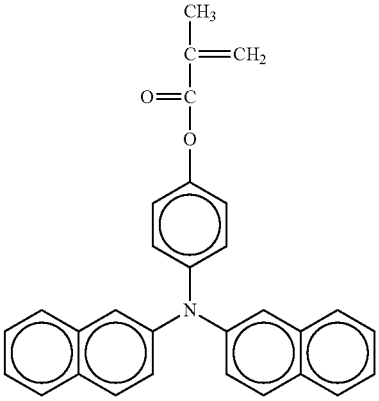
No. 42
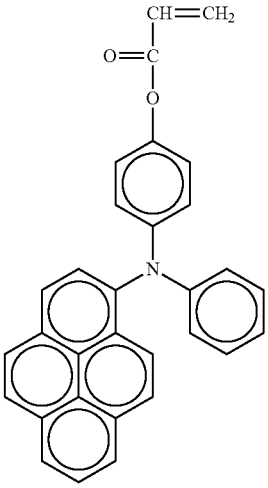

No. 43
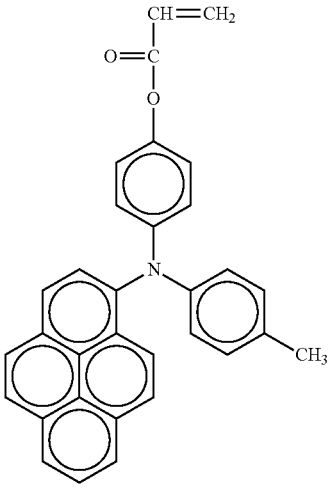
No. 44
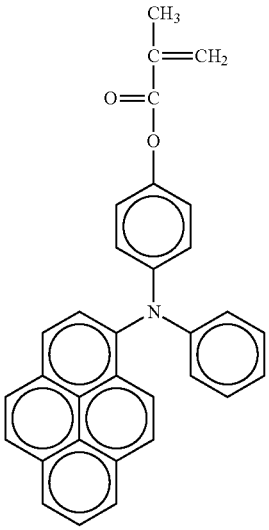
No. 45
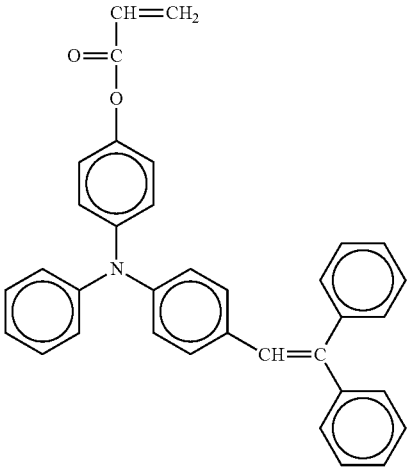
No. 46
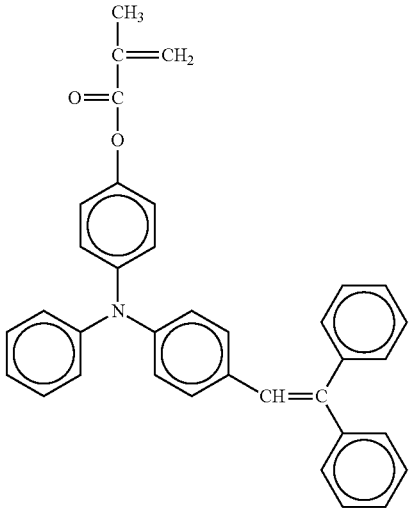
No. 47
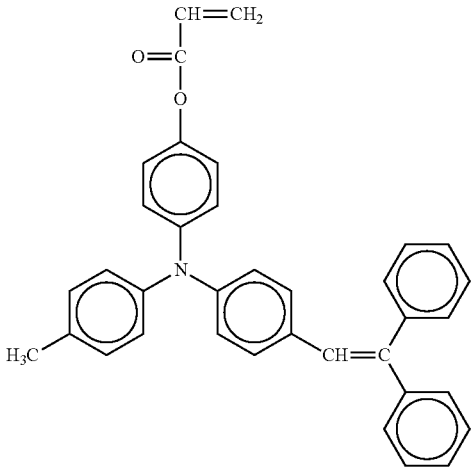
No. 48
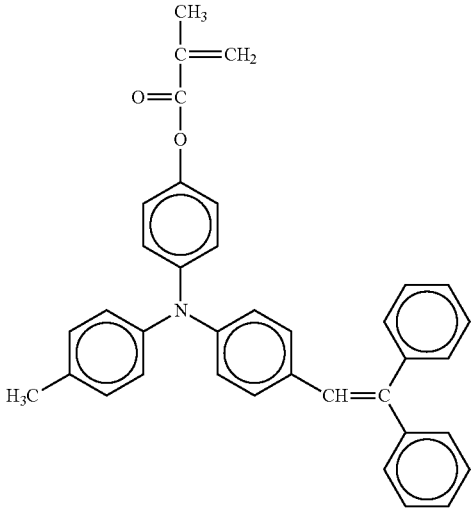

-continued
No. 49
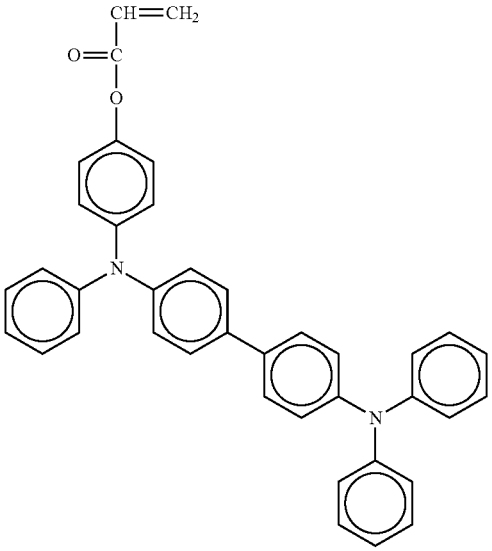
No. 50
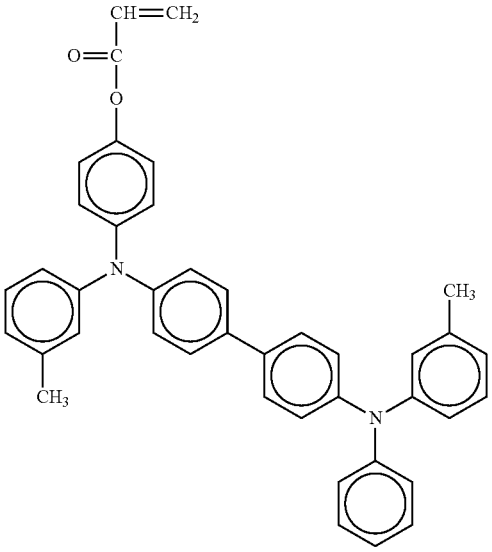
No. 51
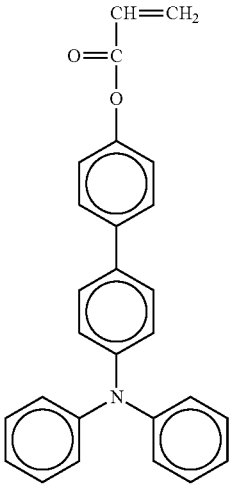
-continued
No. 52
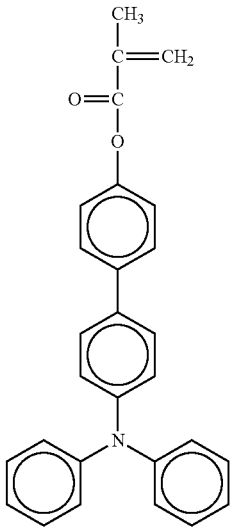
No. 53
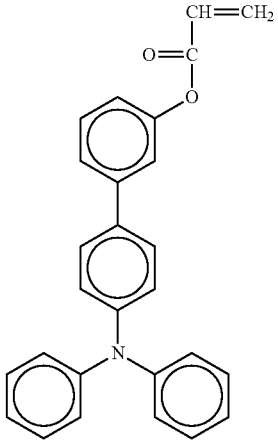
No. 54
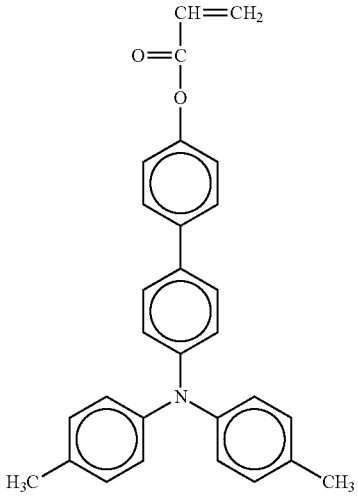

No. 55
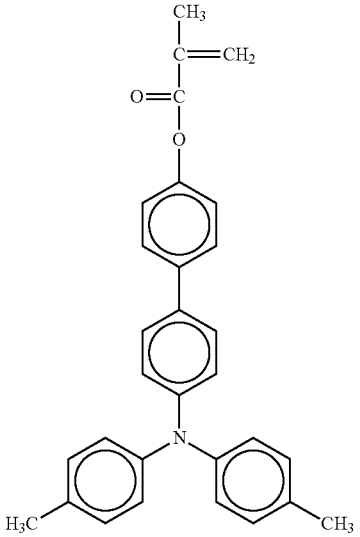
No. 56
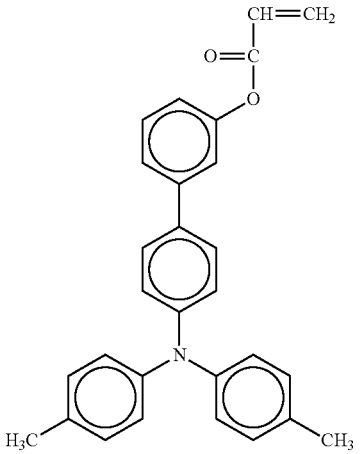
No. 57
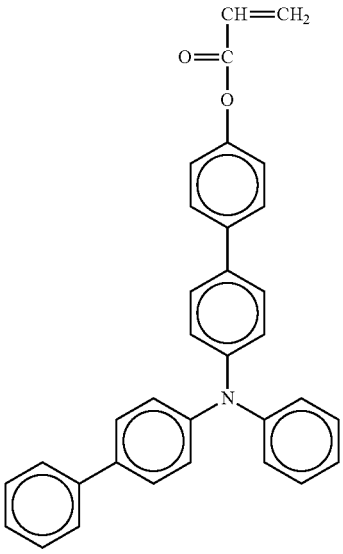
No. 58
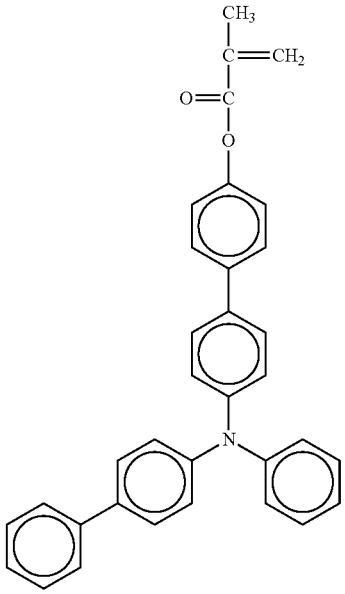
No. 59
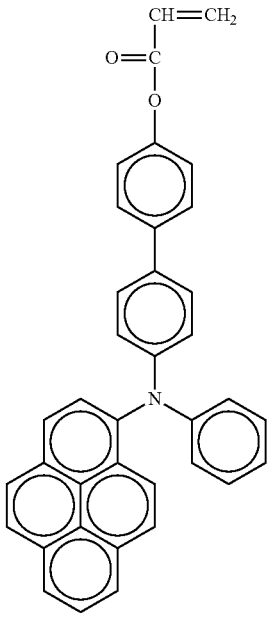

-continued
No. 60
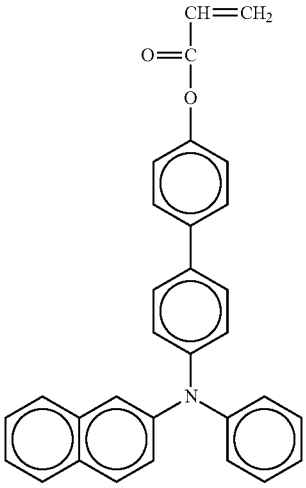
No. 61
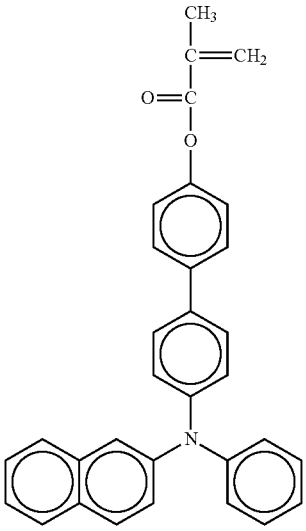
No. 62
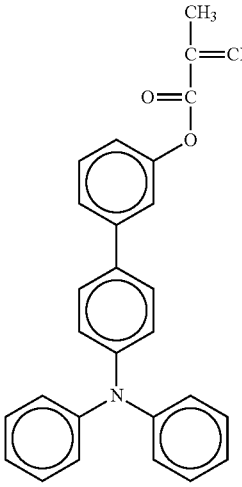
-continued
No. 63
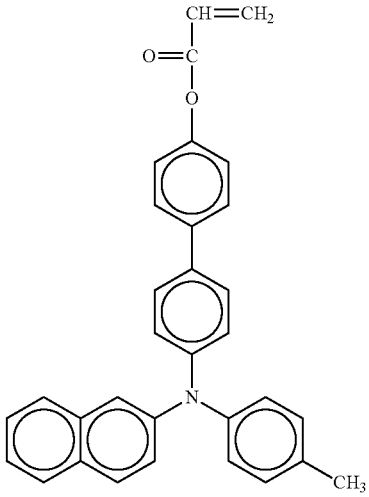
No. 64
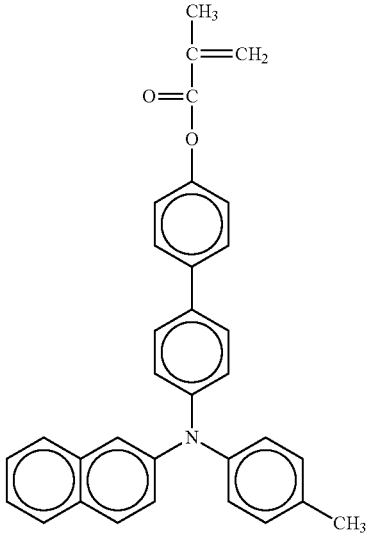
No. 65
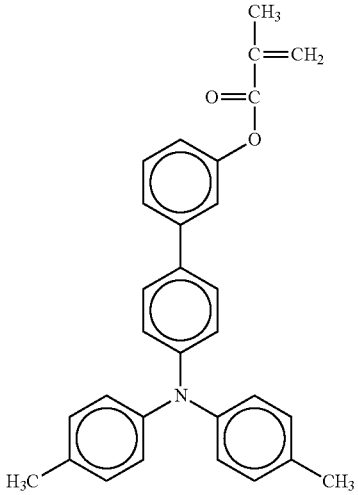

No. 66
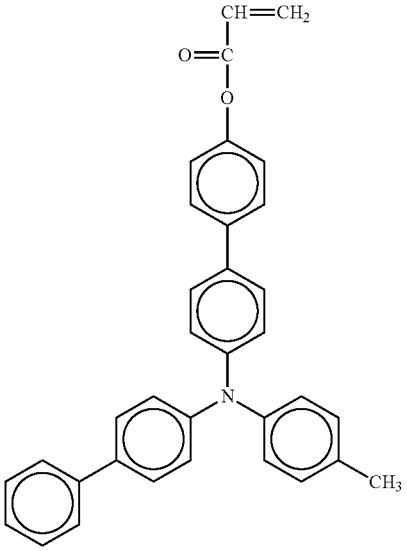
No. 67
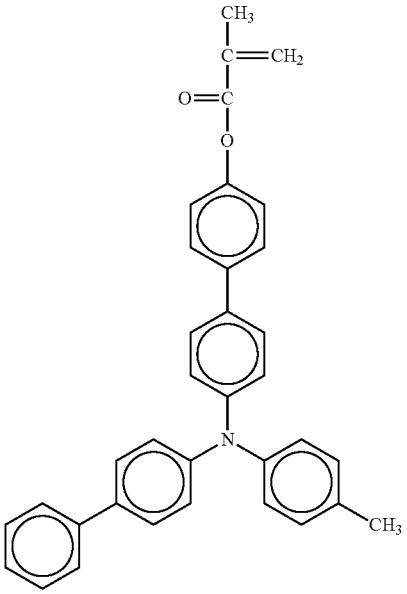
No. 68
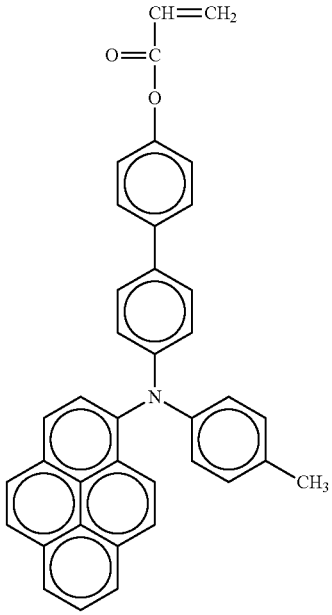
No. 69
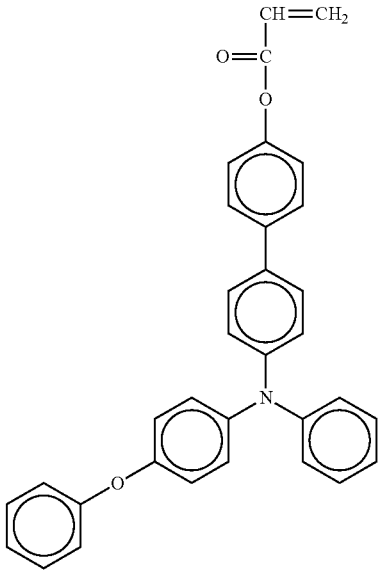

No. 70
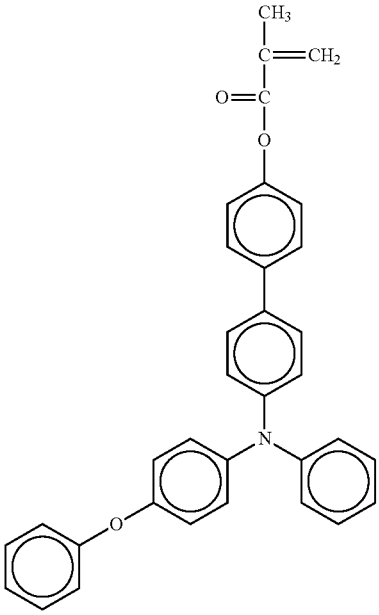
No. 71
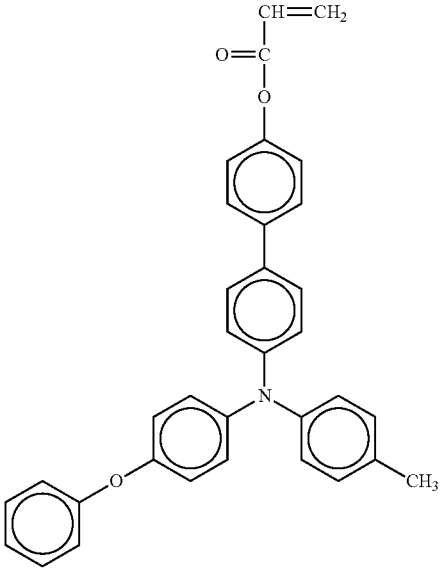
No. 72
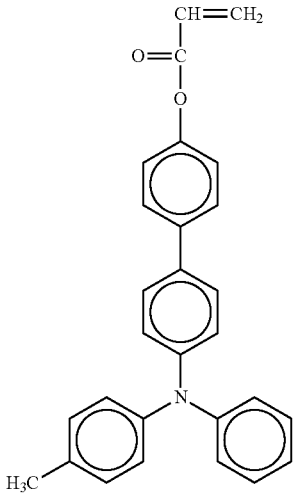
No. 73
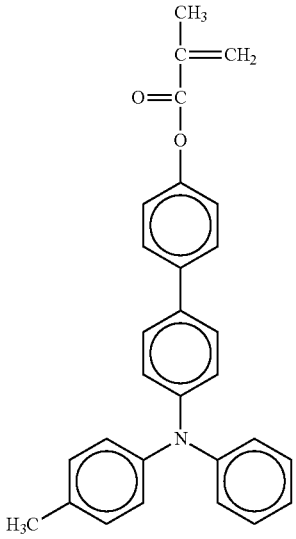
No. 74
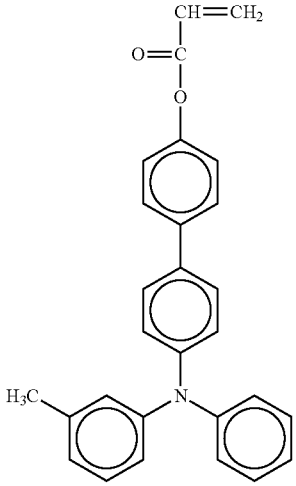

No. 75
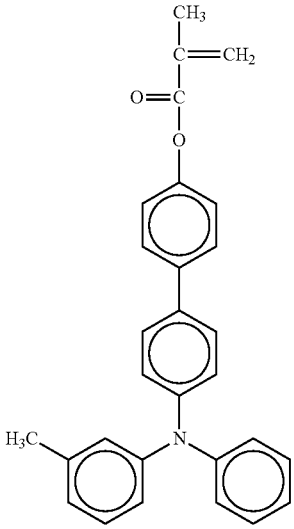
No. 76
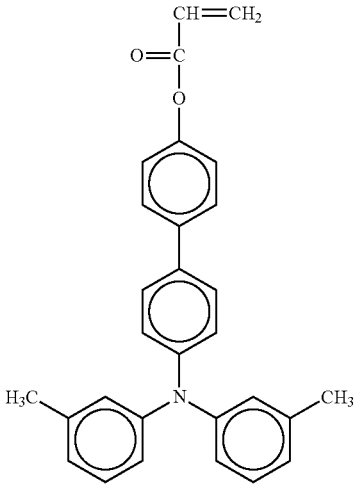
No. 77
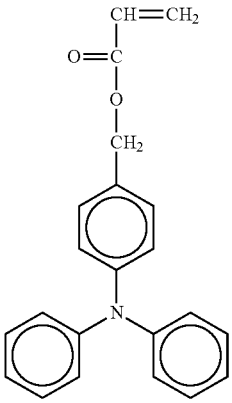
No. 78
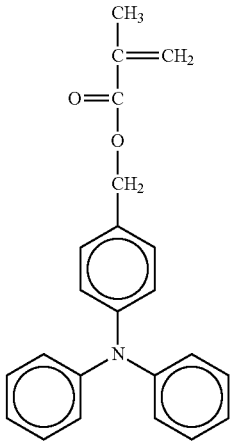
No. 79
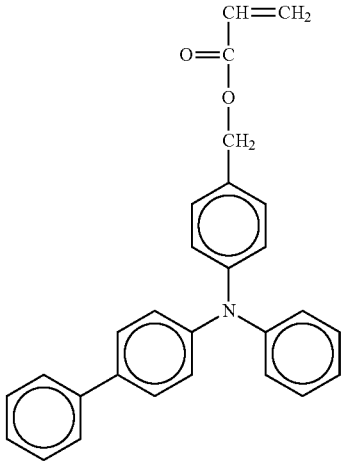
No. 80
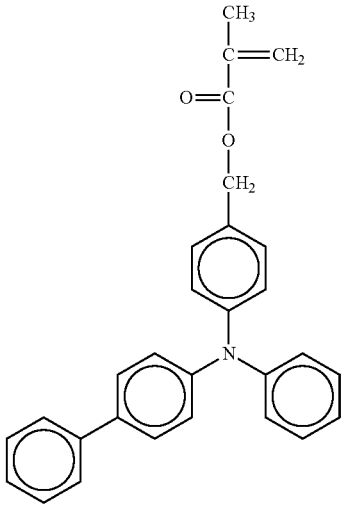

No. 81
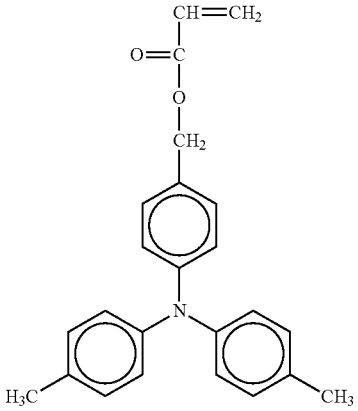
No. 82
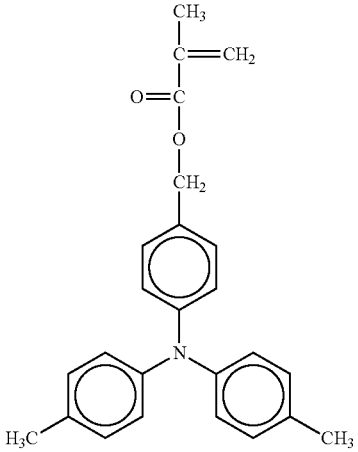
No. 83
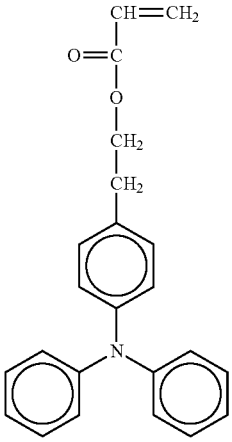
No. 84
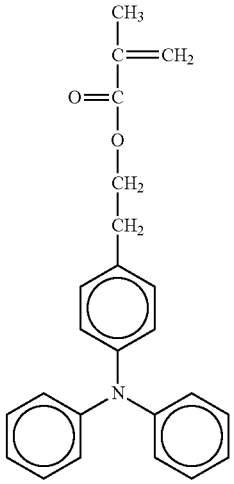
No. 85
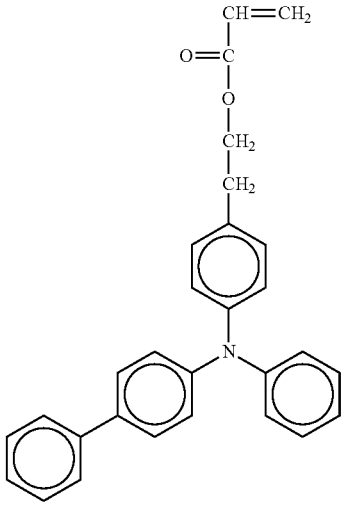
No. 86
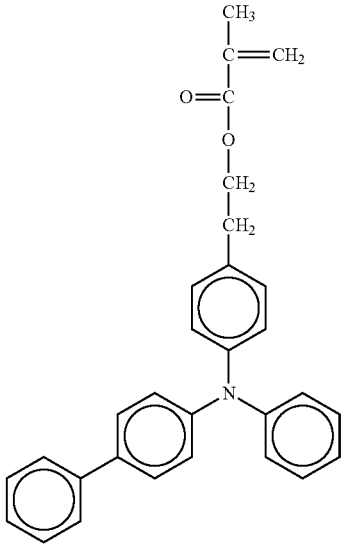

No. 87
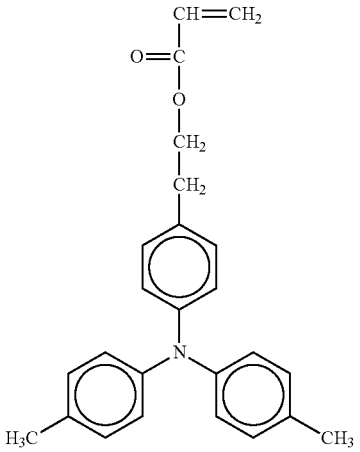
No. 88
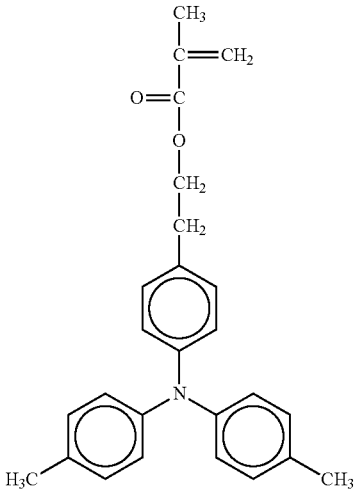
No. 89
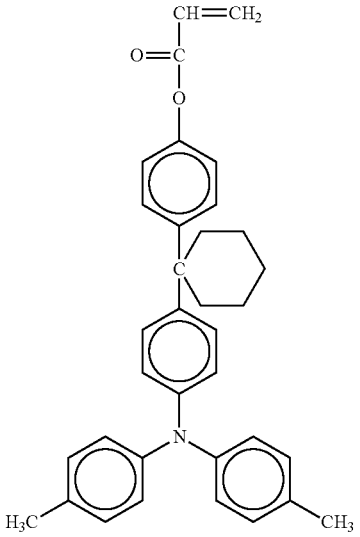
No. 90
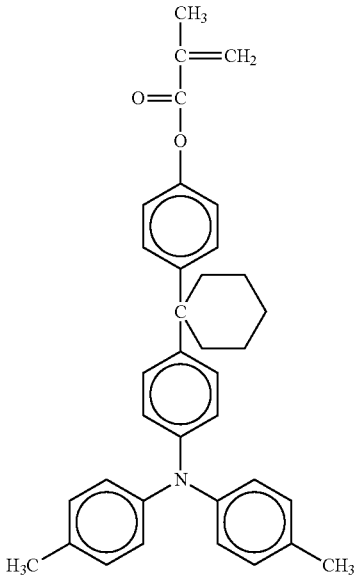
No. 91
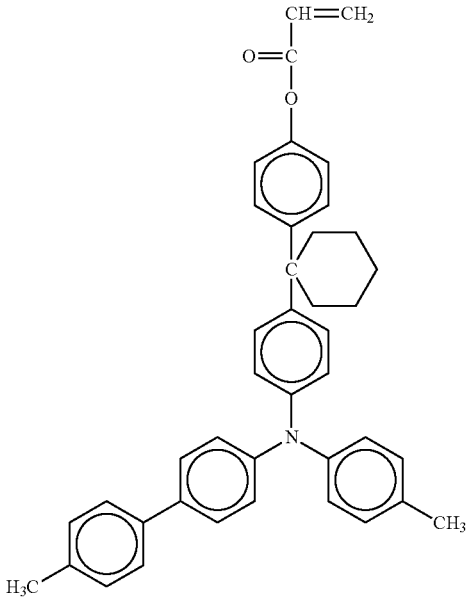

No. 92
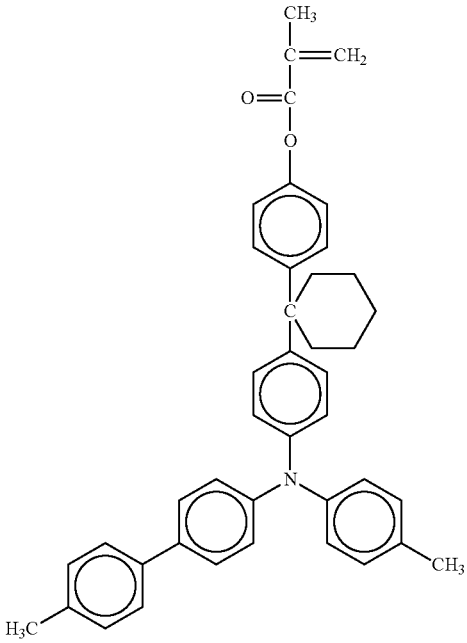
No. 93
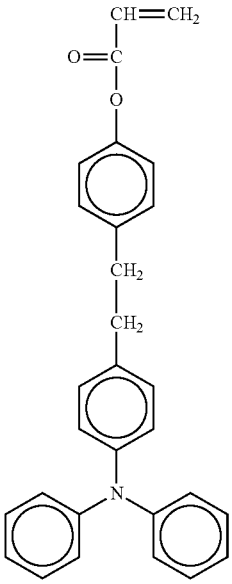
No. 94
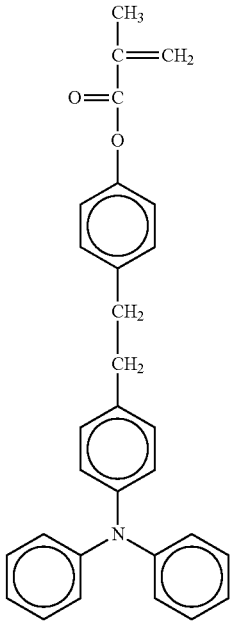
No. 95
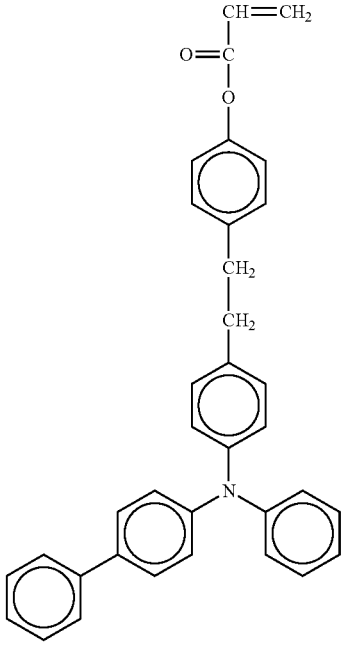

No. 96
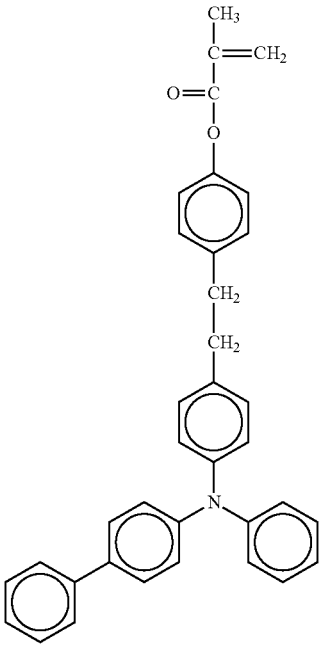
No. 97
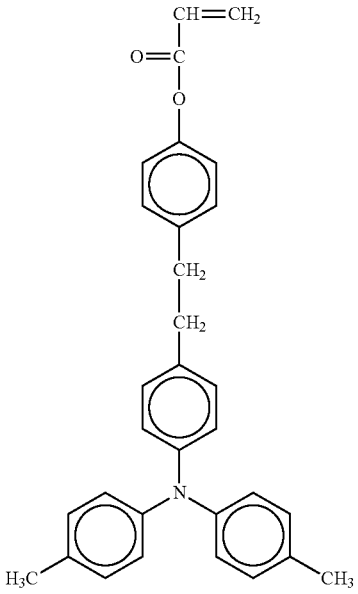
No. 98
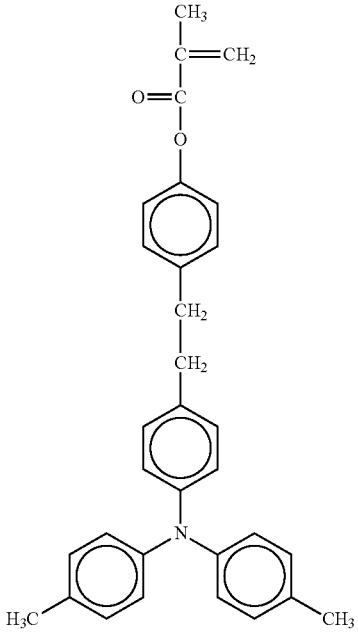
No. 99
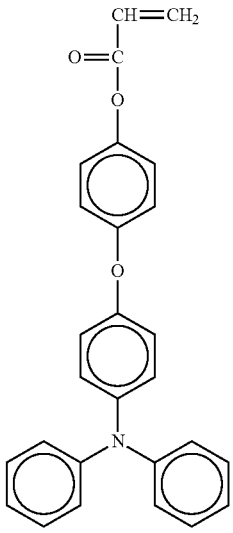

No. 100
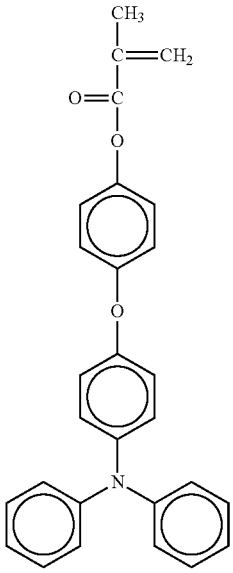
No. 101
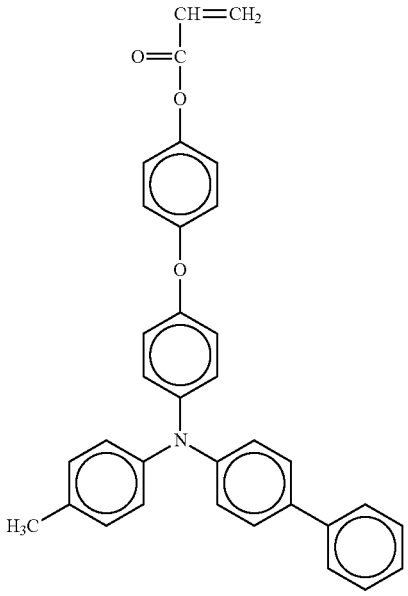
No. 102
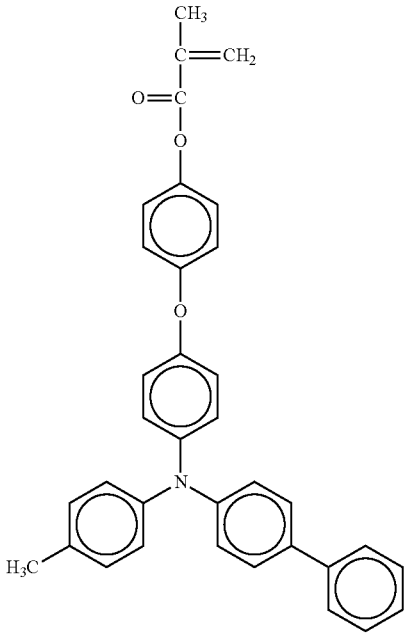
No. 103
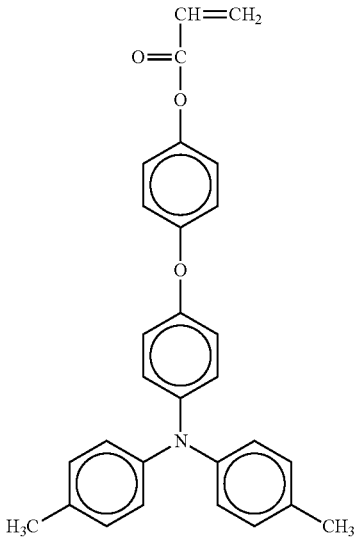

No. 104
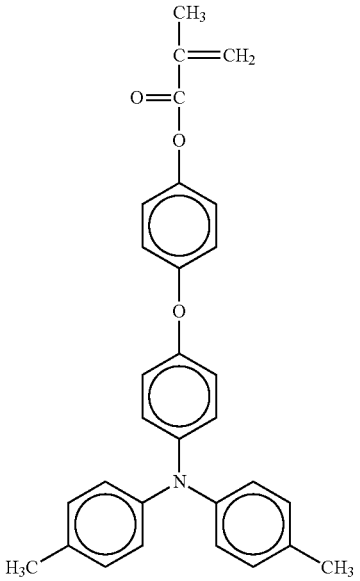
No. 105
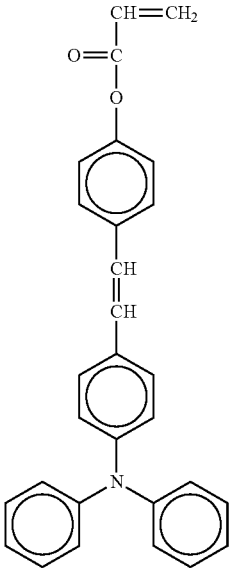
No. 106
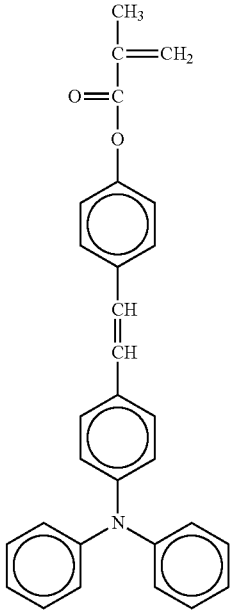
No. 107
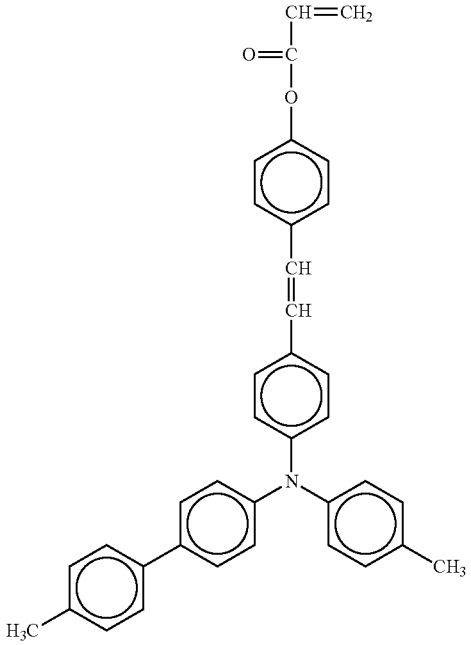

No. 108
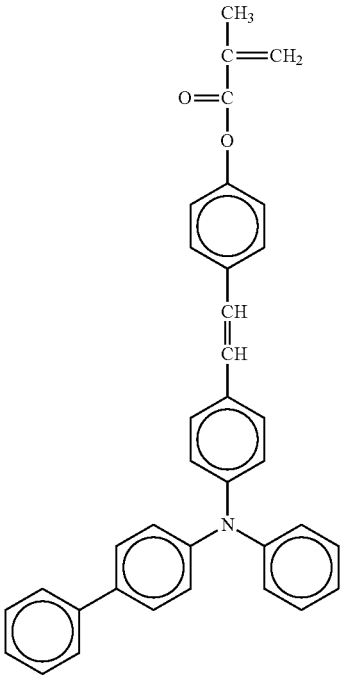
No. 109
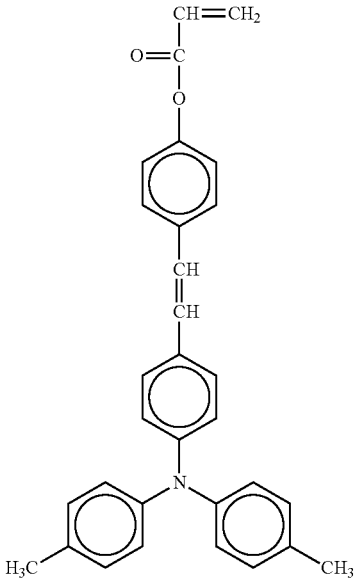
No. 110
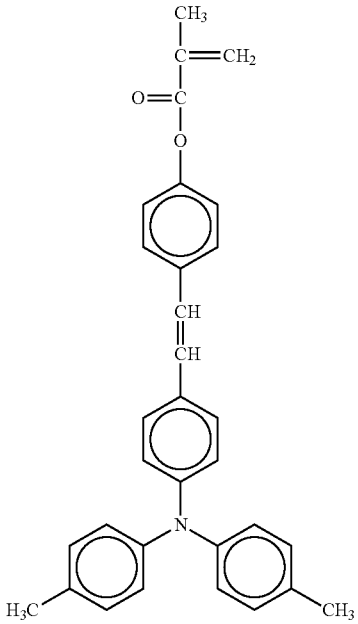
No. 111
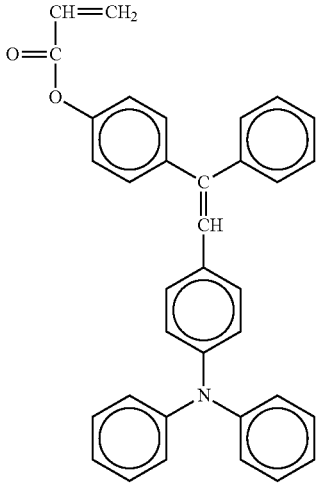
No. 112
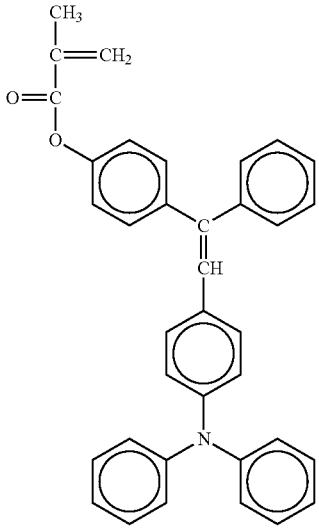

No. 113
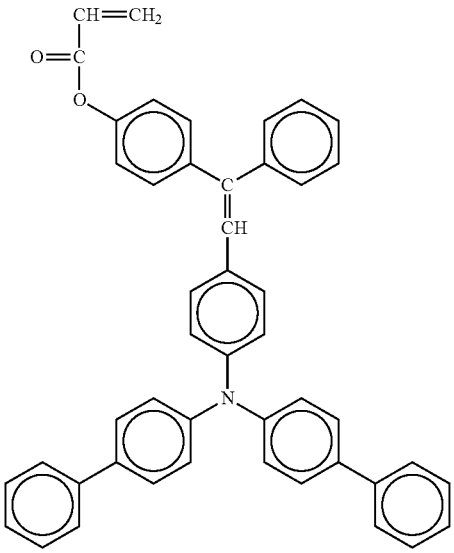
No. 114
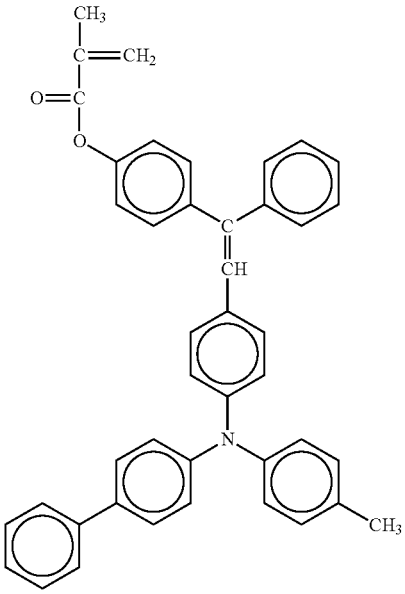
No. 115
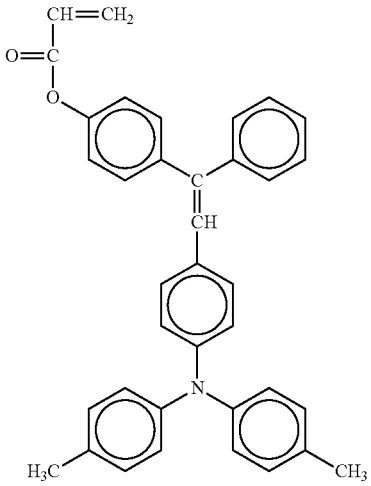
No. 116
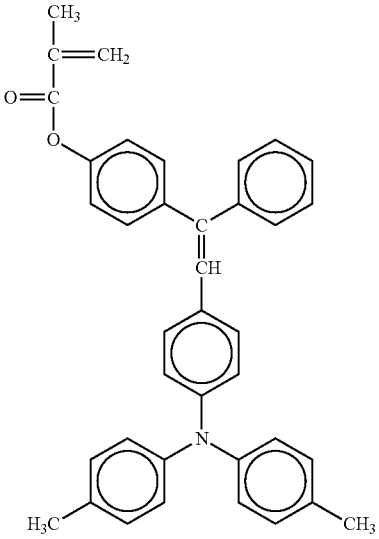
No. 117
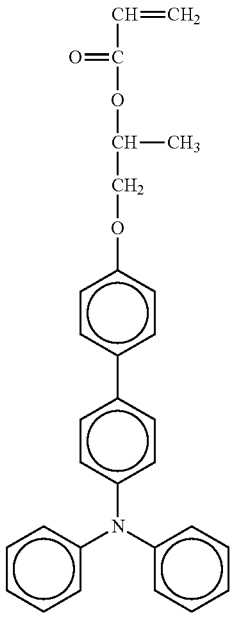

No. 118
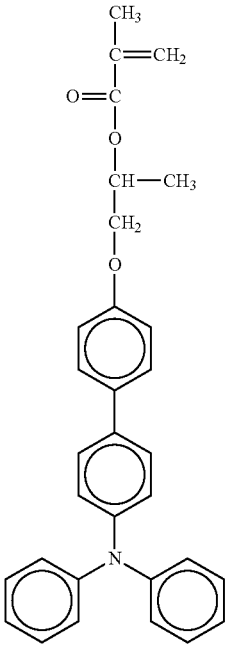
No. 119
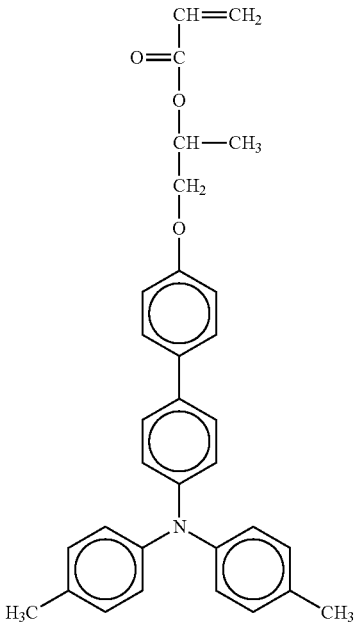
No. 120
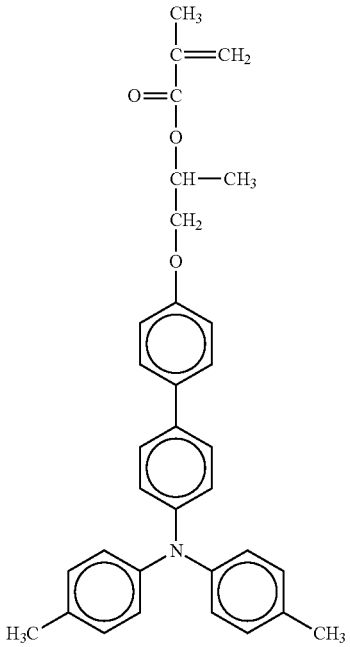
No. 121
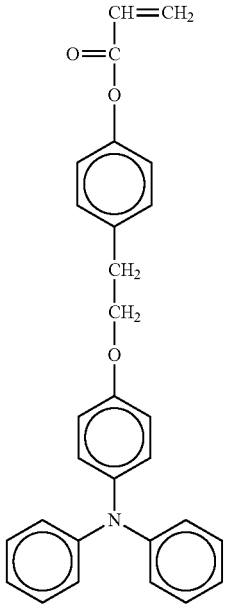

No. 122
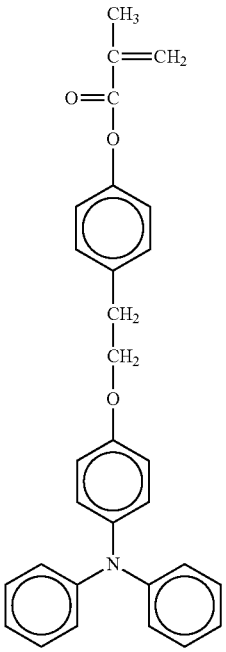
No. 123
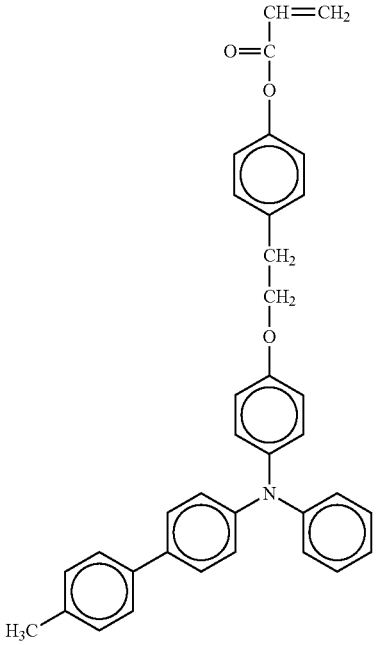
No. 124
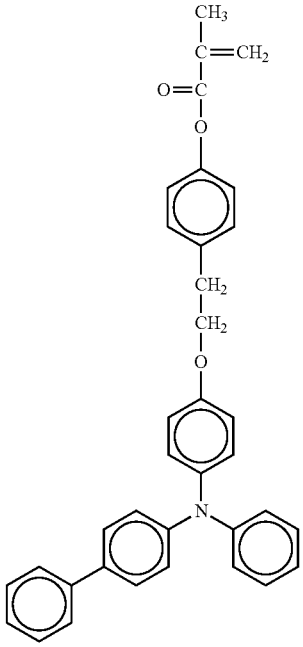
No. 125
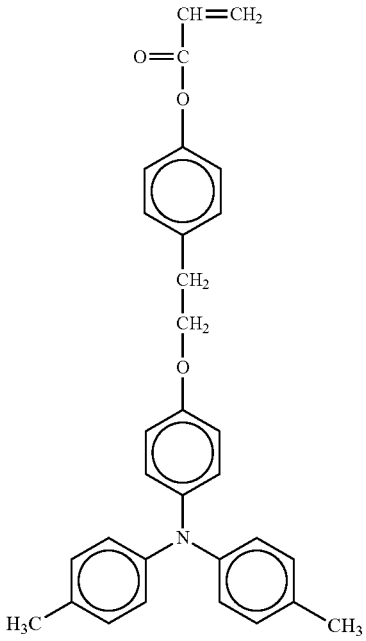

No. 126
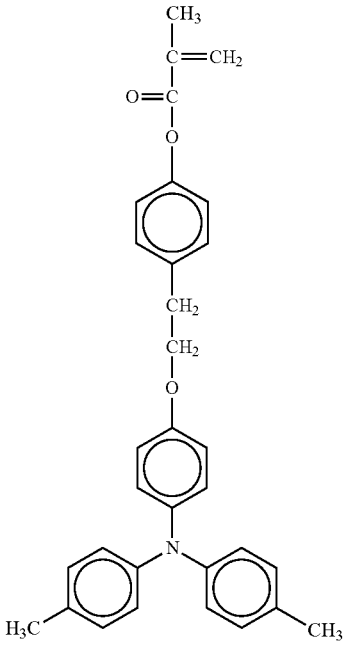
No. 127
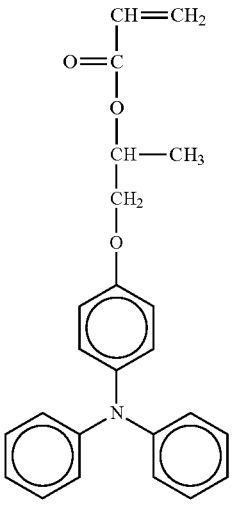
No. 128
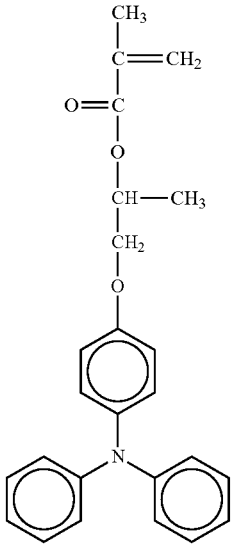
No. 129
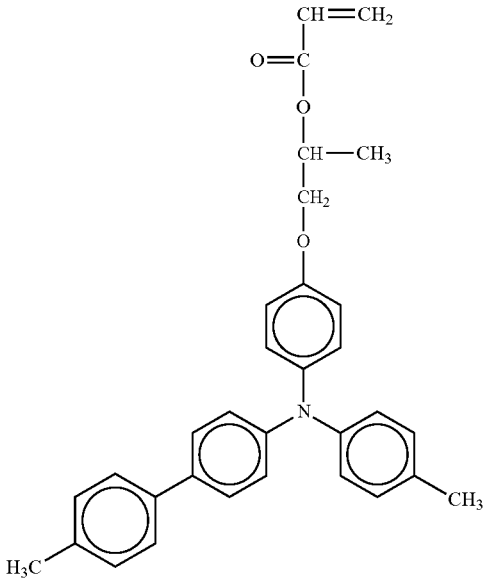

No. 130
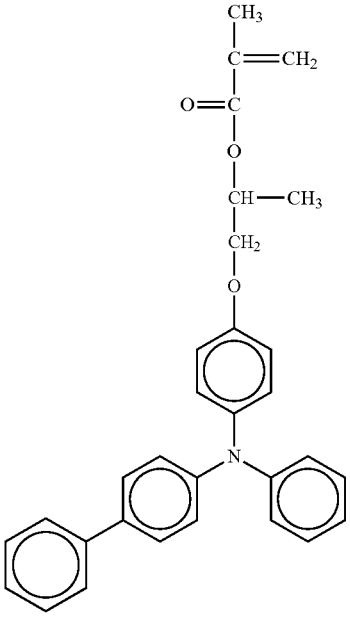
No. 131
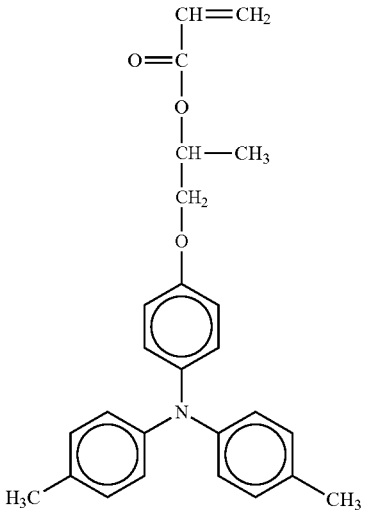
No. 132
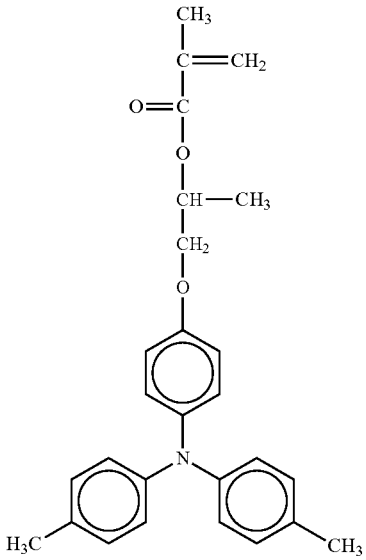
No. 133
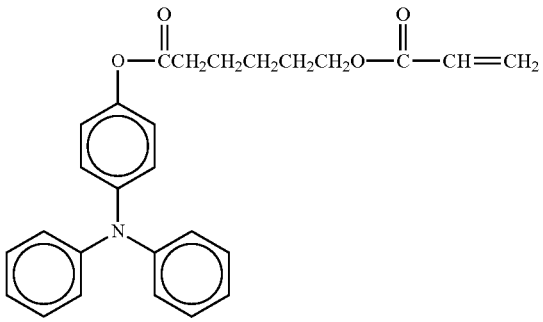
No. 134
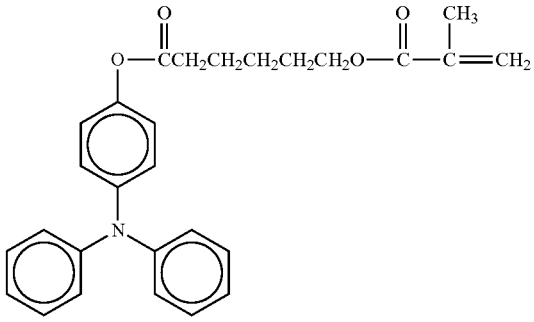
No. 135
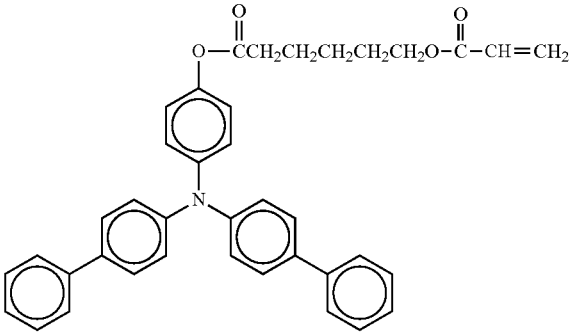

No. 136
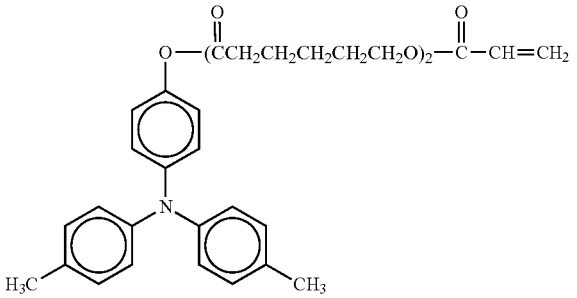
No. 137
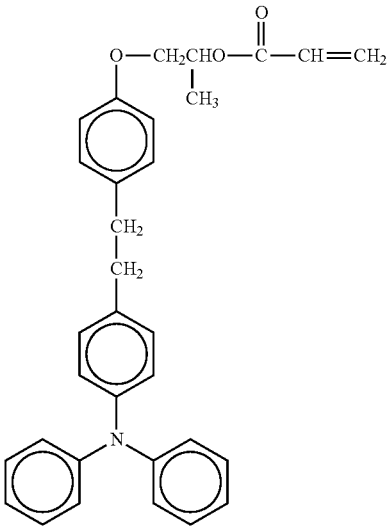
No. 138
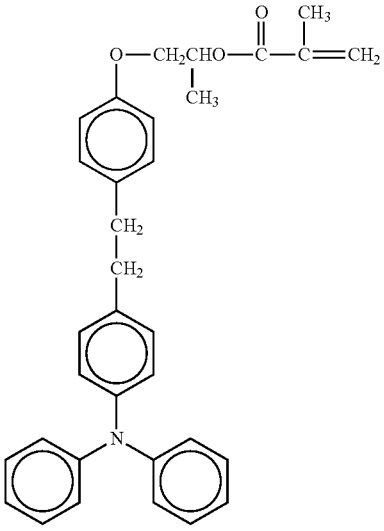
No. 139
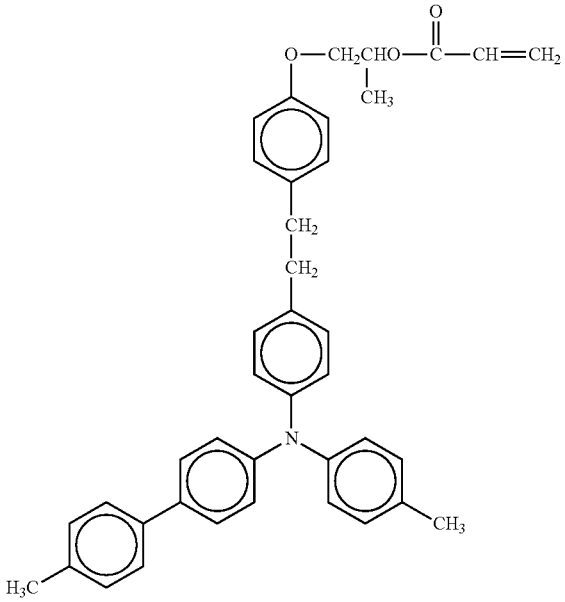
No. 140
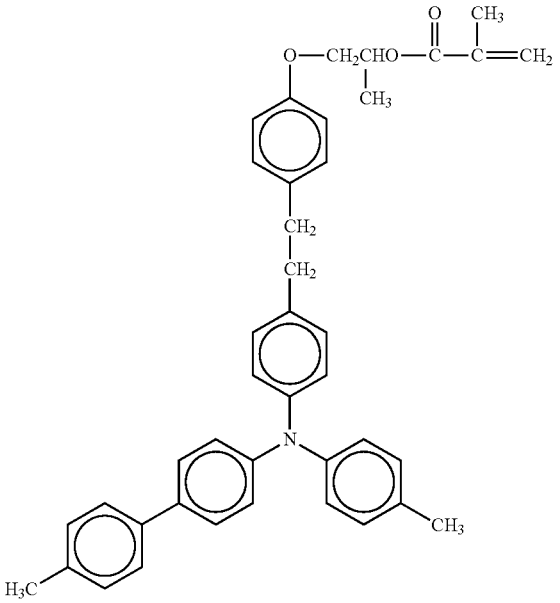
No. 145
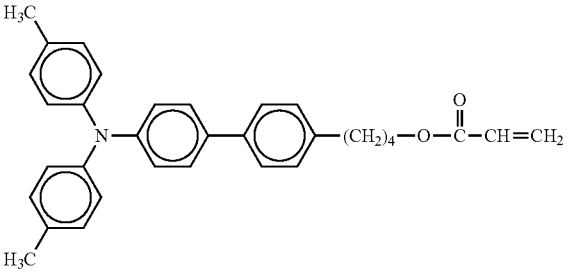

-continued
No. 146
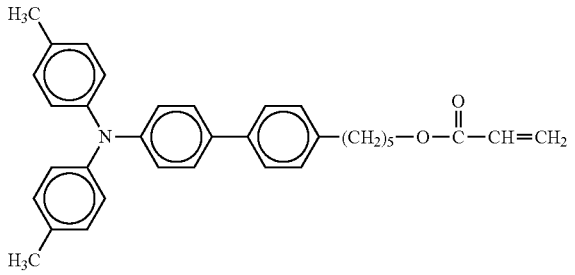
No. 147
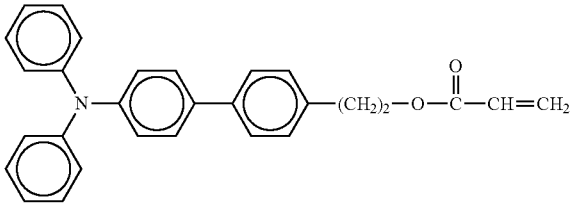
No. 148
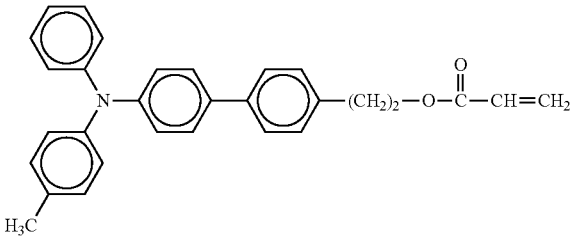
No. 149
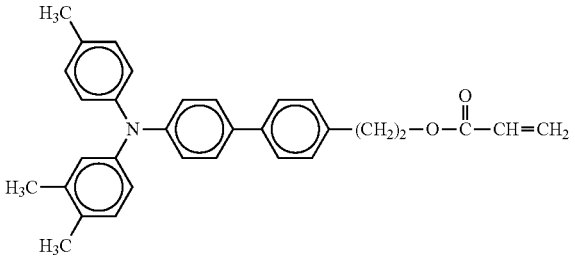
No. 150
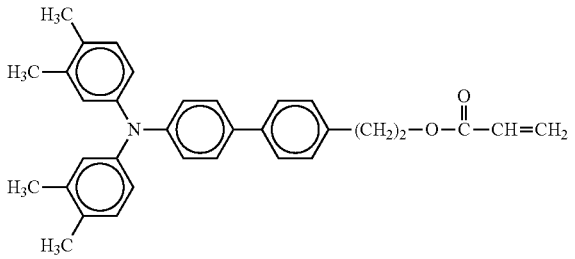
-continued
No. 151
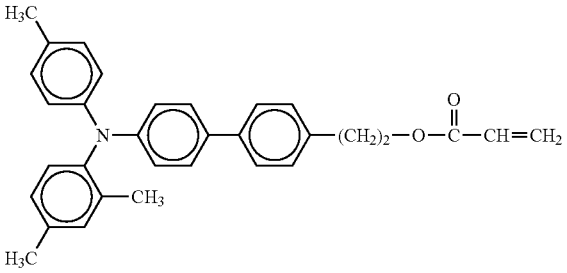
No. 152
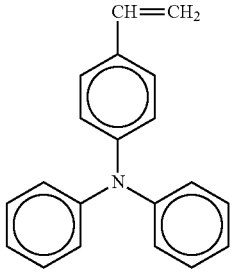
No. 153
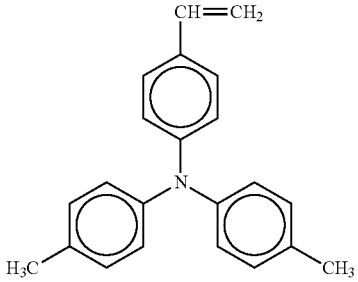
No. 154
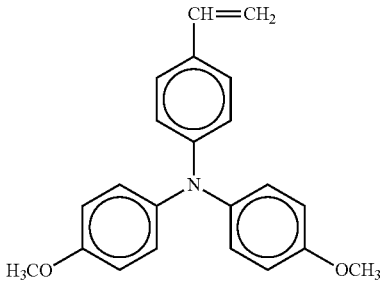
No. 155
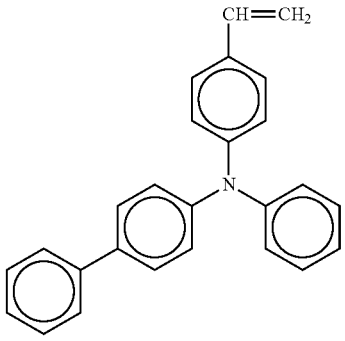

-continued
No. 156
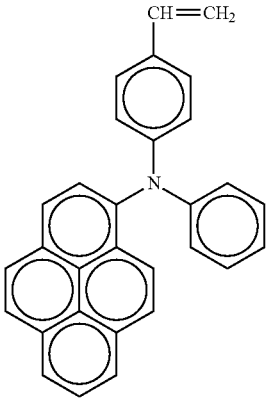
No. 157
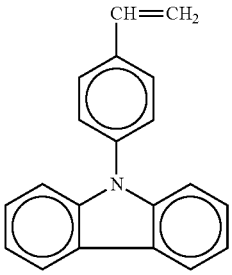
No. 158
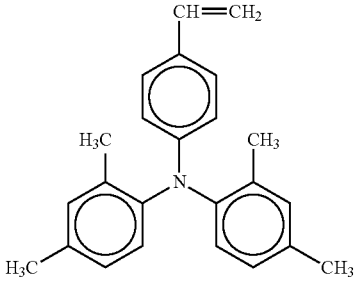
No. 159
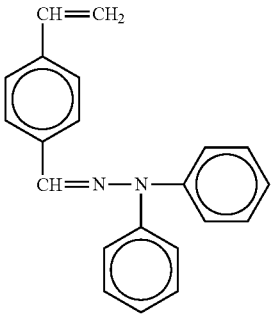
No. 160
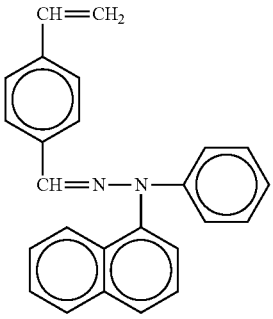
-continued
No. 161
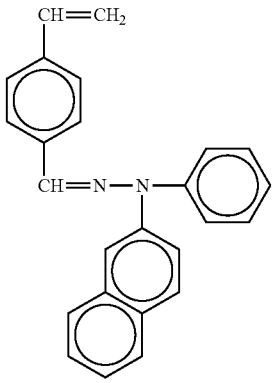
No. 162
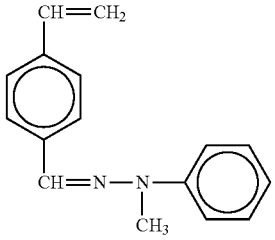
No. 163
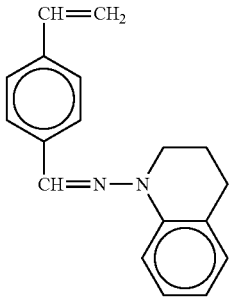
No. 164
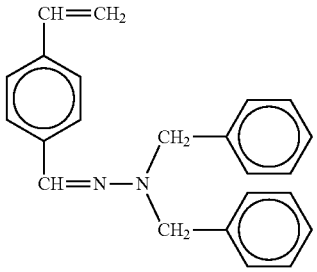
No. 165
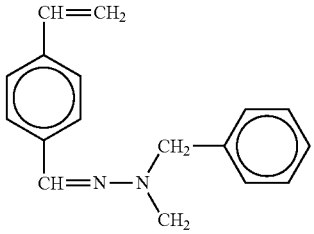

-continued

No. 166

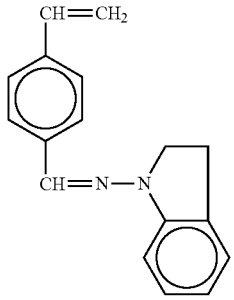

No. 167

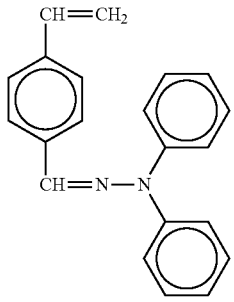

No. 168

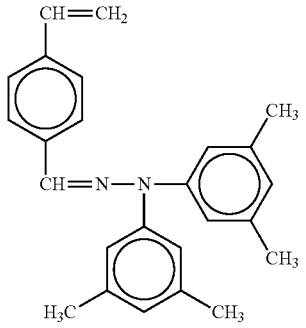

No. 169

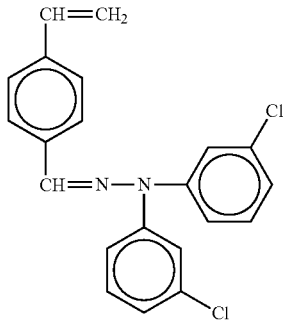

In addition, the polymerizable monomer having a charge transport structure imparts a charge transport power to the protection layer, and the content ratio of the polymerizable monomer having a charge transport structure is from 20 to less than 80% by weight, and preferably from 30 to 70% by weight based on the total weight of the protection layer. A content of the polymerizable compound having a charge transport structure that is excessively small easily invites an insufficient charge transport power of the protection layer, which causes deterioration of electrostatic characteristics such as sensitivity, and a rise of the residual voltage over repetitive use. A content of the radical polymerizable compound having a charge transport structure that is excessively large easily leads to reduction of the content of the compound having no charge transport structure. This easily leads to reduction of the cross linking density, which prevents demonstration of a high abrasion and/or damage resistance. Desired electric characteristics and abrasion resistance vary depending on the process used and thus the layer thickness of the protection layer of the image bearing member for use in the present invention changes. Therefore, it is difficult to jump to any conclusion but considering the balance of both characteristics, the range of from 30 to 70% by weight is most preferred. The polymerizable compound having a charge transport structure is not isolated because it is cured. Even though the polymerizable compound is not isolated, the charge transport structure is quantified using a method such as FT-IR and thus can be used as the density ratio among the charge transport materials for use in the present invention.

As described above, a resin formed by curing a polymerizable compound having 3 or more functional groups with no charge transport structure and a polymerizable compound having one functional group with a charge transport structure is particularly preferable. However, a polymerizable monomer and oligomer having one or two functional groups can be also suitably used, and is significantly effective depending on materials. Any known radical polymerizable monomers and oligomers can be used.

Specific examples of such radical monomers having one functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the polymerizable divalent functional groups include, but are not limited to, 1,3-butane diol acrylate, 1,4-butane diol acrylate, 1,4-butane diol dimethacrylate, 1,6-hexane diol diacrylate, 1,6-hexane diol dimethacrylate, diethylene glycol diacrylate, neopentyl glycol diacrylate, bisphenol A-EO modified diacrylate, bisphenol F EC modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in unexamined published Japanese patent application publication Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the polymerizable oligomers include, but are not limited to, an epoxy acrylate based oligomer, a urethane acrylate based oligomer, and a polyester acrylate based oligomer.

In addition, a polymerization initiator can be optionally added to the liquid application for the protection layer to accelerate the curing reaction.

Specific examples of the thermal polymerization initiators include, but are not limited to, a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, lauroyl peroxide, and 2,2-bis(4,4-di-t-butylperoxydicyclohexy)propane; and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator.

Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of such a polymerization initiator is from 0.5 to 40 parts by weight and preferably from 1 to 20 parts by weight based on 100 parts by weight of the compound having a polymerization property.

Furthermore, the protection layer for use in formation of the surface layer for use in the present invention optionally includes additives such as various kinds of plasticizers (for relaxing internal stress or improving adhesiveness), a leveling agent, a compound having an alkylamino group, an antioxidant, and a charge transport material having a low molecular weight having no radical reaction property. Known additives can be used as these additives. A typical resin such as dibutylphthalate and dioctyl phthalate can be used as the plasticizer. The content thereof is not greater than 20% by weight and preferably not greater than 10% based on the total solid portion of the liquid application. Silicone oils such as dimethyl silicone oil, methyl phenyl silicone oil and a polymer or an oligomer having a perfluoroalkyl group in its side chain can be used as the leveling agent. Alternatively, a leveling agent having a functional group for polymerization can be also effectively used. The content thereof is suitably not greater than 1% by weight based on the total solid portion of the liquid application. When such an additive is added in an excessively large amount, the friction index of the surface of an image bearing member tends to decrease, resulting in unstable supply of a lubricant material. In addition, the materials specified for the charge transport layer can be effectively used as the compound having an alkyl amino group. Addition of these materials to the protection layer placed at the uppermost layer of an image bearing member is preferable. However, a material that is added excessively tends to cause curing inhibition so that the addition amount is limited to the minimum amount. The content thereof is not greater than 3%, and preferably not greater than 2% by weight based on the total solid portion of the liquid application. Specific examples of the anti-oxidizers (oxidants) include, but are not limited to, known materials such as phenol based compounds, paraphenylene diamines, hydroquinones, organic sulfur compounds, organic phosphorous compounds, and hindered amines. Particularly, the anti-oxidants specified for the charge transport layer represented by the chemical structure 6, 7, 8 or 9 is preferable. Addition of an anti-oxidant to a protection layer is preferable. However, when the addition amount is too large, curing tends to be prohibited or the residual voltage tends to rise.

The content thereof is not greater than 3%, and preferably not greater than 2% by weight based on the total solid portion of the liquid application.

The protection layer for use in the present invention is formed by coating and curing a liquid application containing at least the filler, a polymerizable compound having no charge transport structure, and an optional polymerizable compound having a charge transport structure to the charge transport layer. When a liquid polymerizable compound is used for the liquid application, other components are possibly dissolved in the liquid before coating. Optionally, the liquid application is diluted by a suitable solvent before coating.

Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosolve and cellosolve acetate. These solvents can be used alone or in combination. The solvent for dilution occupies a large part of the liquid application for a protection layer. Therefore, a highly volatile solvent is preferable in terms that the solvent hardly remains in the protection layer. Use of a solvent that easily remains in the protection layer is preferably avoided.

The solvent that easily remains tends to raise the residual voltage, prevent curing, cause uneven curing, or reduce the curing density. In the present invention, among these solvent for dilution, solvents such as tetrahydrofuran, methylethyl ketone, or an alcohol based solvent are suitably used. Among these, tetrahydrofuran is most suitable. The dilution ratio by using such a solvent is arbitrary and varies depending on the solubility of a composition, a coating method, and a target layer thickness. A dip coating method, a spray coating method, a bead coating method, a ring coating method, etc., can be used in application of the liquid application.

In the present invention, subsequent to application of the liquid application of the protection layer, the liquid applied is cured by application of external energy such as heat, light and radiation ray to form the protection layer. Heat can be applied to the protection layer from the application surface side or the substrate side using a gas such as air and nitrogen, vapor, or various kinds of heat media, infra-red radiation and electromagnetic wave. The heating temperature is not lower than 100° C. and preferably not higher than 170° C. When the heating temperature is too low, the reaction speed tends to be slow so that the curing reaction may not be complete. A heating temperature that is too high tends to cause non-uniform curing reaction, thereby significantly distorting the inside of the protection layer and resulting in a great number of non-reacted residual groups and reaction terminated ends. A method of heating the cross linked surface layer at a relatively low temperature, for example lower than 100° C., followed by heating at a relatively high temperature, for example, higher than 100° C., is suitable to uniformly conduct curing reaction.

As light energy, a UV irradiation light source such as a high pressure mercury lamp or a metal halide lamp having a main emission wavelength in the ultraviolet area is used. A visible light source can be selected depending on the absorption wavelength of a compound containing a polymerizable monomer and a photopolymerization initiator. The irradiation light amount is preferably from 50 mW/cm$^2$ to 1,000 mW/cm$^2$. When the irradiation light amount is too small, it takes a long time to complete the curing reaction. An irradiation light amount that is too large tends to prevent a uniform curing reaction, which results in local wrinkling on the surface of the protection layer and a great number of non-reacted residual groups and reaction terminated ends. In addition, rapid cross-linking increases the internal stress, which leads to cracking and peeling-off of the layer. Beams of electron can be used as the radiation ray energy. Among these forms of energies, thermal or light energy is suitably used in terms of easiness of reaction speed control and simplicity of a device.

The layer thickness of the protection layer in the present invention is preferably from 1.0 to 8 μm, more preferably from 1.5 to 5.0 μm and furthermore preferably from 2.0 to 4.0 μm. When the layer thickness is too thick, the layer thickness is too thick, cracking o peeling of the layer tends to occur, the residual voltage tends to rise significantly, or the surface texture tends to be uncontrollable due to occurrence of layer application deficiency. To the contrary, when the layer thickness is too thin, the surface texture of the present invention tends to hardly obtain and layer application deficiency tends to occur.

In addition, when the layer thickness of the protection layer is too thin, part of the protection layer may not be sufficiently covered with the protection layer in the lower limit range of the surface roughness.

In the present invention, the binder resin that is contained in the protection layer as the uppermost layer is a curing resin. Therefore, the protection layer is not soluble in an organic solvent. In the method of testing the solubility of the protection layer in an organic solvent, a droplet of an organic solvent that has a highly dissolution property, such as tetrahydrofuran, and dichloromethane, is dropped onto the surface of an image bearing member and subsequent to natural drying, the change of the form of the surface of the image bearing member is observed by a stereomicroscope for determination. The image bearing member that is dissolved in an organic solvent changes such that concave portions are formed at the center portion of the droplet with the surrounding portion thereof swollen, the charge transport material precipitates, which causes clouded, and the surface swells and then shrinks, which causes wrinkle. By contrast, the image bearing member that is not dissolved in an organic solvent is free from such phenomena and remains unchanged to the droplet of the organic solvent.

To make the protection layer insoluble in an organic solvent in the structure of the present invention, the following is suitably controlled in combination: (1) the composition of the liquid application of the protection layer and its content ratio; (2) dilution solvent of the liquid application for the protection layer and adjustment on the density of the solid portion, (3) selection of application method of the protection layer; and (4) control of the curing condition of the protection layer.

With regard to the composition of the liquid application for the protection layer, in addition to the fillers, the polymerizable compounds having no charge transport structure, and the polymerizable compounds having a charge transport structure specified above, when binder resins having no polymerizable functional groups, anti-oxidants, compounds having an alkyl amino group, and additives such as plasticizers and leveling agents are added in a large amount, the cross-linking density decreases, or phase separation occurs between the cured material obtained in the reaction and the additives, which causes the protection layer soluble in an organic solvent.

To be specific, it is preferable to limit the total content of the materials specified above to not greater than 20% by weight based on the total solid portion of the liquid application.

In addition, to prevent thin cross-linking density, the total content of one or two polymerizable monomers, polymerizable oligomers, or polymerizable polymers, is preferably limited to not to greater than 20% by weight based on polymerizable compounds having three functional groups.

Furthermore, when a polymerizable compound having a two or more functional groups with a charge transport structure is contained in an excessive amount, the bulky structure body is fixed in the cross-linked structure by multiple bondings, which tends to cause distortion, thereby forming an aggregation of minute cured materials.

As a result, the protection layer may become soluble in an organic solvent. Depending on the structure of a compound, the content of the polymerizable compound having two or more functional groups with a charge transport structure is preferably limited to not greater than 10% by weight based on the polymerizable compound having one functional group.

The protection layer is not cured completely when heating or an optical irradiation energy is too low and therefore the solubility of the obtained protection layer becomes high. To the contrary, when the protection layer is cured with high energy, the curing reaction proceeds unevenly, thereby increasing non-cross-linked portions, or radical termination portions, or forming collectives of minute cured materials. As a result, the protection layer may become soluble in an organic solvent. To make the protection layer in soluble in an organic solvent, for example, an air blow type oven is suitably used as a heating device when the protection layer is thermally cured. The curing condition is from 100 to 170° C. for 10 minutes to 3 hours. The curing condition for UV optical irradiation is from 50 to 1,000 mW/cm$^2$ for 5 seconds to 5 minutes while controlling the temperature to not greater than 50° C. to prevent uneven curing reaction. The drum temperature is controlled not to be higher than 50° C. In addition, the curing reaction is suitably followed by heating at 100 to 150° C. for 10 to 30 minutes to reduce the amount of the residual solvent.

Next, the case in which urethane resin is used as a curable resin is described below. Known urethane resins can be used. Urethane resins are excellent in abrasion resistance and preferably used as the protection layer in the present invention.

Urethane resins have a high abrasion resistance, excellent electrostatic characteristics, and a high layer quality. Therefore, the urethane resins are suitable to improve the durability of an image bearing member and the image quality. Urethane resins are formed by, for example, a combination of a polyol as an active hydrogen component, and a multi-valent isocyanate as a curing agent. Known polyols can be used and specific examples thereof include, but are not limited to, polyether polyols such as polyaklylene oxide, polyester polyols such as aliphatic polyesters having a hydroxyl group at its end, acryl based polymer polyols such as a copolymer of hydroxymethacrylate, epoxy polyols such as epoxy resins, polyols having fluorine, and polycarbonate diols having a polycarbonate skeleton. In addition, Japanese patent No. 3818584 describes a technology of preventing deterioration of a cured resin, or reducing a decrease in the resolution of an image bearing member by using a polyol having a hindered amine skeleton. This can be also preferably used in the present invention.

Hindered amine is known as a light stabilizer or an antioxidant. By curing a polyol having this structure, the hindered amine structure can be introduced into the cured resin, which improves stabilization effect.

In addition, two or more kinds of these can be mixed for use.

The structure of the hindered amine is illustrated below.

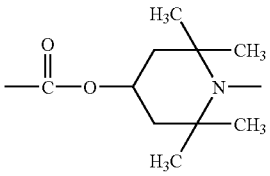

The polyols have two or more functional groups and more preferably three or more functional groups, thereby making a strong and firm three dimensional network structure. Consequently, the curing property is improved and the strength of the layer is improved. Polyols having a molecular weight of from 100 to 150 are widely used. However, the volume shrinks severely depending on the curing condition, which leads to degradation of the layer quality. In this case, Japanese patent No. 3818585 describes a technology to relax the volume shrinkage during the curing reaction for which a polyol having a molecular weight of 1,000 or more is separately added.

Typical isocyanate material is usable as the polyvalent isocyanate of the curing agent. However, an isocyanate that does not cause a change in color of the layer over time is preferable. Specific examples of the multi-valene disocyanates include, but are not limited to, isocyanate compounds such as trilene diisocyanate (TDI), diphenylmethane diisocyanate (MDI), xylene diisocyanate (XDI), hexamethylene diisocyanate (HDI), isophorone diisocyanate (IPDI), bis (isocyanate methyl)cyclohexane (HDXI), trimethylhexamethylene diisocyanate (TMDI), polyisocyanates such as an adduct of HDI-trimathylol propane, HDI-isocyanate, HDI-biulet, an adduct of XDI-trimethylol propane, an adduct of IPDI-trimethylol propane, and IPDI-iscyanulate. As isocyanates having an amide bond for use in the present invention, an adduct of HDI-trimethylol propane, an adduct of IPDI-trimethylol propane, and HDI-biulet are used alone or in combination.

With regard to the polymerizable compound having a charge transport structure, any known materials can be used as long it has the charge transport structure as described above and a functional group reactive with isocyanate group, etc. in the same structure.

The charge transport structure is any of a positive hole transportability, an electron transportability or both as described above. Among these, compounds having a triarylamine structure are particularly preferable. In addition, hydroxyl group is generally used as a functional group for use in the curing reaction. Preferably, at least two hydroxyl groups are contained in the structure, thereby forming a three dimensional network structure.

Specific examples of polymerizable compounds having the triphenyl amine structures include, but are not limited to, the following: These structures are for the illustration purpose only and the present invention is not limited thereto.

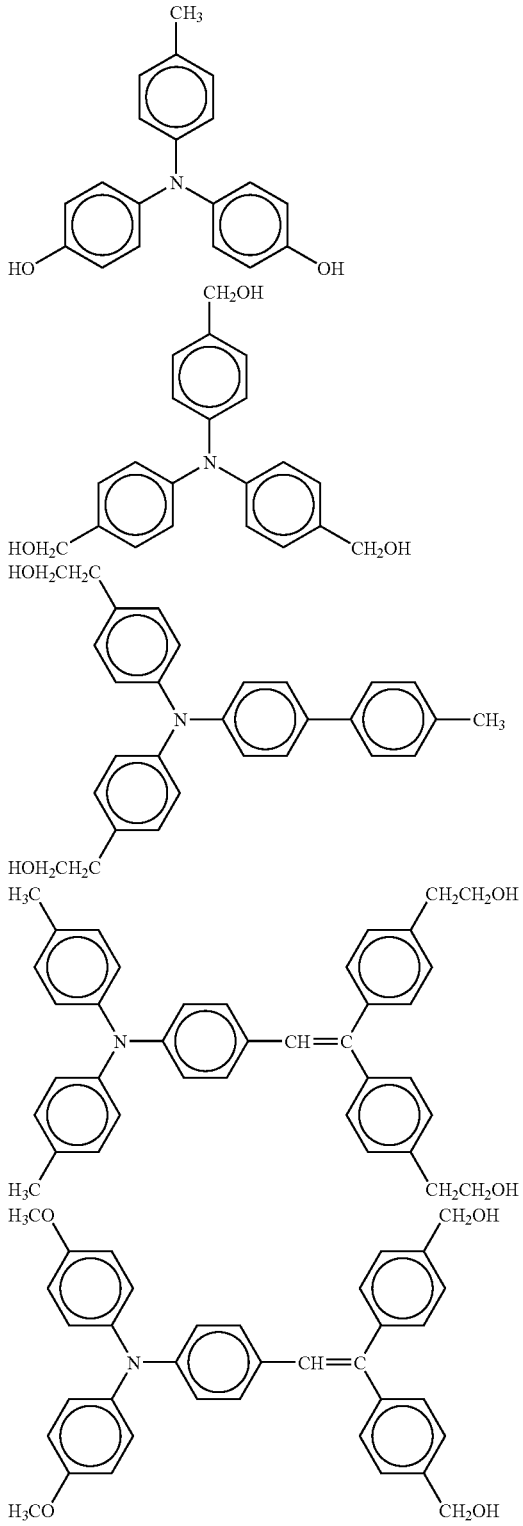

-continued

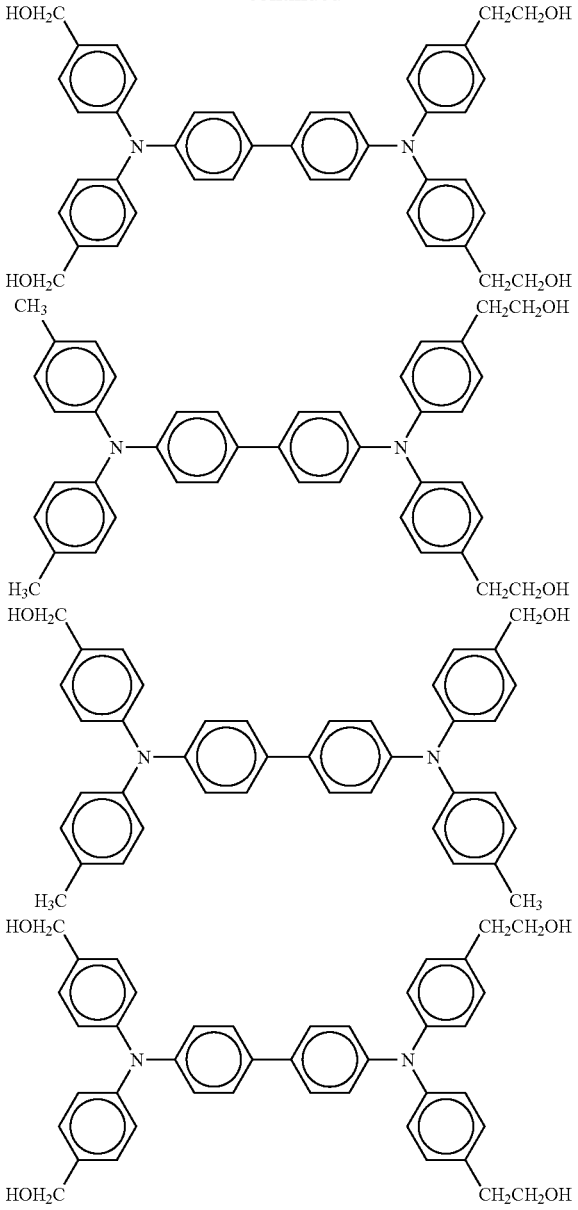

Next, the case in which a curable siloxane resin is used as a curable resin is described below. Known siloxane resins are used. Urethane resins are excellent in abrasion resistance and preferably used as the protection layer.

The curable siloxane resins are curable resins having a three dimensional network structure formed by conducting reaction (hydrolytic reaction, reaction using a catalyst or a cross-linking agent) of monomers, oligomers, or polymers having a silixane bonding in their structure unit. In general, the siloxane bonding in organic silicone compounds having a siloxane bonding is accelerated by hydrolytic reaction followed by dehydration condensation to obtain a three dimensional network structure. Thus, a cured resin layer formed of the silioxane resin is obtained. For example, the three dimensional network structure is formed to obtain the cured layer by the dehydration condensation reaction by a composition formed of alkoxy silane, or a composition formed of alkoxy silane and colloidal silica.

In general, the curable siloxane resin described above is formed by a material such as an organic silicon compound having a hydroxyl group or a hydrolytic group.

Specific examples of the hydrolytic group in the organic silicon compound having a hydroxyl group or a hydrolytic group include, but are not limited to, a methoxy group, an ethoxy group, a methylethylketoxime group, a diethylamino group, an acetoxy group, a propenoxy group, a propoxy group, a buthoxy group, and a methoxyethoxy group. Among these, hydrolytic groups represented by —OR are preferable. R represents an atomic group forming an alkoxy group and preferably the number of carbon atoms is from 1 to 6.

Generally, the organic silicon compound used as the material for the curable siloxane resin is different in reactivity depending on the number of the hydrolytic groups bonded with a silicon atom. When the number of the hydrolytic groups is one, the cross linking density is small, meaning that curing is not sufficient. Therefore, polymerization reaction of the organic silicon compound can be restrained. When the number is 2, 3 or 4, polymerization reaction easily occurs. The cross-linking reaction can be highly accelerated particularly when the number is 3 or 4.

However, although the hardness of the layer is sufficient, it may be brittle. Therefore, it is preferable to mix a component having a relatively few number of hydrolytic groups and a component having a relatively large number of hydrolytic groups. In addition, as the material for the siloxane resins, a hydrolytic condensation compound oligomized by hydrolytigation under the acid or basic condition can be also used.

With regard to the polymerizable compound having a charge transport structure, any known material can be used as long it has a charge the transport structure and a functional group to conduct curing reaction with a siloxane resin described above in the same structure. The charge transport structure may have either or both of a positive hole transportability and an electron transportability as described above. Among these, compounds having a triarylamine structure are particularly preferable. Hydroxyl group, amino group, mercapto group, and alkoxy silyl group are generally used as the functional group to conduct the curing reaction.

Next, the case in which a phenolic resin (curable phenolic resin) is used as a curable resin is described below. Known phenolic resins can be used. Phenolic resins are excellent in abrasion resistance and preferably used as the protection layer.

The curable phenolic resin is typically obtained by the reaction between a phenol and a formaldehyde. The phenolic resins are typified into two types. One is resol-type phenolic resin which is obtained by conducting reaction between a phenol with an excessive formaldehyde in the presence of an alkali catalyst and, the other, novolac-type phenolic resin which is obtained by conducting reaction between an excessive phenol with a formaldehyde in the presence of an acid catalyst.

The resol-type phenolic resin is soluble in a solvent such as an alcohol or a ketone, and cured by cross-linking polymerization in a three dimensional manner upon application of heat.

By contrast, the novolac-type phenolic resin is not generally cured upon application of heat but can be cured by adding a formaldehyde such as paraformaldehyde or hexamethylene tetramine with heating.

Both phenolic resin types can be use as the phenolic resin in the present invention. Resol type is preferable in terms of one liquid property and operation property as liquid application. The resol-type phenolic resin is soluble in a solvent such as an alcohol or a ketone, and cured by cross-linking polymerization in a three dimensional manner upon application of heat. In addition, these phenolic resins can be used alone or in combination (mixtures of two or more kinds, including a mixture of a resol type and a novolac type)).

With regard to the reactive compound having a charge transport structure, any known materials can be used as long it has a charge transport structure and a functional group that conducts curing reaction with a phenolic resin as described above in the same structure. The charge transport structure is either or both of a positive hole transportability, and an electron transportability as described above. Among these, compounds having a triarylamine structure are particularly preferable. Hydroxyl group, carboxyl group, alkoxy silyl group, epoxy group, carbonate group, thiol group, amino group, etc. are generally used as the functional group to conduct the curing reaction.

As described above, any curable resins can be suitably used. These protection layers can contain the various kinds of additives such as polymerization initiators, cross linking agents, plasticizers, leveling agents, compounds having slkyl amino groups, anti-oxidants, charge transport materials having a low molecular weight without radical polymerization property as described above.

In addition, any known curing methods described above can be used to manufacture the image bearing member of the present invention.

An example of the surface texture of the protection layer in the present invention is described. The surface of the protection layer described in the present invention has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

The present invention relates to the microscopic roughness and the macroscopic roughness as described above.

The microscopic roughness is achieved when the filler is contained. This affects little to the parameters of the surface roughness. However, the macroscopic roughness has an impact on improvement in cleaning ability, filming prevention effect and its sustainability.

The surface of the protection layer described in the present invention is found to have significant improvement by having an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

The arithmetical mean waviness Wa obtained from the waviness profile described above is from 0.05 to 0.3 μm, preferably from 0.10 to 0.27 μm, and more preferably from 0.13 to 0.25 μm. When Wa is too small, the behavior of a cleaning blade tends to be so unstable that the toner easily slips through the blade, resulting in degradation of the cleaning performance.

In addition, the charging roller may be contaminated, or filming may occur. By contrast, when Wa is too large, the layer thickness difference of the surface layer tends to increase, which may lead to production of abnormal images caused by uneven image density, dot dust, etc. In the present invention, the average length WSm of profile components is relatively large. Therefore, this impact tends to rise to the surface.

The average length WSm of the profile components obtained from the waviness profile is from 0.5 to 1.5 mm, preferably from 0.6 to 1.3 mm and more preferably from 1.7 to 1.2 mm. When WSm is too small, the uniformity of the lubricant material tends to deteriorate, abrasion of the cleaning blades is easily accelerated, the cleaning ability easily deteriorates, filming easily occurs, etc. By contrast, when WSm is too large, the toner tends to slip through the cleaning blade, resulting in bad cleaning performance, and uneven image density and dot dust resulting from the layer thickness difference of the surface layer begins to rise to the surface.

The arithmetical mean waviness Wa and the average length WSm of profile components in the present invention are based on JIS B061-2001 {Geometrical Product Specifications (GPS)—Surface texture: Profile method—Terms, definitions and surface texture parameters}. Profile is a collective terms for total profile, primary profile, roughness profile and waviness profile. Roughness profile is a curve obtained by removing (cutting off) the waviness component with λc profile filter and waviness profile is a curve obtained by removing (cutting off) the wavelength component longer and shorter than the waviness component from the primary profile. The wavelength component longer than the waviness component is removed by λf profile filter and the wavelength component shorter than the waviness component is removed by λc profile filter. The primary profile, the roughness profile, and the waviness profile are represented by cut-off values (wavelength removed by filter) by the two filters of a low range (passing) filter and a high range (passing) filter for the range of the passing wavelength.

In the present invention, a λc profile filter, which defines the border between the roughness component and the waviness component, is 0.25 mm and the wavelength component shorter than 0.25 mm is cut off. A λf profile filter, which defines the border between the waviness component and the wavelength component longer than that, is 2.5 mm in the present invention.

In the present invention, the arithmetical mean waviness Wa and toe average length WSm of profile components are measured by Surfcom 1400D (manufactured by TOKYO SEIMITSU CO., LTD.). Any other measuring instrument corresponding thereto can be used. In addition, the evaluation length is set to be 5 times as much as λf, i.e., 12.5 mm. Measuring can be performed along the axis direction or the peripheral direction of an image bearing member. The values obtained in both directions are significantly the same in the present invention. With regard to the measuring along the peripheral direction, the curvature component is required to be removed. Measuring should be conducted multiple times for averaging to reduce the measuring error. In the present invention, measuring is conducted at three portions, which are the center portion of an image bearing member, the center portion of the range including the top end to the center portion of the image bearing member, and the center portion of the range including the bottom end to the center portion of the image bearing member. Furthermore, in each portion, four points are measured by rotating the image bearing member about a right angle. 12 points are measured on the whole and the average thereof is obtained.

There are known methods for controlling the form (texture) of the surface layer of an image bearing member. For example, JP S52-026226-A and Japanese patent No. 4056097 describe a method of adding a filler, and adjusting the surface roughness by the particle diameter and the addition amount thereof, JP H02-139566-A and 2006-301092-A describe a method of performing grinding after application of a surface layer, and JP H02-150850 and Japanese patent No. 3938210 describe a method of mechanically forming the surface roughness using sand blast, etc.

However, although minute roughness can be obtained by the surface control using a filler, large waviness can be difficult to form as in the present invention. In addition, in the method of mechanical forming the surface roughness, forming waviness is difficult and a streaked or dimpled surface is obtained instead.

A dip coating method, a ring coating method, a roll coating method, a spray coating method, etc. are typically used to form a surface layer. When a liquid application is applied using such a method, a layer having a smooth surface is obtained and thus, a surface layer having a large waviness is difficult to obtain.

By contrast, in the present invention, as a result of an intensive study by the inventors, it is found that a surface layer having a large waviness is formed by suitably controlling prescription of a liquid application, or the application conditions using a spraying method. Waviness form in the spray coating method can be controlled by spraying application conditions such as fogging air pressure during spray application, the amount of a liquid application, the gap between a spraying gun and a substrate, and the number of timed of application. In addition, a solvent or air can be sprayed after spray coating to form waviness. When waviness is controlled by prescription of the liquid application, waviness is controlled by the kind or the addition amount of the leveling agent or the solvent in the liquid application, or the density of the solid portion in the liquid application. Waviness can be effectively controlled by a combination of the prescription of a liquid application and a spray coating method.

A specific example of the method of controlling waviness is described but the method of controlling waviness is not limited thereto. When a surface layer is formed by a spray coating method and waviness is controlled, any spray gun is usable. An spray gun that controls the spitting amount of a liquid application, the amount of fogged air flow, the air pressure for fogging, etc. is preferable. Specific examples of such an air gun includes, but are not limited to, an air spray, an airless spray, or an electrostatic spray. A horizontal or upright type spray can be used. In the present invention, an air spray A100 (manufactured by Meiji Machine Co., Ltd.) is used for application of liquid.

Figure 10:
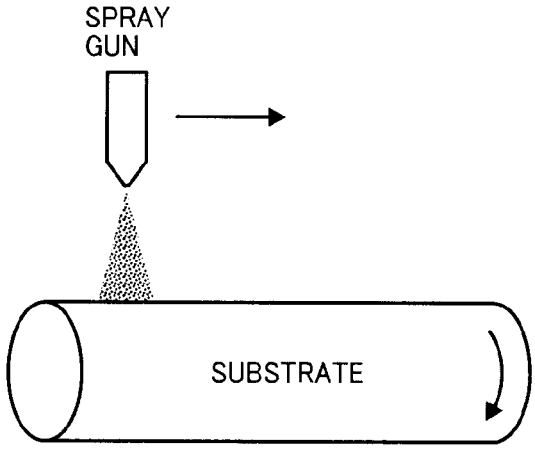
FIG. 10 is a diagram illustrating spray coating for the surface layer.

FIG. 10 is a schematic diagram illustrating spray coating. In FIG. 10, the substrate represents a product in an image bearing member manufacturing stage in which a photosensitive layer is applied to a supporting member. The supporting member has a cylindrical form. The substrate is rotated by a driving force (not shown) in the direction indicated by an arrow and the spray gun coats a liquid application for a surface layer to the substrate while fogging the liquid. The spray gun slowly moves slowly from the left end of the substrate in the direction indicated by an arrow to apply the liquid application for a surface layer all over the substrate. There is no specific limit to the number of application times of the liquid application for a surface layer.

Also, there is no specific limit to the moving speed of the spray gun and the number of rotation of the substrate. The moving speed of the spray gun is preferably not faster than 10 mm/s and the number of rotation of the substrate is preferably not less than 80 rpm. The gap between the spray gun and the substrate is preferably from 20 to 100 mm and more preferably from 30 to 70 mm. When the gap is too narrow, uneven application is likely to occur since the gap between the spray gun and the substrate. When the gap is too wide, attachment ratio tends to be low although depending on the kind of the spray gun. In addition, when the gap between the spray gun and the substrate is wide, the solvent in the fogged liquid droplets spitted from the spray gun easily evaporates, thereby reducing the size of the droplets. Therefore, waviness is difficult to form.

The spitting amount of a liquid application is preferably 0.02 ml/s or larger. When the spitting amount is too small, the droplets tend to be narrow. The spitting amount is controlled by controlling the nozzle open degree of the spray gun, the extrusion amount of the syringe pump, etc.

In addition, a solvent or air can be sprayed in a wet state obtained immediately after the liquid application is sprayed to form waviness. When a solvent is sprayed, there is no specific limit to the kind of the solvent but a solvent having a low boiling point is preferable so as not to make the solvent remain on the surface of the applied layer after spraying.

In addition, since a cross-linkable resin is used in the present invention, a process of cross-linking the applied layer is required after spray application. The time of set-to-touch to be taken from spray coating to cross-linking is preferably 10 minutes or less. When the set-to-touch time is long, the applied layer is levelized so that waviness decreases or disappears in some cases.

Undercoating Layer

In the image bearing member of the present invention, an undercoating layer can be provided between the electroconductive substrate and the photosensitive layer. Typically, such an undercoating layer is mainly made of a resin. Considering that a photosensitive layer is applied to such an undercoating layer (i.e., resin) in a form of solvent, the resin is preferably hardly soluble in a known organic solvent.

Specific examples of such resins include, but are not limited to, water soluble resins such as polyvinyl alcohol, casein, and sodium polyacrylate, alcohol soluble resins such as copolymer polyamide (copolymerized nylon) and methoxymethylized polyamide (nylon) and curable resins which foil a three dimensional mesh structure, such as polyurethane, melamine resins, phenolic resins, alkyd-melamine resins, isocyanates and epoxy resins.

In addition, inclusion of metal oxides in the undercoating layer is suitable to prevent the occurrence of moiré fringe and reduce the residual voltage. The moiré fringe is a kind of image deficiency caused by an interference pattern referred to as a moire due to the optical interference occurring inside the photosensitive layer when an image is written by a coherent light beam such as a laser beam. Basically, the moiré fringe is prevented because the undercoating layer scatters the incident laser beam. Therefore, the undercoating layer contains a material having a large refraction index. A structure in which an inorganic pigment is dispersed in a binder resin is most suitable to prevent moiré fringe. One of usable inorganic pigments is white pigment and specific examples thereof include, but are not limited to, metal oxide such as titanium oxide, zinc oxide, calcium fluoride, silicon oxide, magnesium oxide, aluminum oxide, tin oxide, zirconium oxide, and indium oxide.

Furthermore, the undercoating layer preferably has a function of transferring charges having the same polarity as that of the charges on the surface of an image bearing member from the charge generation layer to the electroconductive substrate to reduce the residual voltage and the inorganic pigment mentioned above bears that function. For example, when an image bearing member of a negative charging type is used, the undercoating layer can reduce the residual voltage by having an electron conductivity. The metal oxides mentioned above are suitably used as these inorganic pigments. However, although the residual voltage is reduced by the existence of inorganic pigments having a low resistance and an increase in the addition ratio thereof, the background fouling may worsen. Therefore, the layer structure and the layer thickness of the undercoating layer in an image bearing member and an addition amount of the inorganic pigments is adjusted to have a good combination between the reduction on the background fouling and the residual voltage. In consideration of prevention of moiré fringes, an increase of the residual voltage, background fouling, and charging reduction in the first round, titanium oxide is most suitable among the metal oxides mentioned above.

Such an undercoating layer is mainly formed of a binder resin, and an inorganic pigment (metal oxide) and a liquid dispersion for application is obtained by wet dispersion in a state in which a solvent is contained. Acetone, methylethylketone, methanol, ethanol, butanol, cyclohexanone, dioxane and a sovent mixture thereof are suitably used as the solvent. The inorganic pigments are dispersed with a binder resin in a solvent by a typical method using such as a ball mill, sand mill, and an attritor to prepare the liquid application. The binder resin can be added before dispersion and after dispersion as a resin solution. In addition, an agent, an additive, a curing promoter, etc. can be optionally added for curing (cross-linking) and a dispersion agent can be added to improve the dispersion property of the inorganic pigment. Using such a liquid application, the undercoating layer is formed on an electroconductive substrate using a known method such as a dip coating method, a spray coating method, a ring coating method, a bead coating method and a nozzle coating method. After application of the liquid, the undercoating layer is formed by optional curing treatment such as light irradiation for drying or curing. The layer thickness of the undercoating layer varies depending on the kind of the inorganic pigment contained therein and is preferably from 0 to 20 μm and more preferably from 2 to 10 μm.

In addition, an intermediate layer can be provided between the electroconductive substrate and the undercoating layer or the undercoating layer and the photosensitive layer. The intermediate layer is provided to reduce the infusion of positive holes from the electroconductive substrate and the main purpose of the intermediate layer is to prevent the background fouling. Generally, the intermediate layer is mainly formed of a binder resin. Specific examples of the resins include, but are not limited to, polyamide, alcohol soluble polyamide (soluble nylon), water soluble polyvinylbutyral, polyvinyl butyral, and polyvinyl alcohol. The method described above and known application methods are employed as the intermediate layer formation method. The layer thickness of the intermediate layer is suitably from about 0.05 to 2 μm. By having a two layer structure of the intermediate layer and the undercoating layer, the effect of reducing the background fouling drastically increases but the residual voltage also tends to increase. In addition, due to this two layer structure of the intermediate layer and the undercoating layer, the charge of the first round tends to decrease. Therefore, this two layer structure is determined taking into consideration the composition and the layer thickness of the intermediate layer and the undercoating layer.

In the present invention, an anti-oxidizer, a plasticizer, a lubricant, an ultraviolet absorber, a leveling agent, etc. can be added to at least one layer of the charge generation layer, the charge transport layer, the single layered photosensitive layer, the undercoating layer, the intermediate layer and the protection layer to improve the environmental resistance, particularly to prevent the degradation of sensitivity, the rise in residual potential and the reduction on charging. The following materials are typically used for these compounds.

Specific examples of the anti-oxidizers that can be added to each layer include, but are not limited to, the following.

(a) Phenol Compounds 2,6-di-t-butyl-p-cresol, butylated hydroxyanisol, 2,6-di-t-butyl-4-ethylphenol, n-octadoyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

(b) Paraphenylene Diamines

N-phenyl-N'-isopropyl-p-phenylenediamine, N,N'-1-sec-butyl-p-phenylenediamine, N-phenyl-N-sec-butyl-p-phenylenediamine, N,N'-1-isopropyl-p-phenylenediamine, and N,N'-dimethyl-N,N'-di-t-butyl-p-phenylenediamine.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(d) Organic Sulfur Compounds dilauryl-3,3-thiodipropionate, distearyl-3,3'-thiodipropionate, and ditetradecyle-3,3□ f-thiodipropionate.

(e) Organic Phosphorous Compounds triphenyl phosphine, tri(nonylphenyl)phosphine, tri(dinonylphenyl)phosphine, tricresyl phosphine, and tri(2,4-dibutylphenoxy)phosphine.

Specific examples of the plasticizers that can be added to each layer include, but are not limited to, the following (a) Phosphoric Ester Based Plasticizer Triphenyl phosphate, tricresyl phosphate, trioctyl phosphate, octyldiphenyl phosphate, trichloroethyl phosphate, cresyl diphenyl phosphate, tributyl phosphate, tri-2-ethylhexyl phosphate, and triphenyl phosphate.

(a) Phthalic Ester Based Plasticizer

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzil phthalate, butyllauryl phthalate, methyloleyl phthalate, octyldecyl phthalate, dibutyl fumarate, and dioctyl fumarate.

(c) Aromatic Carboxyl Ester Based Plasticizer

Trioctyl trimellitic acid, tri-n-octyl trimellitic acid, and octyl oxybenzoate.

(d) Aliphatic Dibasic Acid Ester Based Plasticizer

Dibutyl adipate, n-hexyl adipate, di-2-ethylhexyl adipate, di-n-octyl adipate, n-octyl-n-decyl adipate, diisodecyl adipate, dicapryl adipate, di-2-ethyl-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophyalate, and di-n-octyl tetrahydrophtalate.

(e) Aliphatic Ester Derivative

Butyl oleate, glycerin monoloeic acid ester, methyl acetyl ricinolate, pentaerythritol ester, dipentaerythritol hexaester, and triacetine, and tributyrin.

(f) Oxic Acid Ester Based Plasticizer

Methyl acetyl ricinoleate, butyl acetyl ricinoleate, butylphthalyl butyl glicolate, and tributyl acetyl citrate.

(g) Epoxy Plastic Agent

Epoxidized soy bean oil, epoxidized linseed oil, butyl epoxy stearate, decyl epoxy stearate, octyl epoxy stearate, benzyl epoxy stearate, dioctyl epoxy hexahydrophthalate, and didecyl epoxyhexahydrophyalate.

(h) Diol Ester Based Plasticizer

Diethylene glycol dibenzoate, and triethylene glycol di-2-ethyl butylate.

(i) Choline Containing Plasticizer

Chlorinated paraffin, chlorinated diphenyl, chlorinated aliphatic methyl, and methoxychlorinated aliphatic methyl.

(j) Polyestel Based Plasticizer

Polypropylene adipate, polypropylene cebacate, polyester, and acetylized polyester.

(k) Sulfuric Acid Derivatives p-toluene sulfone amide, o-toluene sulfone amide, p-toluene sulfone ethyl amide, o-toluene sulfone ethyl amide, toluene sulfone-N-ethyl amide, and p-toluene sulfone-N-cyclohexyl amide.

(i) Citric Acid Derivatives

Triethyl citrate, triethyl acetyl citrate, tributyl citrate, tributyl acetyl citrate, tri-2-ethyl hexyl acetyl citrate, and acetyl citrate-n-octyl decyl.

(m) Others

Terphenyl, partially hydrogenerated terphenyl, camphort, 2-nitrodiphenyl, dinonyl naphthaline, and methyl abietate.

Specific examples of the lubricants that can be added to each layer include, but are not limited to, the following.

(a) Hydrocarbon Compounds

Liquid paraffin, paraffin wax, microwax, and low polymerized polyethylene.

(d) Aliphatic Compounds

Lauric acid, myristic acid, paltimic acid, stearic acid, arachidic acid, and behenic acid.

(c) Aliphatic Amide Based Compound

Stearyl amide, palmitic amide, oleic amide, methylene bisstearoamide, and ethylene bisstaroamide.

(d) Esterified Compounds

Lower alcohol ester of an aliphatic acid, multi-valent alcohol ester of an aliphatic acid, and aliphatic acid polyglycol esters.

(e) Alcohol Based Compounds

Cetyl alcohol, stearyl alcohol, ethylene glycol, polyethylene glycol, and polyglycerol.

(f) Metal Soap

Lead stearate, cadmium stearate, barium stearate, calcium stearate, zinc stearate, and magnesium stearate.

(g) Natural Wax

Carnauba wax, candelila wax, bees wax, whale wax, insect wax and montar wax (h) Others Silicone Compounds, and Fluorinated Compounds Specific examples of the ultraviolet absorber that can be added to each layer include, but are not limited to, the following.

(a) Benzophenones 2-hydrosybenzophenone, 2,4-dihydroxybenzophenone, 2,2',4-trihydroxybenzophenone, 2,2',4,4'-tetrahydroxy benzophenone, and 2,2'-dihydroxy-4-methoxy dibenzophenone.

(b) Salicylates

Phenylsalicylate, and 2,4-di-t-butylphenyl-3,5-di-t-butyl-4-hydroxybenzoate.

(a) Benzotriazoles (2'-hydroxyphenyl)benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole.

(d) Cyanoacrylates

Ethyl-2-cyano-3,3-diphenylacrylate, and methyl-2-carbomethoxy-3(paramethoxy)acrylate.

(e) Quenchers (Metal Salts)

Nickel (2,2'-thiobis(4-t-octyl)phenolate)normalbutyl amine, nickeldibutyldithiocarbamate, nickel dibutyldithiocarbamate, and cobalt dicyclohexyldithiophosphate.

(f) HALS (Hindered Amines)

Bis(2,2,6,6-tetramethyl-4-piperidyl)cebacate, bis(1,2,2,6,6-pentamethyl-4-piperidyl)cebacate, 1-[2-[3-(3,5-di-t-butyl-4-hydroxyphenyl)propionyloxy]ethyl]-4-[3-(3,5-di-t-butyl-4-hydroxyphenyl)propionyloxy-2,2,6,6-tetramethyl pyridine, 8-benzil-7,7,9,9-tetramethyl-3-octyl-1,3,8-triazaspiro[4,5]undecane-2,4-dione, and 4-benzoyloxy-2,2,6,6-tetramethyl piperidine Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Titanylphthalocyanine Crystal

The method of synthesizing titanyl phthalocyanine crystal for use in the present invention is described below. Titanyl phthalocyanine is synthesized according to JOP 2004-83859. 292 parts of 1,3-diiminoisoindoline and 1,800 parts of sulfolane are mixed and 204 parts of titanium tetrabuthoxido is dropped thereto in nitrogen atmosphere. Thereafter, the temperature is raised to 180° C., and the resultant is stirred to conduct reaction for 5 hours while the reaction temperature is maintained in a range of from 170 to 180° C. After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine. The coarse titanyl phthalocyanine is dissolved in strong sulfuric acid the amount of which is 20 times as much as that of the titanyl phthalocyanine. The resultant is dropped to iced water the amount of which was 100 times as much as the resultant. The precipitated crystal is filtered and washed with de-ionized water (pH: 7.0, specific conductivity: 1.0 μS/cm) repeatedly until the washing water indicates neutral (the pH of the de-ionized water after washing is 6.8 and the specific conductivity thereof is 2.6 μS/cm). Thus, a wet cake (water paste) of titanyl phthalocyanine pigment is obtained.

40 parts of the thus obtained wet cake (water paste) is put in 200 parts of tetrahydrofuran and vigorously stirred with HOMOMIXER (MARKII f model, KENIS, Ltd.) (at 2,000 rpm) at room temperature until the color of the paste changed from navy blue to light blue (20 minutes after initiation of stirring), followed by immediate filtration with a reduced pressure. The crystals on the filtration device are washed with tetrahydrofuran to produce a wet cake of the pigment. The wet cake is then dried for 2 days at 70° C. under a reduced pressure (5 mmHg) to produce 8.5 parts of a titanyl phthalocyanine crystal. Hereinafter, this is referred to as "Pigment 1" The solid portion density of the wet cake was 15 weight %. The weight ratio of the solvent for crystal conversion to the wet cake is 33. No halogenated material is used in the raw material of Synthesis Example 1.

The thus obtained titanyl phthalocyanine powder measured under the following conditions has a CuKα X ray diffraction spectrum having a wavelength of 1.542 Å such that a maximum diffraction peak is observed at a Bragg (2θ) angle of 27.2±0.2°, main peaks are observed at a Bragg (2θ) angle of 9.4±0.2°, 9.6±0.2°, and 24.0±0.2°, and a peak is observed at a Bragg (2θ) angle of 7.3±0.2° as the lowest angle diffraction peak, while there is no peak between 9.4° and 7.3° and there is no peak at 26.3°. The results are shown in FIG. 9.

Measuring Conditions of X Ray Diffraction Spectrum

X ray tube: Cu
Voltage: 50 kV
Current: 30 mA
Scanning speed: 2°/minute
Scanning area: 3° to 40°
Time constant: 2 seconds Synthesis Example of Polymerizable Compound Having Charge Transport Structure The polymerizable compound having a charge transport structure for use in the present invention can be synthesized by, for example, the method described in Japanese patent No. 3164426. An example thereof is as follows.

(1) Synthesis of Hydroxyl Group Substituted Triarylamine Compound (Represented by the Following Chemical Structure B)

240 ml of sulfolane is added to 113.85 g (0.3 mol) of methoxy group substituted triarylamine compound (represented by the following chemical structure A) and 138 g (0.92 mol) of sodium iodide followed by heating to 60° C. in nitrogen atmosphere. 99 g (0.91 mol) of trimethyl chlorosilane is dropped to the liquid in one hour and the resultant is stirred at about 60° C. for four and half hours to complete the reaction. About 1.5 litter of toluene is added to the reaction liquid. Subsequent to cooling down to room temperature, the liquid is repeatedly washed with water and sodium carbonate aqueous solution. Thereafter, the solvent is removed from the toluene solution. The toluene solution is refined with column chromatography treatment {absorption medium (silica gel), development solvent (toluene: ethyl acetate=20:1)}. Cyclohexane is added to the obtained light yellow oil to precipitate crystal. 88.1 g (yield ratio=80.4%) of the white crystal represented by the following Chemical structure B is thus obtained.

Melting point: 64.0 to 66.0° C.

TABLE 1

| | Element Analysis Value (%) | | |
|---|---|---|---|
| | C | H | N |
| Measured value | 85.06 | 6.41 | 3.73 |
| Calculated value | 85.44 | 6.34 | 3.83 |

Chemical structure A

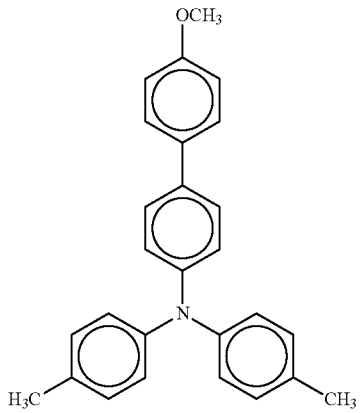

Chemical structure B

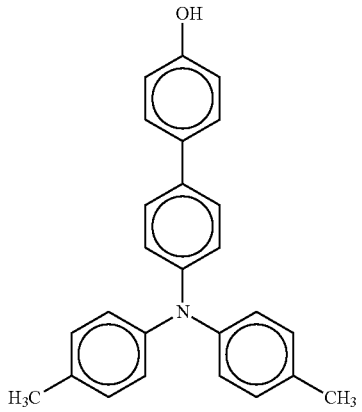

(2) Triaryl Amino Group Substituted Acrylate Compound (Illustrated Chemical Compound No. 54)

82.9 g (0.227 mol) of the hydroxy group substituted triarylamine compound (represented by the chemical structure B) obtained in (1) is dissolved in 400 ml of tetrahydrofuran and sodium hydroxide (NaOH: 12.4 g, $H_2O$: 100 ml) is dropped to the liquid in nitrogen atmosphere. The solution is cooled down to 5° C. and 25.2 parts (0.272 mol) of chloride acrylate is dropped thereto in 40 minutes. Thereafter, the solution is stirred for 3 hours at 5° C., and the reaction is terminated. The resultant reaction liquid is poured to water and extracted by toluene. The extracted liquid is repeatedly washed with sodium acid carbonate and water. Thereafter, the solvent is removed from the toluene aqueous solution and refined by column chromatography treatment (absorption medium: silica gel, development solvent: toluene). n-hexane is added to the obtained colorless oil to precipitate crystal. 80.73 g (yield ratio=84.8%) of the white crystal represented by the illustrated compound No. 54 is thus obtained.

Melting point: 117.5° C. to 119.0° C.

TABLE 2

| Element Analysis Value (%) | | | |
|---|---|---|---|
| | C | H | N |
| Measured value | 83.13 | 6.01 | 3.16 |
| Calculated value | 83.02 | 6.00 | 3.33 |

Manufacturing Example 1 of Image Bearing Member

The liquid application of a resin (in intermediate) layer, the liquid application of an undercoating layer, the liquid application of a charge generation layer, and the liquid application of a charge transport layer having the following recipes are applied to an aluminum cylinder having an outer diameter of 60 mm in this order by a dip coating method followed by drying in an oven to obtain an intermediate layer having a thickness of about 0.6 μm, an undercoating layer having a thickness of about 3 μm, a charge generation layer having a thickness of about 0.2 μm, and a charge transport layer having a thickness of about 24 μm. The drying condition for each layer is: 130° for 10 minutes for the resin (intermediate) layer; 130° C. for 20 minutes for the undercoating layer; 90° C. for 20 minutes for the charge generation layer; and 120° C. for 20 minutes for the charge transport layer.

| Liquid Application for Resin Layer | |
|---|---|
| N-methoxy methylated nylon (FR-101, manufactured by Namariichi Co., Ltd.) | 5 parts |
| Methanol | 70 parts |
| n-butanol | 30 parts |

-continued

| Liquid Application for Undercoating Layer | |
|---|---|
| Titanium oxide A (CR-EL, manufactured by Ishiahara Sangyo Kaisha Ltd.: Average primary particle diameter: | about 0.25 μm |
| Titanium oxide B (PT-401Ml, manufactured by Ishiahara Sangyo Kaisha Ltd.: Average primary particle diameter: | about 0.07 μm |
| Alkyd resin (Beckozole M6401-50, solid portion: 50% manufactured by Dainippon Ink and Chemicals, Inc.) | 14 parts |
| Melamine resin (L-145-60, manufactured by Dainippon Ink and Chemicals, Inc.; solid portion: 60%) | 8 parts |
| 2-butanone | 70 parts |
| **Liquid Application for Charge Generation Layer** | |
| Titanylphthalocyanine having an X-ray spectrum illustrated in FIG. 9 | 8 parts |
| Polyvinylbutyral (BX-1, manufactured by Sekisui Chemical Co., Ltd.) | 4 parts |
| 2-butanone | 400 parts |

The pigment mentioned above and 2-butanone solution where polyvinyl butyral is dissolved are put in a marketed bead mill dispersion device using PSZ balls having a diameter of 0.5 mm. Dispersion is performed for 30 minutes at 1,200 rpm to prepare a liquid dispersion of the charge transport layer.

| Liquid Applicatoin for Charge Transport Layer | |
|---|---|
| Polycarbonate (Z polika, manufactured by Teijin Chemicals Ltd. | 10 parts |
| Compound represented by the charge transport material (Illustrated Chemical Compound No. 14) | 10 parts |
| | 0.3 parts |

Anti-Oxidizer represented by the following chemical structure

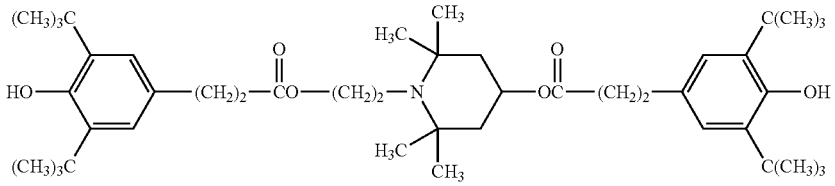

Anti-Oxidizer represented by the following chemical structure 0.3 parts

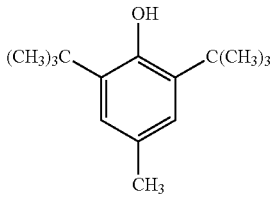

-continued

| | |
|---|---|
| Compound having an alkylamino group represented by the following chemical structure: | 0.3 parts |

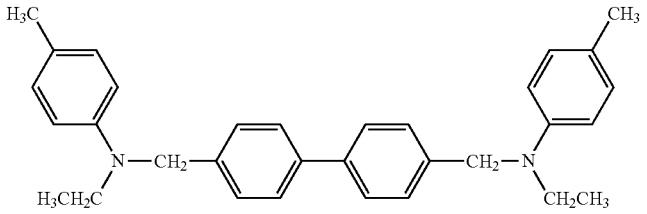

| | |
|---|---|
| Silicone oil (1 $cm^2/s$ (100 cSt) , manufactured by Shin-etsu Chemical Co., Ltd. ) | 0.002 parts |
| Tetrahydrofuran | 100 parts |

Alumina balls having a Φ of 5 mm are placed in a glass pot having a volume of 70 cc and in addition, the following filler, polycarboxylic acid compound and cyclopentanone are placed therein to conduct dispersion at 150 rpm for 24 hours by a ball mil. Thereafter, tetrahydrofuran is added thereto followed by stirring to obtain a mill base. The mill base is mixed with a solution in which other materials are preliminarily mixed to prepare the liquid application for the protection layer.

| (Mill Base) | |
|---|---|
| Alumina filler (SUMICORUNDUM AA-15, manufactured by Sumitomo Chemical Co., Ltd.; Average primary particle diameter: 0.3 μm) | 8 parts |
| Polycarboxylic acid compound (unsaturated polycarboxylic polymer having a lower molecular weight solution: BYK-P104, manufactured by BYK-Chemie U.S. Inc.; non-volatile portion: 50%) | 0.2 parts |
| Cyclopentanone | 8 parts |
| Tetrahydrofuran | 12 parts |
| Liquid Applicatoin for Protection Layer | |
| Mill Base | 3 parts |
| Radical polymerizable compound having no charge transport structure: (KAYARAD TMPTA, manufactured by Nippon Kayaku Co., Ltd., molecular weight of 296, 3 functional groups, molecular weight/number of functional groups = 99)] | 4 parts |
| Radical polymerizable compound having one functional group with a charge transport structure (Illustrated Compound No. 54) | 4 parts |
| Photo polymerization initiator {1-hydroxy-cyclohexyl-phenyl-ketone (IRGACURE 184, manufactured by Chiba Specialty Chemicals)} | 0.5 parts |
| Leveling agent (polydimethyl siloxane solution having a polyester modified acryl group: BYK-UV3510, manufactured by BYK-Chemie U.S. Inc.) Tetrahydrofuran | 0.01 parts<br>50 parts |

A protection layer is formed on the charge transport layer under the following application condition using the obtained liquid application for the protection layer by a spray coating method.

Application Condition for Protection Layer

Spray distance: 50 mm

Spray moving speed: 6 mm/s

Drum rotation speed: 140 rpm

Fogged air pressure: 1.0 $kg/cm^2$

Fogged flow amount: 15 L/s

The liquid application for protection layer is naturally dried for 10 minutes after the liquid application is applied. Thereafter, the protection layer is irradiated and cured with light emitted by a UV lamp system (manufactured by Fusion) using a metal halide lamp under the condition of an irradiation distance of 50 mm, an irradiation intensity of 500 $mW/cm^2$ and an irradiation time of 40 seconds at about 42° C. A protection layer having a thickness of about 3 μm is obtained after drying for 30 minutes at 130° C. to manufacture an image bearing member.

Manufacturing Example 2 of Image Bearing Member

Another image bearing member (Manufacturing Example 2) is manufactured in the same manner as in Manufacturing Example 1 except that toe fogging air pressure in the spray coating conditions is changed to 1.1 $kg/cm^2$.

Manufacturing Example 3 of Image Bearing Member

Another image bearing member (Manufacturing Example 8) is manufactured in the same manner as in Manufacturing Example 1 except that the fogging air pressure in the spray coating conditions is changed to 0.5 $kg/cm^2$.

Manufacturing Example 4 of Image Bearing Member

Another image bearing member (Manufacturing Example 4) is manufactured in the same manner as in Manufacturing Example 1 except that the fogging air pressure in the spray coating conditions is changed to 0.6 $kg/cm^2$.

Manufacturing Example 5 of Image Bearing Member

Another image bearing member (Manufacturing Example 5) is manufactured in the same manner as in Manufacturing Example 1 except that the fogging air pressure in the spray coating conditions is changed to 0.5 $kg/cm^2$.

Manufacturing Example 6 of Image Bearing Member

Another image bearing member (Manufacturing Example 6) is manufactured in the same manner as in Manufacturing Example 1 except that the amount of tetrahydrofuran in the liquid application for protection layer is changed to 20 parts.

Manufacturing Example 7 of Image Bearing Member

Another image bearing member (Manufacturing Example 7) is manufactured in the same manner as in Manufacturing Example 6 except that the fogging air pressure in the spray coating conditions is changed to 0.9 $kg/cm^2$.

Manufacturing Example 8 of Image Bearing Member

Another image bearing member (Manufacturing Example 8) is manufactured in the same manner as in Manufacturing Example 6 except that the fogging air pressure in the spray coating conditions is changed to 0.7 $kg/cm^2$.

Manufacturing Example 9 of Image Bearing Member

Another image bearing member (Manufacturing Example 9) is manufactured in the same manner as in Manufacturing Example 1 except that the amount of tetrahydrofuran in the liquid application for protection layer is changed to 90 parts and the fogging air pressure in the spray coating conditions is changed to 1.3 kg/cm$^2$.

Manufacturing Example 10 of Image Bearing Member

Another image bearing member (Manufacturing Example 10) is manufactured in the same manner as in Manufacturing Example 1 except that the surface of the protection layer is abraded with an abrasion sheet after the image bearing member is manufactured.

Manufacturing Example 11 of Image Bearing Member

Another image bearing member (Manufacturing Example 11) is manufactured in the same manner as in Example 3 except that the filler is changed to the following.

| | |
|---|---|
| Alumina filler (SUMICORUNDUM AA-07, manufactured by Sumitomo Chemical Co., Ltd.; Average primary particle diameter: 0.7 μm) | 8 parts |

Manufacturing Example 12 of Image Bearing Member

Another image bearing member (Manufacturing Example 12) is manufactured in the same manner as in Example 3 except that the filler is changed to the following.

| | |
|---|---|
| Alumina filler (SUMICORUNDUM AA-15, manufactured by Sumitomo Chemical Co., Ltd.; Average primary particle diameter: 1.5 μm) | 8 parts |

Manufacturing Example 13 of Image Bearing Member

Another image bearing member (Manufacturing Example 13) is manufactured in the same manner as in Example 3 except that the filler is changed to the following.

| | |
|---|---|
| Silica filler (KMPX-100, manufactured by Shin-etsu Chemical Co., Ltd., Average primary particle diameter: 0.1 μm) | 4 pars |

Manufacturing Example 14 of Image Bearing Member

Another image bearing member (Manufacturing Example 14) is manufactured in the same manner as in Example 3 except that the polycarboxylic acid compound is not added.

Manufacturing Example 15 of Image Bearing Member

Another image bearing member (Manufacturing Example 15) is manufactured in the same manner as in Example 3 except that the filler and the polycarboxylic acid compound is not added.

Manufacturing Example 16 of Image Bearing Member

Another image bearing member (Manufacturing Example 16) is manufactured in the same manner as in Manufacturing Example 15 except that the surface of the protection layer is abraded with an abrasion sheet after the image bearing member is manufactured.

Manufacturing Example 17 of Image Bearing Member

Another image bearing member (Manufacturing Example 17) is manufactured in the same manner as in Example 3 except that the radical polymerizable compound having no charge transport structure contained in the liquid application for the protection layer is reduced to a half, the following compound is added and the optical polymerization initiator is replaced with the following optical polymerization initiator.

| | |
|---|---|
| Radical polymerizable compound having no charge transport structure: (KAYARAD DPCA-60, manufactured by Nippon Kayaku Co., Ltd., molecular weight of 1,263, 6 functional groups, molecular weight/number of functional groups = 211)] | 2 parts |
| Photo polymerization initiator {2,2-dimethoxy-1,2-diphenylethane-1-one (IRGACURE 651, manufactured by Chiba Specialty Chemicals)} | 1 part |

Manufacturing Example 18 of Image Bearing Member

Another image bearing member (Manufacturing Example 18) is manufactured in the same manner as in Example 3 except that the radical polymerizable compound having no charge transport structure contained in the liquid application for the protection layer is replaced with 3 parts of the illustrated compound No. 54 having one functional group and 1 part of the following compound having two functional groups.

| | |
|---|---|
| Radical polymerizable compound having one functional group with a charge transport structure (Illustrated Compound No. 54) | 3 parts |
| Radical polymerizable compound having two functional groups with a charge transport structure represented by the following structure | 1 part |

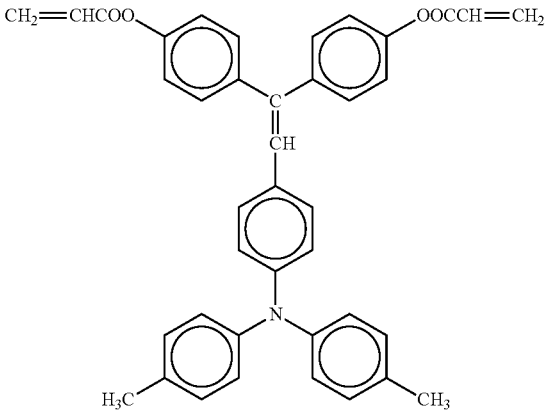

Manufacturing Example 19 of Image Bearing Member

Another image bearing member (Manufacturing Example 19) is manufactured in the same manner as in Example 3 except that the liquid application for the protection layer is changed to the liquid application for the protection layer having the following recipe with no curing treatment by optical irradiation but with heating and drying treatment at 150° C. for 20 minutes.

| Liquid Application for Protection Layer | |
|---|---|
| Mill base prepared above | 3 parts |

Isocyante: (Sumijule HT, HDI adduct) (manufactured by Sumitomo Chemical Bayer Co., Ltd.)

Polyol 1 represented by the following chemical structure

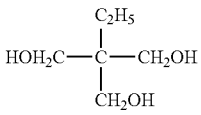

Polyol 2 (LZR170, manufactured by Fujikura Kasei Co., Ltd.)

Polymerizable compound having charge transport structure represented by the following chemical structure:

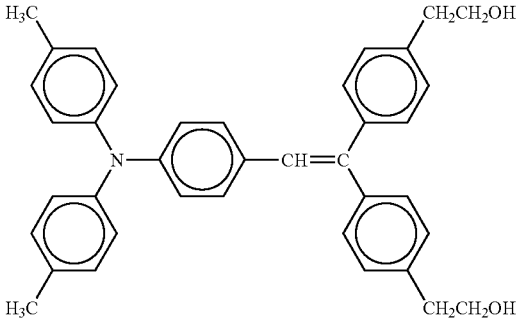

Solvent: tetrahydrofuran/cyclohexanone

Mixing Condition (Part)

Isocyanate/polyol 1/polyol 2/reactive compound having a charge transport structure/tetrahydrofuran=3/2/8/10/100/30.

Manufacturing Example 20 of Image Bearing Member

Another image bearing member (Manufacturing Example 20) is manufactured in the same manner as in Example 18 except that the filler is replaced with the following and the polymerizable compound having a charge transport structure is not added.

| | |
|---|---|
| Tin oxide filler (S-1, manufactured by Mitsubishi Material Corporation, Average primary particle diameter: 0.02 μm) | 25 parts |

Manufacturing Example 21 of Image Bearing Member

Another image bearing member (Manufacturing Example 19) is manufactured in the same manner as in Example 3 except that the liquid application for the protection layer is changed to the liquid application for the protection layer having the following recipe with no curing treatment by optical irradiation but with heating and drying treatment at 150° C. for 20 minutes.

| Liquid Application for Protection Layer | |
|---|---|
| Mill Base | 3 parts |
| Polycarbonate (Z polika, manufactured by Teijin Chemicals Ltd. | 10 parts |
| Compound represented by the charge transport material No. 17 illustrated above | 7 parts |
| Compound having an alkylamino group represented by the following chemical structure: | 1 part |

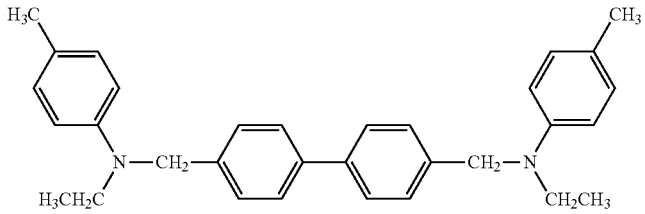

-continued

| | |
|---|---|
| Anti-Oxidizer represented by the following chemical structure | 0.3 parts |

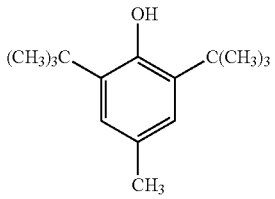

| | |
|---|---|
| Tetrahydrofuran | 500 parts |
| Cyclohexanone | 150 parts |

Manufacturing Example 22 of Image Bearing Member

Another image bearing member (Manufacturing Example 22) is manufactured in the same manner as in Example 3 except that the liquid application for the charge generation layer having the following recipe and the liquid application for the charge transport layer having the following recipe are applied to form a charge generation layer and a charge transport layer.

The following azo pigment is prepared according to the method described in Japanese patent No. 3026645. In addition, the cyclohexanone solution in which polyvinyl butyral is dissolved and the following azo pigment are put in a ball mill dispersion device using PSZ balls having a diameter of 10 mm. Dispersion is performed for 7 days at 85 rpm followed by dilution and mixing by cyclohexanone and 2 butanone to prepare a liquid dispersion for the charge transport layer.

| Liquid Application for Charge Transport Layer | |
|---|---|
| Asymmetric bisazo pigment represented by the following chemical structure | 5 parts |

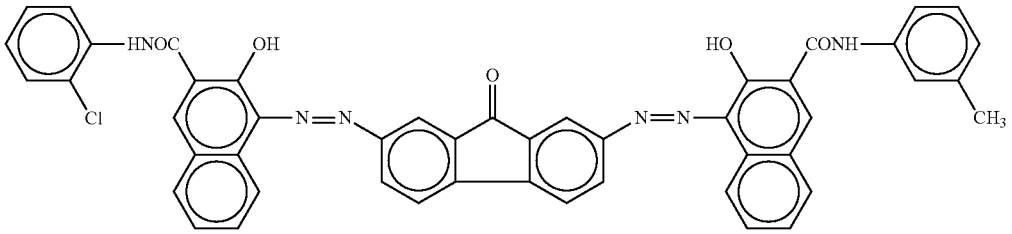

| | |
|---|---|
| Polyvinylbutyral (BM-S, manufactured by Sekisui Chemical Co., Ltd. | 1.5 parts |
| Cyclohexanone | 250 parts |
| 2-butanone | 100 parts |
| Liquid Application for Charge Transport Layer | |
| Polycarbonate (Z polika, manufactured by Teijin Chemicals Ltd.) | 10 parts |
| α-phenyl stilbene derivative represented by the following chemical structure: | 7 parts |
| Chemical structure 101 | |

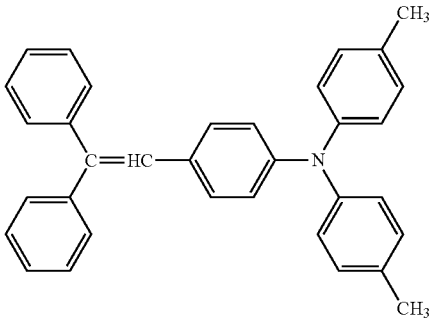

-continued

| | |
|---|---|
| Silicone oil (1 $cm^2/s$ (100 cSt), manufactured by Shin-etsu Chemical Co., Ltd.) | 0.002 parts |
| Tetrahydrofuran | 100 parts |
| Anti-Oxidizer represented by the following chemical structure | 0.03 parts |

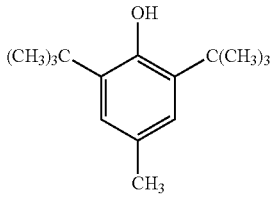

| | |
|---|---|
| Anti-Oxidizer represented by the following chemical structure | 0.07 parts |

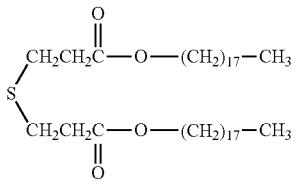

Examples 1 and 14 and Comparative Examples 1 and 8

The arithmetical mean waviness Wa and the average length WSm of profile components are measured for the thus prepared image bearing members. The measuring device is Surfcom 1400D (manufactured by TOKYO SEIMITSU CO., LTD.) and measuring is performed according to JIS B 0601: 2001.

The primary profile is measured under the following conditions: measuring length: 12.5 mm; profile filter λc: 0.25 (mm); profile filter λf: 2.5 mm; Measuring speed: 0.60 mm/s. Least square straight line compensation is selected for incline compensation.

Measuring is conducted along the axis direction of the image bearing member at three portions, which are the center portion of an image bearing member, the center portion of the range including the top end to the center portion of the image bearing member, and the center portion of the range including the bottom end to the center portion of the image bearing member. Furthermore, in each portion, four points are measured by rotating the image bearing member about a right angle. 12 points are measured on the whole and the average thereof is obtained. The results are shown in Table 4.

Images are evaluated for the image bearing members. With regard to the image evaluation and machine-running test using paper, a machine remodeled based on a digital full color photocopier (manufactured by Ricoh Co., Ltd.) is used which includes, for example, a charging device, an irradiation device, a development device, a transfer device, a fixing device, a cleaning device, a lubricant material applicator, and a discharging device with the image bearing member installed onto a process cartridge.

A scorotron charger is used for the black station, and a vicinity type charging roller is used for each of the magenta station, the cyan station and the yellow station. The charging roller is a hard resin roller having a diameter of 10 mm and the gap between the image bearing member and the roller is adjusted to be 50 μm. The charging is performed by an alternate electric field in which an AC component (sine curve) having a Vpp of 3 kV and a frequency of 1.5 kHz overlapped with a DC component of −600 V.

In addition, a semiconductor laser that emits light having a wavelength of 655 nm is employed as the irradiation device. A polymerization toner having an average particle diameter of about 6 μm is used for the toner filled in the development device. An intermediate transfer belt is used as the transfer device. A blade is used as the cleaning device while brought in contact with the image bearing member against the rotation direction of the image bearing member.

In addition, a solidified bar formed of zinc stearate is used as the lubricant material. As illustrated in FIG. 1, a pressure spring and a fur brush is structured, in which the fur brush scrapes zinc stearate to supply it to the surface of the image bearing member. Furthermore, an application blade is provided to apply zinc stearate on the surface of the image bearing member and avoid excessive attachment of zinc stearate on the surface of the image bearing member after zinc stearate is attached to the surface of the image bearing member. The applicator (blade) is brought in contact with the image bearing member along the rotation direction of the image bearing member.

Images are output at the initial stage and after 300,000 printing in a low temperature environment in which cleaning performance tends to be bad. Images are output in a single color of black or magenta and evaluated for the scrotron charger and the charging roller. No faults are observed with regard to the initial output images. The images obtained after 300,000 printing are evaluated for cleaning performance, and mottles caused by filming. In addition, after the machine running test using paper, the charging roller is observed with naked eyes with regard to contamination. In addition, the image bearing member is evaluated with regard to the degree of damage formed on the surface of the image bearing member and the amount of abrasion after the machine running using paper.

These results are shown in Table 4. The evaluation criteria are shown in Table 3.

TABLE 3

| Evaluation item | Cleaning performance | Filming | Charging roller (contamination) | Durability against damage |
|---|---|---|---|---|
| E | Excellent | None | Excellent | Not observed by naked eyes |
| G | Slightly bad with no practical problem | Roller Hardly contaminated | Several points contaminated | Observable by naked eyes but causing no problem |
| NG | Noticeable | Roller apparently contaminated (sticky) | Mottle deficiency Unpleasant level | Clearly damaged and surface texture changed |
| B | Causing practical problem | Roller contaminated all over | Recognized as problem | Extremely damaged causing problem |

Table 4-1

| Example/ Comparative Example | Manufacturing Example of image bearing member No. | Initial Wa (μm) | Initial WSm (μm) | After 300,000 printing Cleaning performance *B | Cleaning performance *M | Filming *B | Filming *M |
|---|---|---|---|---|---|---|---|
| Example 1 | 1 | 0.077 | 1.132 | G | G | G | G |
| Comparative Example 1 | 2 | 0.033 | 1.224 | NG | NG | NG | NG |
| Example 2 | 3 | 0.168 | 0.987 | G | G | E | G |
| Example 3 | 4 | 0.267 | 0.668 | E | E | E | E |
| Comparative Example 2 | 5 | 0.332 | 0.452 | NG | NG | NG | NG |
| Example 4 | 6 | 0.189 | 1.218 | G | G | E | G |
| Example 5 | 7 | 0.231 | 1.044 | E | E | E | E |
| Comparative Example 3 | 8 | 0.331 | 0.883 | NG | NG | NG | NG |
| Comparative Example 4 | 9 | 0.015 | 1.571 | NG | NG | NG | NG |
| Comparative Example 5 | 10 | 0.246 | 0.314 | NG | NG | NG | NG |
| Example 6 | 11 | 0.195 | 1.114 | G | G | E | E |
| Example 7 | 12 | 0.269 | 1.434 | G | G | G | G |
| Example 8 | 13 | 0.121 | 0.717 | G | G | G | G |
| Example 9 | 14 | 0.277 | 1.348 | G | G | G | G |
| Comparative Example 6 | 15 | 0.103 | 0.640 | B | B | NG | NG |
| Comparative Example 7 | 16 | 0.196 | 0.533 | NG | NG | NG | NG |
| Example 10 | 17 | 0.174 | 1.088 | G | G | E | E |
| Example 11 | 18 | 0.161 | 0.972 | G | G | E | G |
| Example 12 | 19 | 0.156 | 0.723 | G | G | G | G |
| Example 13 | 20 | 0.151 | 0.709 | G | G | G | G |
| Comparative Example 8 | 21 | 0.091 | 1.102 | NG | NG | NG | NG |
| Example 14 | 22 | 0.175 | 0.886 | G | G | E | G |

Table 4-2

| Example/ Comparative Example | Manufacturing Example of image bearing member No. | After 300,000 printing Charging roller (contamination) *B | Charging roller (contamination) *M | Durability against damage *B | Durability against damage *M | Abrasion amount (μm) *B | Abrasion amount (μm) *M |
|---|---|---|---|---|---|---|---|
| Example 1 | 1 | — | G | E | E | 0.2 | 0.2 |
| Comparative Example 1 | 2 | — | B | E | E | 0.2 | 0.2 |
| Example 2 | 3 | — | G | E | E | 0.2 | 0.2 |
| Example 3 | 4 | — | E | E | E | 0.2 | 0.2 |
| Comparative Example 2 | 5 | — | B | E | E | 0.2 | 0.2 |
| Example 4 | 6 | — | G | E | E | 0.2 | 0.2 |
| Example 5 | 7 | — | E | E | E | 0.2 | 0.2 |
| Comparative Example 3 | 8 | — | NG | NG | NG | 0.2 | 0.2 |
| Comparative Example 4 | 9 | — | B | E | E | 0.2 | 0.2 |
| Comparative Example 5 | 10 | — | NG | NG | NG | 0.2 | 0.2 |
| Example 6 | 11 | — | G | E | E | 0.2 | 0.2 |
| Example 7 | 12 | — | G | E | E | 0.2 | 0.2 |
| Example 8 | 13 | — | G | G | G | 0.6 | 0.6 |
| Example 9 | 14 | — | G | G | G | 0.3 | 0.3 |
| Comparative Example 6 | 15 | — | B | B | B | 0.9 | 1.0 |
| Comparative Example 7 | 16 | — | B | B | B | 1.0 | 1.1 |
| Example 10 | 17 | — | G | E | E | 0.2 | 0.2 |
| Example 11 | 18 | — | G | E | E | 0.2 | 0.2 |
| Example 12 | 19 | — | G | E | E | 0.2 | 0.2 |
| Example 13 | 20 | — | G | G | G | 0.2 | 0.2 |
| Comparative Example 8 | 21 | — | B | B | B | 0.4 | 0.5 |
| Example 14 | 22 | — | G | E | E | 0.2 | 0.2 |

*B = black:
*M = magenta

Comparative Example 9

An image forming apparatus without the lubricant material applicator using the image bearing member in Manufacturing Example 3 of Image bearing member is evaluated in the same manner as described above.

The results are shown in Table 5.

TABLE 5

| Example/ Comparative Example | Manufacturing Example of image bearing member No. | Initial Wa (μm) | Initial WSm (μm) | After 300,000 printing Cleaning performance *B | Cleaning performance *M | Filming *B | Filming *M |
|---|---|---|---|---|---|---|---|
| Copmarative Example 9 | 3 | 0.162 | 0.955 | B | B | NG | NG |

| Example/ Comparative Example | Manufacturing Example of image bearing member No. | After 300,000 printing Charging roller (contamination) *B | Charging roller (contamination) *M | Durability against damage *B | Durability against damage *M | Abrasion amount (μm) *B | Abrasion amount (μm) *M |
|---|---|---|---|---|---|---|---|
| Comparative Example 9 | 3 | — | B | B | B | 1.3 | — |

*B = black:
*M = magenta

Examples 15 to 28 and Comparative Examples 9 to 16

Another additional machine running test using paper is done for the image bearing members.

In the test, the lubricant material applicator is removed from the process cartridge and a toner containing zinc stearate is mixed in the development device to fill the development device. The zinc stearate contained in the toner is added in an amount of 0.15 parts by weight based on 100 parts of the mother toner and mixed with external additives.

The test is performed in the same manner except this and 100,000 sheets are additionally printed for image evaluation.

TABLE 6-1

| Example/ Comparative Example | Manufacturing Example of image bearing member No. | Initial Wa (μm) | Initial WSm (μm) | After 100,000 printing Cleaning performance *B | After 100,000 printing Cleaning performance *M | After 100,000 printing Filming *B | After 100,000 printing Filming *M |
|---|---|---|---|---|---|---|---|
| Example 15 | 1 | 0.077 | 1.132 | G | G | G | G |
| Comparative Example 9 | 2 | 0.033 | 1.224 | NG | NG | NG | NG |
| Example 16 | 3 | 0.168 | 0.987 | G | G | E | G |
| Example 17 | 4 | 0.267 | 0.668 | E | E | E | E |
| Comparative Example 10 | 5 | 0.332 | 0.452 | NG | NG | NG | NG |
| Example 18 | 6 | 0.189 | 1.218 | G | G | E | G |
| Example 19 | 7 | 0.231 | 1.044 | E | E | E | E |
| Comparative Example 11 | 8 | 0.331 | 0.883 | NG | NG | NG | NG |
| Comparative Example 12 | 9 | 0.015 | 1.571 | NG | NG | NG | NG |
| Comparative Example 13 | 10 | 0.246 | 0.314 | NG | NG | NG | NG |
| Example 20 | 11 | 0.195 | 1.114 | G | G | E | E |
| Example 21 | 12 | 0.269 | 1.434 | G | G | G | G |
| Example 22 | 13 | 0.121 | 0.717 | G | G | G | G |
| Example 23 | 14 | 0.277 | 1.348 | G | G | G | G |
| Comparative Example 14 | 15 | 0.103 | 0.640 | B | B | NG | NG |
| Comparative Example 15 | 16 | 0.196 | 0.533 | NG | NG | NG | NG |
| Example 24 | 17 | 0.174 | 1.088 | G | G | E | E |
| Example 25 | 18 | 0.161 | 0.972 | G | G | E | G |
| Example 26 | 19 | 0.156 | 0.723 | G | G | G | G |
| Example 27 | 20 | 0.151 | 0.709 | G | G | G | G |
| Comparative Example 16 | 21 | 0.091 | 1.102 | NG | NG | NG | NG |
| Example 28 | 22 | 0.175 | 0.886 | G | G | E | G |

*B = black:
*M = magenta

TABLE 6-2

| Example/ Comparative Example | Manufacturing Example of image bearing member No. | After 100,000 printing Charging roller contamination *B | After 100,000 printing Charging roller contamination *M | After 100,000 printing Durability against damage *B | After 100,000 printing Durability against damage *M | After 100,000 printing Abrasion amount (μm) *B | After 100,000 printing Abrasion amount (μm) *M |
|---|---|---|---|---|---|---|---|
| Example 15 | 1 | — | G | E | E | 0.2 | 0.2 |
| Comparative Example 9 | 2 | — | B | E | E | 0.2 | 0.2 |
| Example 16 | 3 | — | G | E | E | 0.2 | 0.2 |
| Example 17 | 4 | — | E | E | E | 0.2 | 0.2 |
| Comparative Example 10 | 5 | — | B | E | E | 0.2 | 0.2 |
| Example 18 | 6 | — | G | E | E | 0.2 | 0.2 |
| Example 19 | 7 | — | E | E | E | 0.2 | 0.2 |
| Comparative Example 11 | 8 | — | NG | E | E | 0.2 | 0.2 |
| Comparative Example 12 | 9 | — | B | E | E | 0.2 | 0.2 |
| Comparative Example 13 | 10 | — | NG | NG | NG | 0.2 | 0.2 |
| Example 20 | 11 | — | G | E | E | 0.2 | 0.2 |
| Example 21 | 12 | — | G | E | E | 0.2 | 0.2 |
| Example 22 | 13 | — | G | G | G | 0.6 | 0.6 |
| Example 23 | 14 | — | G | G | G | 0.3 | 0.3 |

TABLE 6-2-continued

| Example/ Comparative Example | Manufacturing Example of image bearing member No. | After 100,000 printing Charging roller contamination *B | After 100,000 printing Charging roller contamination *M | After 100,000 printing Durability against damage *B | After 100,000 printing Durability against damage *M | After 100,000 printing Abrasion amount (μm) *B | After 100,000 printing Abrasion amount (μm) *M |
|---|---|---|---|---|---|---|---|
| Comparative Example 14 | 15 | — | B | B | B | 0.9 | 1.0 |
| Comparative Example 15 | 16 | — | B | B | B | 1.0 | 1.1 |
| Example 24 | 17 | — | G | E | E | 0.2 | 0.2 |
| Example 25 | 18 | — | G | E | E | 0.2 | 0.2 |
| Example 26 | 19 | — | G | E | E | 0.2 | 0.2 |
| Example 27 | 20 | — | G | G | G | 0.2 | 0.2 |
| Comparative Example 16 | 21 | — | B | B | B | 0.4 | 0.5 |
| Example 28 | 22 | — | G | E | E | 0.2 | 0.2 |

*B = black:
*M = magenta

As seen in the results, no problems relating to cleaning, filming, or contamination on charging roller are observed and good images are produced after printing 300,000 images by using the protection layer that contains a cured resin and a filler and has a surface texture represented by the arithmetical mean waviness Wa of from 0.05 to 0.3 μm of the waviness profile and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm. In addition, damage on the surface of the image bearing member and abrasion thereof are extremely little or small so that the image bearing member is still usable. Furthermore, although not shown in Tables, the cleaning blade for use in these evaluations is scarcely chipped off or abraded during the machine running test. That is, the blade has an elongated working like length. In the case in which the lubricant material applicator is removed and the development agent and the lubricant material are mixed, the effect described above is stably sustained. That is, the image bearing member having the surface texture of the present invention maintains good performance regardless of the application method of the lubricant material.

To the contrary, in the case in which either or both of the arithmetical mean waviness Wa and the average length WSm of profile components are out of the range, problems such as bad cleaning performance, filming, or contamination on charging roller arise to surface, thereby apparently degrading the image quality. Furthermore, although not shown in Tables, the cleaning blade for use in these evaluations is significantly chipped off or abraded during the machine running test. That is, deterioration of the blade is severe. In addition, in the case in which no filler is added to the protection layer, bad cleaning performance, filming, or contamination on charging roller is significantly recognized, thereby greatly degrading abrasion resistance and durability. Furthermore, in the case in which the protection layer contains a filler and a thermoplastic resin is used as the binder resin contained therein, abrasion resistance and durability is not sufficient or sustainability on reducing bad cleaning performance, or contamination on charging roller during the machine running test is not satisfactory. In addition, when the lubricant material is not applied to the surface of the image bearing member, no problem occurs in the initial stage but damage or abrasion is severe after 300,000 printing and the image quality also significantly deteriorates. This deterioration occurs particularly in the roller charging system. The surface of the image bearing member using the roller charging system is so severely damaged that the amount of abrasion is not measured.

It is clear that application of a lubricant material is suitable in the present invention.

In addition, when the lubricant material applicator is removed and the development agent is mixed with the lubricant material, frequency of the occurrence of filming or bad cleaning performance increases and the application effect of the lubricant material decreases. Thus, it is found that the application method of a lubricant material affects the effect of the present invention.

The image forming apparatus of the present invention is advantageous in terms of the following.

According to the present invention, the working life length of the image bearing member is elongated. Abrasion of the image bearing member is reduced to a degree that abrasion is hardly observed. In addition, little damage is faulted or observed on the surface of the image bearing member even when images having a large image area are repetitively printed over an extended period of time. This is because the protection layer is formed of a cured resin, the mechanical strength thereof is increased by the addition of a filler and in addition, since the lubricant material is stably replenished on the surface of the image bearing member, the mechanical abrasion is reduced and the surface of the image bearing is protected from chemical deterioration caused by charing.

Furthermore, the image bearing member of the present invention demonstrates good cleaning performance and is free from filming. Thus, the image quality is sustained. This is because, due to the microscopic surface rough form and the macroscopic surface rough form of the surface of the image bearing member, the lubricant material is constantly replenished to the surface, thereby partially reducing the contact pressure between the image bearing member and the cleaning blade, which leads to stabilization of the behavior of the blade. Furthermore, since the image bearing member is hardly damaged or abraded during repetitive use over an extended period of time, the rough surface texture (form) of the image bearing member is stably maintained. This leads to a virtuous circle of stably sustaining improvement in the cleaning ability and prevention of filming.

In the case of the image forming apparatus using the charging roller, the charging roller is free from contamination because the cleaning ability is improved. Therefore, the charging is stably sustained, which contributes to sustainability of the image quality. In addition, since the behavior of the cleaning blade is stabilized and the excessive contact pressure is reduced, the blade is prevented from chipping off, cracking, or abrasion, thereby elongating the working life length of the blade.

Therefore, according to the present invention, the trade-off relationship between abrasion resistance and durability of an image bearing member and the cleaning property is cleared so that the image bearing member can have a good combination of both. Therefore, according to the present invention, an image forming apparatus is provided which stably produces quality images even when the image forming apparatus is repetitively used over an extended period of time. These technologies are suitable for the image forming apparatus used particularly in the printing field.

This document claims priority and contains subject matter related to Japanese Patent Applications Nos. 2009-150530 and 2010-103131, filed on Jun. 25, 2009, and Apr. 28, 2010, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member comprising an electroconductive substrate on which are provided at least a photosensitive layer and a protection layer, in that sequence;

a charging device that charges a surface of the image bearing member to form a latent electrostatic image thereon;

a development device that develops the latent electrostatic image with a development agent comprising toner to obtain a developed toner image;

a cleaning device that removes toner remaining on the surface of the image bearing member; and a lubricant material applicator that applies a lubricant material to the surface of the image bearing member, the protection layer comprising a cured resin and a filler, a surface form of the protection layer having an arithmetical mean waviness Wa of from 0.05 to 0.3 μm and an average length WSm of profile elements of from 0.5 to 1.5 μm, which are obtained from a waviness profile obtained by filtering a coarse component with a λc profile filter of 0.25 mm and filtering a wavelength component longer than a waviness with a λf profile filter of 2.5 mm.

2. The image forming apparatus according to claim 1, wherein the cured resin is a resin formed by curing a polymerizable compound having no charge transport structure and a polymerizable compound having a charge transport structure, the polymerizable compound having no charge transport structure comprises a polymerizable compound having at least three functional groups, and the number of functional groups of the polymerizable compound having a charge transport structure is one.

3. The image forming apparatus according to claim 2, wherein the functional groups of the polymerizable compound having no charge transport structure and the functional group of the polymerizable compound having a charge transport structure are either or both of an acryloyloxy group and a methacryloyloxy group.

4. The image forming apparatus according to claim 2, wherein the charge transport structure of the polymerizable compound having a charge transport structure is a triaryl amine structure.

5. The image forming apparatus according to claim 4, wherein the polymerizable compound having a charge transport structure is at least one kind of compounds represented by the chemical structure 12 and 13:

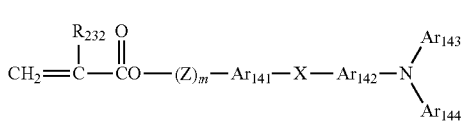

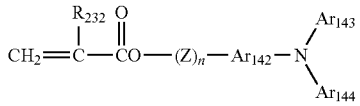

where $R_{232}$ represents hydrogen atom, a halogen atom, a substituted or non-substituted alkyl group, a substituted or non-substituted aralky group, a substituted or non-substituted aryl group, cyano group, nitro group, an alkoxy group, —$COOR_{241}$, wherein $R_{241}$ represents hydrogen atom, a substituted or non-substituted alkyl group, a substituted or non-substituted aralkyl group or a substituted or non-substituted aryl group, a halogenated carbonyl group or —$CONR_{242}R_{243}$, wherein $R_{242}$ and $R_{243}$ independently represent hydrogen atom, a halogen atom, a substituted or non-substituted alkyl group, a substituted or non-substituted aralkyl group or a substituted or non-substituted aryl group, $Ar_{141}$ and $Ar_{142}$ independently represent a substituted or non-substituted arylene group, $Ar_{143}$ and $Ar_{144}$ independently represent a substituted or non-substituted aryl group, X represents a single bond, a substituted or non-substituted alkylene group, a substituted or non-substituted cycloalkylene group, a substituted or non-substituted alkylene ether group, oxygen atom, sulfur atom, or vinylene group, Z represents a substituted or non-substituted alkylene group, a substituted or non-substituted divalent alkylene ether group or a divalent alkyleneoxy carbonyl group, and m and n represent an integer of from 0 to 3.

6. The image forming apparatus according to claim 1, wherein the filler has an average primary particle diameter of from 0.1 to 1.0 μm.

7. The image forming apparatus according to claim 1, wherein the filler is α alumina.

8. The image foaming apparatus according to claim 1, wherein the protection layer comprises a polycarboxylic compound.

9. The image forming apparatus according to claim 1, wherein the charging device employs a roller system comprising a charging roller provided in the vicinity of the image bearing member.

10. The image forming apparatus according to claim 9, wherein a voltage in which an alternating current component is overlapped with a direct current component is applied to the charging roller to charge the image bearing member.

11. The image forming apparatus according to claim 1, wherein the charging device employs a scorotron system in which the charging device is not in contact with the image bearing member.

12. The image forming apparatus according to claim 1, wherein the cleaning device has a blade form and is arranged in contact with the image bearing member against a rotation direction of the image bearing member.

13. The image forming apparatus according to claim 1, wherein the lubricant material applicator is integrated into with at least one of the charging device, the development device, and the cleaning device.

14. The image forming apparatus according to claim 13, wherein the lubricant material applicator is integrated with the development device and the lubricant material is applied to the surface of the image bearing member together with the toner when the development device develops the latent electrostatic image.

15. The image forming apparatus according to claim 1, wherein the lubricant material comprises zinc stearate.

16. The image forming apparatus according to claim 1, wherein a blade is provided between the cleaning blade and the charging device and arranged in contact with the image bearing member in a trailing direction relative to a rotation direction of the image bearing member.

17. The image forming apparatus according to claim 1, wherein multiple image formation elements are provided in a tandem arrangement, each of which comprises the image bearing member and at least one of the charging device, the development device, the cleaning device, and the lubricant material applicator.

18. The image forming apparatus according to claim 17, wherein one of the image formation elements comprises a combination of the development device using black toner and the charging device employing a scorotron system and the rest of the multiple image formation elements comprise a combination of the development device using a toner color other than black and the charging device employing a charging roller.

19. A process cartridge comprises:

an image bearing member comprising an electroconductive substrate on which are provided at least a photosensitive layer and a protection layer, in that sequence; and at least one of devices selected from the group consisting of a charging device that charges a surface of the image bearing member to form a latent electrostatic image thereon, a development device that develops the latent electrostatic image with a development agent comprising toner to obtain a developed toner image, a cleaning device that removes toner remaining on the surface of the image bearing member, and a lubricant material applicator that applies a lubricant material to the surface of the image bearing member, wherein the protection layer comprises a cured resin and a filler and a surface form of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm, and wherein the process cartridge is detachably attachable to the image forming apparatus of claim 1.

20. An image bearing member comprising:

an electroconductive substrate; and layers comprising a photosensitive layer and a protection layer laminated on the electroconductive substrate, in that sequence, wherein the protection layer comprises a cured resin and a filler and a surface form of the protection layer has an arithmetical mean waviness Wa of from 0.05 to 0.3 μm and an average length WSm of profile elements of from 0.5 to 1.5 mm, which are obtained from a waviness profile obtained by filtering a coarse component with a λc profile filter of 0.25 mm and filtering a wavelength component longer than a waviness with a λf profile filter of 2.5 mm.

* * * * *